US005360051A

United States Patent [19]

Takahashi et al.

[11] Patent Number: 5,360,051

[45] Date of Patent: Nov. 1, 1994

[54] CONTINUOUS CASTING METHOD AND APPARATUS FOR IMPLEMENTING SAME METHOD

[75] Inventors: Makoto Takahashi; Masami Temma; Atsuhiro Goto, all of Sakai, Japan

[73] Assignee: Nippon Steel Corporation, Tokyo, Japan

[21] Appl. No.: 73,649

[22] Filed: Jun. 8, 1993

Related U.S. Application Data

[60] Division of Ser. No. 700,118, May 10, 1991, Pat. No. 5,242,014, which is a continuation of Ser. No. 443,541, Nov. 30, 1989, abandoned.

[30] Foreign Application Priority Data

| | | | |
|---|---|---|---|
| Nov. 30, 1988 | [JP] | Japan | 63-303236 |
| Dec. 16, 1988 | [JP] | Japan | 63-317844 |
| Mar. 6, 1989 | [JP] | Japan | 1-053468 |
| Mar. 8, 1989 | [JP] | Japan | 1-055900 |
| Mar. 8, 1989 | [JP] | Japan | 1-055901 |

[51] Int. Cl.[5] ..... B22D 43/00

[52] U.S. Cl. ..... 164/155.3; 164/158; 164/270.1; 164/417

[58] Field of Search ..... 164/417, 418, 477, 158, 164/270.1, 155.3; 901/6, 47

[56] References Cited

U.S. PATENT DOCUMENTS

| | | | |
|---|---|---|---|
| 4,545,106 | 10/1985 | Juengel | 901/6 |
| 4,687,431 | 8/1987 | Stengelin | 164/158 |
| 4,732,554 | 3/1988 | Hellmann | 901/6 |
| 5,078,140 | 1/1992 | Kwoh | 901/6 |

FOREIGN PATENT DOCUMENTS

| | | | |
|---|---|---|---|
| 3400896 | 8/1985 | Germany . | |
| 3425488 | 1/1986 | Germany . | |
| 49-28569 | 7/1974 | Japan . | |
| 54-71723 | 6/1979 | Japan . | |
| 57-146455 | 9/1982 | Japan | 164/418 |
| 60-96355 | 5/1985 | Japan | 164/418 |
| 62-142463 | 9/1987 | Japan . | |
| 62-270263 | 11/1987 | Japan | 164/472 |
| 1118350 | 5/1989 | Japan | 164/472 |

OTHER PUBLICATIONS

Patent Abstracts of Japan vol. 9, No. 107 (M-378) (1830) May 11, 1985; & JP-A-59229267 (Mitsubishi) 22 Dec. 1984.

Patent Abstract of Japan vol. 10, No. 342 (M-536) (2398) Nov. 19, 1986; & JP-A-61144249 (Kawasaki) 1 Jul. 1986.

Patent Abstracts of Japan vol. 9, No. 179 (M-399) (1902) Jul. 24, 1985; & JP-A-60049846 (Simitomo) 19 Mar. 1985.

*Primary Examiner*—P. Austin Bradley
*Assistant Examiner*—Rex E. Pelto
*Attorney, Agent, or Firm*—Pollock, Vande Sande & Priddy

[57] ABSTRACT

A multi-articulated arm in a continuous casting machine which interacts with a melt surface condition within a mold, including melt surface abnormalities such as boiling and lack of powder, and a condition of slag beard formation by using image sensors, and also detects a condition of Deckel formation by using a load sensor through a sensor rod, thereby controlling a casting speed, a flow rate of gas blown into a pouring nozzle, a flow rate of a melt poured into the mold, scatter of powder to prevent the occurrence of the melt surface abnormalities. Additionally, said arm can remove a slag beard by a hitting oscillator and removing Deckels by the sensor rod. Those works can be performed following priority thereof by a multi-functional robot equipped with a multi-articulated arm having at its distal end an automatic tool changer mechanism.

8 Claims, 26 Drawing Sheets

CONTINUOUS CASTING METHOD AND APPARATUS FOR IMPLEMENTING SAME METHOD

This is a divisional of 700,118, filed on May 10, 1991 now U.S. Pat. No. 5,242,014, which is a continuation of Ser. No. 443,541, filed on Nov. 30, 1989, now abandoned.

BACKGROUND OF THE INVENTION

The present invention relates to a method and an apparatus for continuously casting metals while preventing the occurrence of various undesired abnormal conditions in the mold surface.

Continuous casting is a method of drawing a molten metal being poured into a casting of constant cross-section, and allows to produce, for example, bars having a circular or rectangular cross-section, pipes and plate-like products. Such a casting method is used for producing castings of, for example, aluminum, copper alloys, cast iron, and steel. To describe continuous casting of steel, for example, a molten material (or melt) is poured from a ladle into a tundish and then from the tundish into a water-cooled mold. A casting emerging out of the mold is supported by a multiplicity of rolls when it is cooled by water. Pinch rolls are disposed under the supporting rolls for slightly pressing the casting to draw it into desired products. The drawn part is cut by a cutter upon reaching a certain length. On the other hand, a lubricant is supplied to inner surfaces of the mold to prevent the casting from sticking thereto. The tundish includes a nozzle to prevent entrainment of impurities into the melt when it enters from the tundish into the mold, so that the melt should be poured with the distal end portion of the nozzle kept always immersed in the melt within the mold.

For example, continuous casting of steel, in particular, has various difficult problems occur which have impeded complete automation of work, especially in the process related to pouring of a melt into a mold. Such problems will be explained in more detail below.

A. Problem of Melt Surface Abnormalities

The associated system including a continuous casting mold (hereinafter referred to simply as mold) comprises 1) a mold, 2) a pouring nozzle, including a lower nozzle, an upper nozzle and a dipped nozzle, which is disposed at the center area of the mold and mounted to the bottom of a tundish, 3) a sliding nozzle (hereinafter referred to simply as SN), or melt (molten steel) flow rate controller utilizing, for example, a stopper, 4) a flow rate controller of gas blown into the pouring nozzle (hereinafter referred to simply as blown gas) for capturing and surfacing inclusions or deoxidation products present in the melt within the mold, and preventing the pouring nozzle from being clogged by the inclusions or deoxidation products, 5) a melt surface level controller, and the like. The blown gas is discharged into the melt surface, which means the surface of contents including molten steel, molten flux and non-molten flux, within the mold, while mold powder or mold flux is charged (or scattered) into the mold for the purposes of heat-keeping, thermal insulation and anti-oxidation of the melt within the mold, capture of deoxidation products or inclusions, and lubrication between a solidified shell and the mold, for instance. The powder or flux is melted upon contacting the melt (or molten steel) to form a molten layer, followed by flowing into gaps between the mold and the solidified shell to effect the various above explained functions. Further, vertical oscillations are applied to the mold to ensure smooth drawing of a casting, while the melt surface within the mold is constantly fluctuated or moved warily with the melt discharged through the pouring nozzle. The melt discharged through the pouring nozzle under such conditions is cooled by the mold and others to start solidifying while forming a meniscus at the top surface of the melt in conformity with the mold.

Thus, in the associated apparatus components and mechanism including a mold, the above mentioned factors are present in a intermixed and complicated state, which factors are delicately balanced in a stable condition of the entire casting system. In other words, the associated apparatus components and mechanisms including a mold contain very complex fluctuating factors, and are always in such an unstable slate that the process is varied largely just by changing some operated variable to a small extent. For example, boiling may occur just by slightly changing a flow rate of the gas blown into the pouring nozzle. The casting system is therefore very sensitive to operational fluctuating factors such as fluctuations in an amount of the melt in the tundish or casting speed, and clogging of the pouring nozzle. Once the balance is lost, there may immediately occur abnormalities, such as level fluctuations, boiling, biased flow and lack of powder, on the melt surface within the mold, such as, so called in this specification melt surface abnormalities. The boiling is a phenomenon that inert gas fed into the tundish, the upper nozzle or the dipped nozzle and then blown into the melt within the mold for the purposes of, e.g., preventing the dipped nozzle from being clogged, is boosted to such an extent as to hinder the melt from flowing from the tundish into the dipped nozzle, and the boosted gas is then blown out at a burst from discharge holes (for example, two) of the dipped nozzle. In the event of this phenomenon, the flames are flared up temporarily from the melt surface and the melt level is lowered. These melt surface abnormalities may directly cause problems including a break-out (hereinafter referred to simply as BO) which is most desirable in the continuous casting operation, and may also directly lead to defect of the surface quality attributable to capture of the powder onto the solidified shell. Thus, keeping the associated apparatus components and mechanisms including a mold stable at all times is the most important point not only in preventing the occurrence of BO, but also in carrying out continuous casting operation steadily while ensuring the quality of castings at the surface and thereabout.

Conventionally, therefore, the melt surface conditions are being monitored within the mold and many detecting means have also been proposed for monitoring. For example, Japanese Patent Unexamined Publication No. 60-49846 discloses a method in which an infrared camera for scanning the melt surface is installed above a mold to measure a temperature distribution over the melt surface thereby to detect a thickness of and its distribution over a powder layer. Japanese Patent Unexamined Publication No. 54-71723 discloses a method of selecting two or more wavelength bands of light radiated from the melt surface within a mold and measuring a temperature of the melt surface from the ratio of light energy level between those wavelength bands, thereby to detect a condition of lack of powder. Japanese Patent Unexamined Publication No. 59-229267 discloses a method of arranging the tip end of an optical fiber to sense (or scan) the melt surface and measuring an electric signal in accordance with an amount of light emitted from the melt surface, thereby to detect a condition of lack of powder. However, those conventional methods do not allow precise detecting of the lack of the powder due to the fact that flames or the like caused upon the gas blown into a pouring nozzle flowing into a mold may erroneously be detected as lack of the powder, or because the melt surface is constantly moved wavily with, for example, oscillations of a mold, the detecting means may be affected by large fluctuations of a temperature condition at the melt surface, or light disturbance caused upon the molten part of the powder or by flames moving warily to appear or disappear with time. Another problem is in that since the temperature measuring device, the infrared camera or the optical fiber, requires a scanning time and a relatively long time for detecting a scattered condition of the powder throughout the melt surface within a mold, the melt surface condition may be changed during the detection process, making it impossible to take a necessary action with the proper timing. Furthermore, in the event of abrupt melt surface abnormalities such as biased flow and boiling mentioned above, the conventional methods can only perform the process of detecting lack of the powder and hence could not detect such abrupt melt surface abnormalities.

Although there have also been proposed techniques of providing thermocouples embedded in a mold wall or mounting a magnetic sensor, an infrared camera or the like above a mold, thereby to a melt surface level, these detecting devices are intended to detect only a melt surface level for controlling constant level, and hence cannot directly detect the melt surface abnormalities such as biased flow, boiling and lack of powder.

As described above, any of the conventional detecting methods had only a single function, and was difficult to quickly and precisely detect a condition of the melt surface in a stable manner. Thus, in actual circumstances various units and devices are arranged intricately in a narrow space near a mold and under high-temperature, dust-full environments, and there is no practical detecting device capable of detecting a condition of the melt surface with high reliability under such unfavorable conditions. To date, therefore, it has been customary for an expert skilled operator to monitor a condition of the melt surface and judge the occurrence of melt surface abnormalities based on his past experience and perception.

As mentioned above, if the associated apparatus components and mechanisms including a mold are out of balance to cause melt surface fluctuations or the melt surface abnormalities such as biased flow, boiling and lack of powder, it has been usual in the past that the operator monitoring the melt surface visually detects such an abnormal condition of the melt surface and immediately takes a proper action based on the detected result. Because the action to balance and stabilize the associated apparatus components and mechanisms including a mold requires quickness and precision, the conventional methods have had to rely on an expert skilled operator, and this has been a big obstacle in an attempt of saving labor expenses.

Notwithstanding such relying on expert skilled operators, there exists a large difference between the operators, and also frequently occurs a delay in detection or erroneous detection, which may cause variations in the quality of castings. In an extreme case, a delay in the proper action may lead to BO.

B. Problems Related to Blow of Inert Gas

In continuous casting of steel, it is common to once store a melt (molten steel) fed through a ladle in a tundish and then pour the melt from the tundish into a mold through a pouring nozzle.

In this case, the melt includes impurities such as deoxidation products, for example, $Al_2O_3$, or powder, slag and sulfides (hereinafter referred to collectively to "inclusions"). If any inclusions are captured and left in a casting, this would give rise to various drawbacks for example, causing internal defects called slag intrusion or surface flaws. Further, $Al_2O_3$ and the like among the inclusions tend to adhere on the inner surface of the nozzle while passing therethrough and eventually accumulate to such an extent as to clogging the pouring nozzle, whereby the stable operation is hindered n many cases.

It has been known to provide means for effectively separating inclusions from the melt and moving them to the melt surface. For example, Japanese Patent Examined Publication No. 49-28569 discloses a technique of blowing inert gas such as argon or nitrogen gas into a flow of the melt while being poured into a mold, thereby effectively move inclusions to the melt surface. This technique has been adopted widely in recent years. Also, Japanese Utility Model Unexamined Publication No. 62-142463 discloses a device for calculating an appropriate data to control a flow rate of gas based on, for example, the flow rate of the melt determined from the head size of the melt, the width and thickness of castings, and the casting speed.

However, in either prior art where the flow rate of blown gas is visually adjusted by an operator, or where it is automatically controlled using the control device, it has been usual to measure a flow rate of the gas flowing through a pipe for being blown into the melt, to control a value of the gas flow rate. However, the reading on a flow gauge installed in the pipe does not always correspond to the flow rate of the gas actually flowing into the melt, because a portion of the gas may leak during the process before reaching the melt, for example, at refractories employed to form a flow passage, or the pressure loss in the flow passage may be changed. It may also happen that the gas blown into the melt flows into a mold along the wall surface of the pouring nozzle and then escapes above the tundish in vain without effecting the specific function. The ratio of an amount of the gas having been blown into the melt but leaked to an amount of the effective gas having been blown into the melt and reached the mold through the pouring nozzle changes dependent on operating conditions. Therefore, in the conventional techniques it has been very difficult to properly control an amount of the effective gas. If the amount of the effective gas is not properly controlled and the amount of the blown gas exceeds a required level, the flow rate of the gas would become unstable and the melt surface within the mold would be largely disturbed, thereby eventually causing a phenomenon in which the melt would not flow into the pouring nozzle, for example boiling. On the contrary, if the amount of the blown gas is reduced to be too small, the stable operation becomes hard to continue because of clogging of the pouring nozzle and other troubles.

Thus, using the conventional techniques may cause boiling and clogging of the pouring nozzle, due to a difference between an amount of the gas flowing through the pipe and an mount of the effective gas as resulted from measuring a flow rate of the gas in the blowing pipe, or due to difficulties in quantitatively adjusting a flow rate of the gas in a stable manner as experienced even when the operator monitors a condition of the melt surface within the mold and adjusts the flow rate of the gas based on the monitored result.

C. Problem of Slag Beard Formation

As well known, powder is supplied (or scattered) over the melt surface within a mold in continuous casting for the purposes of heat-keeping and air shutdown of the melt, capture of nonmetallic inclusions, and lubrication between a solidified shell and the mold, for instance. The powder is melted upon being subjected to heat of the melt, and fluidized to move from the melt surface along the wall surface of the mold. While moving along the wall surface of the mold, the molten powder is cooled by the mold, but heated by the melt. Meanwhile, vertical oscillations are applied to the mold a solidified shell from sticking to the mold surface. Therefore, the powder, once melted, is caused to become solid again and adhere onto the wall surface of the mold in a region just above the solidifying interface of the melt. Such adhesion of the powder gradually increases an amount of the deposited powder with progress of casting, so that the raw powder projects out of the wall surface of the mold in the form of a terrace, thereby forming a slag beard.

A slag beard is responsible for not only a detrimental effect on the quality of castings, but also more serious trouble in the continuous casting operations. For example, if the melt surface is abruptly raised up for some reason in the presence of a slag beard, the slag beard would be captured by a solidified shell and cause a serious defect in the surface quality of castings. In the worst case, the slag beard captured by the solidified shell just below the mold is forced to melt again upon being subjected to heat of the melt or the solidified shell, which may result in a BO (or break-out), which is more detrimental in the continuous casting operation.

In view of the above, it is most preferable to carry out the operation in such a manner as to avoid the occurrence of a slag beard. However, because of complicated thermal conditions produced just above the solidifying interface, it is very difficult to suppress the occurrence of a slag beard itself.

In the past, however, there have been no methods of detecting a condition of the slag beard formation with good precision. At most, only a method of measuring a temperature of the mold, estimating adhesion of the powder onto the wall surface of the mold based on temperature changes, and predicting formation of a slag beard has been proposed in some cases. Thus, in practice the detecting method using such indirect measuring means is poor in its precision and cannot be adopted in actual apparatus. For the reason, with a technique having been generally adopted to date, an operator directly visually monitors a condition in the mold to detect a condition of the slag beard formation. If a slag beard is detected being formed, the operator pushes or pokes the slag beard by a proper stick to peel it and remove from the wall surface of the mold. This imposes very great physical and mental burden on the operator, and also gives rise to a safety problem. In addition, it has frequently happened that the operator erroneously damages a solidified shell and hence causes a defect in the surface quality of castings. In an extreme case, a BO may be caused. Avoiding such problems requires expert skilled operators, which has been a big obstacle in an attempt of achieving the automated casting operation in continuous casting.

As one of means for removing a slag beard, for example, Japanese Patent Unexamined Publication No. 61-144249 proposes a method of irradiating heat flux such as an infrared ray or laser beam to the slag beard for melting and removing it. However, even such a method has to rely on human efforts to detect the formation of a slag beard, and also requires a great deal of additional energy to melt the slag beard. The case of using a laser beam results in a significant increase in the equipment cost.

D. Problem of Deckel Formation

A Deckel (German) is in the form of so-called "leather cover" which results from solidification of a surface layer of the molten steel or steel bath, when actual and latent heat of the steel bath are removed from the bath surface in a mold for continuous casting. If Deckels are formed, nonmetallic inclusions present in the bath, which should be properly captured by mold powder, would instead be captured by the Deckels to remain in a casting, thereby detrimentally affecting quality of the casting. Also, if a Deckel is formed all over the surface of the steel bath, this would cause more serious operational problems such as a BO and breakage of a dipped nozzle. For the reason, it is required to prevent the formation of a Deckel during continuous casting. However, when the molten steel poured into the mold has a temperature as low as that of the liquid line, or when the casting speed is low, Deckels may be formed because of the reduced temperature of the bath within the mold.

Meanwhile, mold powder is supplied (or scattered) over the bath surface within the mold for the purposes of heat-keeping and thermal insulation of the bath, capture of non-metallic inclusions, and lubrication between a solidified shell and the mold, for instance. Therefore, a condition of the Deckels formation cannot be judged visually. Under such environmental situations, there have been neither devices for detecting the formation of Deckels nor devices for removing the formed Deckels in the past. Thus, it has conventionally been customary for an operator to thrust a proper stick of steel into the melt within the mold for sensing the formation of Deckels based on a feeling perceived by his hands. If Deckels are judged to be formed, the operator pushes the Deckels into the bath using that stick so that it is melted once again.

The foregoing conventional method in which the operator detects and remelts Deckels is inefficient because of manual operation, and the operator is subjected directly to the melt or bath and hence safety is not ensured. In addition, unskilled operators may disturb the solidifying interface between the mold and the solidified shell, thereby causing surface flaws on castings. To improve reliability, therefore, the operation have had to rely on a few skilled operators.

On the other hand, although technical development of achieving the automated casting operation in continuous casting has been actively performed in these years, the operation of detecting the formation of Deckels cannot be automated by utilizing optical detection with image processing, for example, because it is impossible to visually detect the Deckels as mentioned above, and hence has been a big obstacle in an attempt of realizing automated casting operation.

E. Problems Related to Automation of Operations

It can be considered to carry out by a robot operations associated with pouring of a molten steel into a mold. To this end, the above described problems A–D have to be solved. Solving of those problems requires to monitor and recognize process conditions changing from time to time as mentioned in A–D, determine necessary actions based on self-judgment dependent on the recognized conditions, and then implement a plurality of selected actions. However performance and operation control of robots have faced problems as follow.

As to the contents of operation and control relating to utilization of industrial robots, the robots from the simplest ones to those capable of repetitively executing a series of operations, as represented by the teaching and playback system, are now within a practicable range and mainly used. In other words, present industrial robots are applied to only such operations as palletizing, painting, feeding, welding and simple assembling which can be executed through simple control of working positions, and hence can be regarded as robots having not perceptual and judgment abilities, but power of memory alone, because they are controlled only by performing reproductive operations of working timings, working contents and position data which have been taught beforehand. Changes of environments are hardly assumed in use of this type robots, and their operations are carried out essentially under the assumption that the objects to be handled are always in certain positions. Furthermore, being basically capable of repetitive operations as mentioned above, industrial use of those robots is restricted to relatively simple works.

For enlarging an application range of industrial robots, therefore, it has been attempted to use various sensors and control operation of the robot based on information detected by the sensors. More specifically, the attempted method is to detect a condition of operating environments around the robot, and control operation of the robot while determining working timings, working contents and working positions of the robot based on the detected environmental condition. Sensors employed in robots include mainly touch, load (force), visual (image) and audible sensors. As to visual sensors among them, for example, some systems have already been developed to a practicable level through combination of a TV camera and an image processing unit. The contents of visual control are carried out by sequentially recognizing an environmental condition by a visual sensor to determine the process of work, and then issuing a command to a control system. Since the information obtained by the visual sensor ms related to only positions and attitudes, the control to be effected can be achieved through just position control. Stated otherwise, even when a visual function is added to a robot, the control system of robot operation can itself be used as it was. With widespread use of visual sensors using CCDs (see page 37), therefore, operation control of robots utilizing a visual sense is going ahead in an application level of other types sensors. As to load (force) and touch sensors, there exists simple load control of converting only a setting value for a position command based on a load or touch detected signal, and then controlling a position in accordance with the setting value. Although even such simple control can sufficiently execute some works, its application range is restricted. In most cases of using load sensors, it is demanded to continuously control the load so that the vector magnitude in the form of load is controlled to De constant or to provide a predetermined pattern. This type of control is more difficult than the simple load control, and hence problematic under the present state of art. As explained above, operation control of robots utilizing sensors ms now practiced mainly by making use of visual sensors in such a manner as to sequentially control positions, etc. based on detected signals in a large part of applications.

Meanwhile, from the standpoint of multi-functions of robots, there has been used an automatic tool changer (hereinafter referred to as ATC) which has a function capable of easily attaching and detaching tools to the tip end of the robot. But, such multifunctional robots are comparable in level of operation and its control to that as mentioned above, and basically applied to simple works as represented by the teaching and playback system. Operation control of multi-functional robots using sensors (mainly visual sensors) to perform a plurality of works is also comparable in level to that as mentioned above, and limited in application to the field of sequential control.

In short, the technology of utilizing robots remains at the level as mentioned above in the present stage of art. Notwithstanding intensive study for next stage robots, only few have reached a satisfactory level. Stated otherwise, changes of operating environments around robots are not taken into account, and much attention is not paid to the process of recognizing a varying condition of environments and determining the working program, for example, based on the recognized condition. Thus, there are mainly in use robots having no perceptual and judgment abilities necessary to program their own operation control depending on changes of operating environments. At the present stage of art, efficiency and reliability of works executed by robots are regarded as more important than perceptual and judgment abilities thereof.

From the foregoing reasons, conventional robots have faced difficulties in their application to the working process where operating environments to be adopted are changed from time to time, and a plurality of working contents and/or working positions have to be determined by the robots themselves dependent on varying conditions of the operating environments detected by sensors, thereby to perform necessary works. Accordingly, that working process have had to be carried out in such situations through direct operations by plural skilled operators using jigs or the like, or indirect operations by operators using a plurality of manipulators, or introduction of multiple robots as mentioned above for relatively simple works. That working process therefore requires a great deal of equipment and man power costs, and also reduces working efficiency. In addition, a safety problem has been experienced because the operators have had to work in the midst of manipulators and robots.

The present invention has been accomplished in view of the foregoing problems as stated in A–E.

BRIEF SUMMARY OF THE INVENTION

One object of the present invention is to provide a method and an apparatus for precisely and quickly detecting melt surface abnormalities in a mold, and effectively preventing their formation based on the detected result, to maintain stable continuous casting operation. The above-mentioned melt surface means the surface of contents, including molten steel, molten flux (or slag), non-molten flux and Deckels, within the mold.

Another object of the present invention is to provide a method which can always ensure a required amount of effective gas precisely following fluctuations in operating conditions or fluctuations in an amount of gas leak through a nozzle and a pipe, if occur, thereby to produce castings excellent in quality without causing problems such as boiling and nozzle clogging.

Still another object of the present invention is to provide a method of detecting a slag beard with good accuracy during operation, and an apparatus for effectively removing the slag beard based on the detected result, thereby making it possible to achieve the automated casting operation while maintaining the stable continuous casting operation.

Still another object of the present invention is to detect and remove Deckels formed in the mold during continuous casting.

Still another object of the present invention is to provide an automated control device or a robot suitable for fulfilling the above mentioned objects. More specifically, this object is to implement efficient multi-functional works, in such working process where operating environments to be adapted are changed from time to time, and hence where a plurality of working contents have to be determined and carried out dependent on varying conditions of the operating environments detected by sensors, through the procedures of using a robot to carry out plural works, controlling the preset priority of works dependent on information applied from the sensors and working conditions of the robot, and then scheduling and deciding the working program so as to perform necessary works with maximum efficiency.

To achieve the above objects, in accordance with a first feature of the present invention, there is provided a method of detecting a melt surface abnormal condition in a mold for continuous casting, comprising the steps of installing one or more pairs of image sensors for detecting a melt surface condition at positions above the mold, which has a pouring nozzle being disposed in the center area of an upper opening portion of the mold, the image sensors being opposed to one another with the pouring nozzle located therebetween; converting input images of a melt surface condition, which are periodically applied from the image sensors to binary images using a reference threshold level for discriminating the image regions into light portions and dark portions; determining an area ratio Rn of the light portions to the entire melt surface region in the viewing fields of the image sensors; determining a change rate Dn of the light portion area ratio Rn per unit time; and detecting an abnormal condition of the melt surface based on preset correlation between the light portion area ratio Rn and/or the change rate Dn and a melt surface abnormal condition.

According to one embodiment of the above method, the change rates Dn for the respective melt surface regions on the opposite sides of the pouring nozzle are compared with preset reference values of the change rate Dn for the respective melt surface regions; the occurrence of boiling is determined when both of the change rates Dn for the respective melt surface regions on the opposite sides of the pouring nozzle exceed the reference values; and the occurrence is determined when only either one of the change rates Dn exceeds the corresponding reference value, thereby detecting an abnormal condition of the melt surface.

According to another embodiment of the above method, each of the respective melt surface regions in the viewing fields of the image sensors is subdivided into plural preset zones and a light portion area ratio Rnn and a change rate Dnn of the light portion area ratio Rnn per unit time for each of the divided zones are determined; the light portion area ratio Rnn and the change rate Dnn are compared with respective preset reference values for each of the divided zones; and a lack condition of powder is determined when the light portion area ration Rnn exceeds the threshold level, but the change rate Dnn does not exceed the reference value, thereby detecting lack of powder as one of melt surface abnormalities and positions where the powder is short.

According to another feature of the present invention, there is provided a method of preventing a melt surface abnormality, which performs any one or more of casting speed control, flow rate control of gas blown into the pouring nozzle, flow rate control of melt poured into the mold, and powder scatter control dependent on a melt surface condition detected by the above method.

According to still another feature of the present invention, there is provided, as a device for eliminating a lack of powder condition, a melt surface abnormality preventing device comprising a powder supply unit for storing a preset amount of powder and capable of being opened at the bottom thereof or turned; a feed unit for feeding powder to the powder supply unit; a multi-articulated support arm supporting at its distal end the powder supply unit and capable of rotating and moving up and down; a drive unit for driving the support arm; and a powder supply controller for controllably driving the powder supply unit and the drive unit in response to detected signals indicating lack of powder and it's position.

According to still another feature of the present invention, there is provided a continuous casting method of pouring a melt stored in a tundish into a mold for continuous casting through a pouring nozzle, while blowing inert gas to the melt, comprising the steps of installing one or more image sensors above the mold for picking up images of the melt surface within the mold; processing image signals detected by the image sensors during continuous casting to detect the number of bubbles floating up to the melt surface and/or the size of flames flared up on the melt surface; comparing each of the detected values with allowable limit values previously determined from correlation between an amount of blown gas and the number of bubbles or the size of flames in the event of boiling or nozzle clogging; and immediately controlling the amount of blown gas when the number of bubbles and/or the size of flames exceeds the corresponding allowable limit values, thereby ensuring a proper mount of blown gas.

According to still another feature of the present invention, there is provided a slag beard formation detecting method in continuous casting comprising the steps of disposing one or more pairs of image sensors for detecting a melt surface condition at positions above a mold, which has a pouring nozzle being disposed in the center area of an upper opening portion of the mold, the image sensors being opposed to one another with the pouring nozzle located therebetween; determining distribution of brightness along at least one check line intersecting the wall surface of the mold based on image input signals of a melt surface condition periodically applied from the image sensors; determining a distance between two positions where the distribution of brightness shows a maximum value and a minimum value; and estimating a condition of slag beard formation from the determined distance.

According to still another feature of the present invention, there is provided a slag beard removing device comprising a multi-articulated arm capable of rotating and moving up and down and having at the distal end a hitting oscillator with an oscillation applying mechanism; a drive unit for driving the arm; and a controller which, by using one or more pairs of image sensors for detecting a melt surface condition installed at positions above a mold, which has a pouring nozzle being disposed in the center area of an upper opening portion of the mold, the image sensors being opposed to one another with the pouring nozzle located therebetween, performs the steps of determining distribution of brightness along at least one check line intersecting the wall surface of the mold based on image input signals of a melt surface condition applied from the image sensors from time to time; determining a distance between two positions where the distribution of brightness shows a maximum value and a minimum value; and issuing a command signal to start driving the hitting oscillator and a command signal to determine a position where the hitting oscillator is to be operated, based on a condition of slag beard formation estimated from the determined distance.

According to still another feature of the present invention, there is provided a Deckel formation detecting device comprising a sensor rod dipped into the melt surface within a mold for continuous casting; a multi-articulated support arm supporting at the distal end the sensor rod and capable of rotating and moving up and down; a drive unit for driving the support arm; and a load sensor for detecting the load exerted on the sensor rod, thereby detecting a condition of Deckels formation from the load exerted on the sensor rod dipped into the melt surface within a mold.

Also, there is provided Deckel removing device which further comprises a comparison operation controller for comparing a detected value of the load sensor with a preset Deckel formation reference value, and issuing a command to drive the drive unit when the detected value exceeds the reference value.

Finally, according to still another feature of the present invention, there is provided a multi-functional robot which can be used as a universal industrial robot and is particularly suitable for use in continuous casting operation. This robot comprises a multi-articulated support arm having at the distal end an automatic tool changer mechanism (hereinafter referred to simply as ATC) and capable of freely moving to rotate and shift up and down, and a drive controller for driving the support arm. Specific features of the robot are as follows:

i) an input section for receiving signals from, at least, one or more visual sensors installed near a working region and/or at the distal end of the support arm for picking up images of the working region of the robot, a load sensor installed near the automatic tool changer mechanism for detecting the load exerted on a tip end of a tool, and a process detecting sensor for detecting operating situations of a process to be handled by the robot;

ii) a judging section for processing the input signals in accordance with the sequence previously established, and judging situations in the working contents of the robot and the working regions of the robot at the current time;

iii) a setting section for previously setting priority of the working positions and the working contents based on the current operating conditions of the process to be handled by the robot and situations in the working region of the robot;

iv) a comparing and deciding section for comparing respective signals from the judging section and the setting section to each other, and scheduling and deciding the highest-priority or most efficient working content dependent on the current situation; and v) a control section for issuing at least one of a tool change command signal to the automatic tool changer mechanism, a drive control signal to the support arm drive controller, and a control signal to the process based on decision of the working contents made by the comparing and deciding section.

Other objects and features of the present invention will become apparent from the following description of respective embodiments with reference to the accompanying drawings.

BRIEF DESCRIPTION OF THE DRAWINGS

FIG. 1 is a conceptual overall view showing one embodiment of the present invention explaining a continuous casting apparatus.

FIGS. 2 and 3 are images picked up by a pair or cameras installed above a mold.

FIGS. 4 and 5 are other examples of picked-up images.

FIGS. 6 and 7 are images resulting from converting the images of FIGS. 4 and 5 to a binary representation.

FIG. 8 is a graph showing time-dependent changes in the area of light portions.

FIG. 9 is a graph result from eliminating disturbances in the graph of FIG. 8.

FIG. 10 is a graph showing time-dependent changes in the light portion area ratio during the continuous casting operation.

FIG. 11 is a graph showing change rates per unit time in the light portion area ratio during the continuous casting operation.

FIGS. 12 and 13 are examples of dividing the respective images into multiple zones.

FIGS. 14 and 15 are graphs, similar to FIG. 10, showing time-dependent changes in the light portion area ratios for the respective divided zones.

FIGS. 16 and 17 are graphs, similar to FIG. 11, showing change rates per unit time in the light portion area ratios for the respective divided zones.

FIG. 18 is a conceptual view showing one example of a powder supply unit used in the present invention.

FIG. 19 is a view showing one example of a powder supply jig used in the present invention.

FIG. 20 is a view showing one example of a powder supply reservoir used in the present invention with dimensions thereof;

FIGS. 21, 22, 23 and 24 are views showing other example of the powder supply reservoir.

FIG. 25 is a view showing an embodiment of implementing the present invention in a general continuous casting equipment.

FIGS. 26 and 27 are illustrations showing binary images taken by a pair of image sensing devices in which; FIG. 26 shows a state where bubbles are produced and FIG. 27 shows a state where flames are flared up.

FIG. 28 is a graph showing one example of an examined result of the relationship between the number of bubbles and a flow rate of blown gas, FIG. 29 is a graph showing one example of an examined result of the relationship between the area of flames and a flow rate of blown gas.

FIG. 30 is a sectional view and a graph showing a partial section illustrative of a melt surface condition in a mold, and brightness distribution obtained by picking up an image of the region near the mold corresponding to the melt surface condition shown in that partial section, respectively.

FIG. 31 is a block diagram showing one example of a slag beard formation detecting device.

FIG. 32 is a plan view showing one setting example of check lines used for detecting a slag beard thickness.

FIG. 33 is a graph showing one example of detecting a condition of slag beard formation in thickness.

FIG. 34 is a block diagram showing one example of a slag beard detecting and removing device.

FIG. 35 is a graph showing time-series changes in the slag beard thickness resulted from operation of a slag beard detecting and removing device.

FIG. 36 is a block diagram showing one example of a Deckel formation detecting device used in the present invention.

FIG. 37 is an enlarged sectional view of a mold in which the Deckel is formed.

FIG. 38 is a graph showing one example of an examined result of load changes due to formation of the Deckel.

FIG. 39 is a block diagram showing an example of a Deckel removing device of the present invention.

FIG. 40 is a graph showing one example of load data detected by a load sensor in a practical example.

FIG. 41 is a block diagram showing an overall concept of a multi-functional robot of the present invention.

FIG. 42 is a block diagram showing one example of the multi-functional robot of the present invention.

FIG. 43 is a plan view of images picked up by a pair of cameras installed above a mold.

FIG. 44 is a plan view of the images of FIG. 43 converted to a binary representation and divided into multiple zones.

FIG. 45 is a front view for explaining the principles of measuring a slag beard.

FIG. 46 is a plan view showing working positions for measuring and removing the slag beard in the mold.

FIG. 47 is a graph showing one example of load data detected by a load sensor when a sensor rod is dipped into the melt surface.

FIG. 48 is a plan view showing working positions for measuring and removing Deckels in the mold.

DETAILED DESCRIPTION OF THE PREFERRED EMBODIMENTS(S)

The following description relates to an embodiment solving the problem of melt surface abnormalities (see the above section A).

Figure 1:
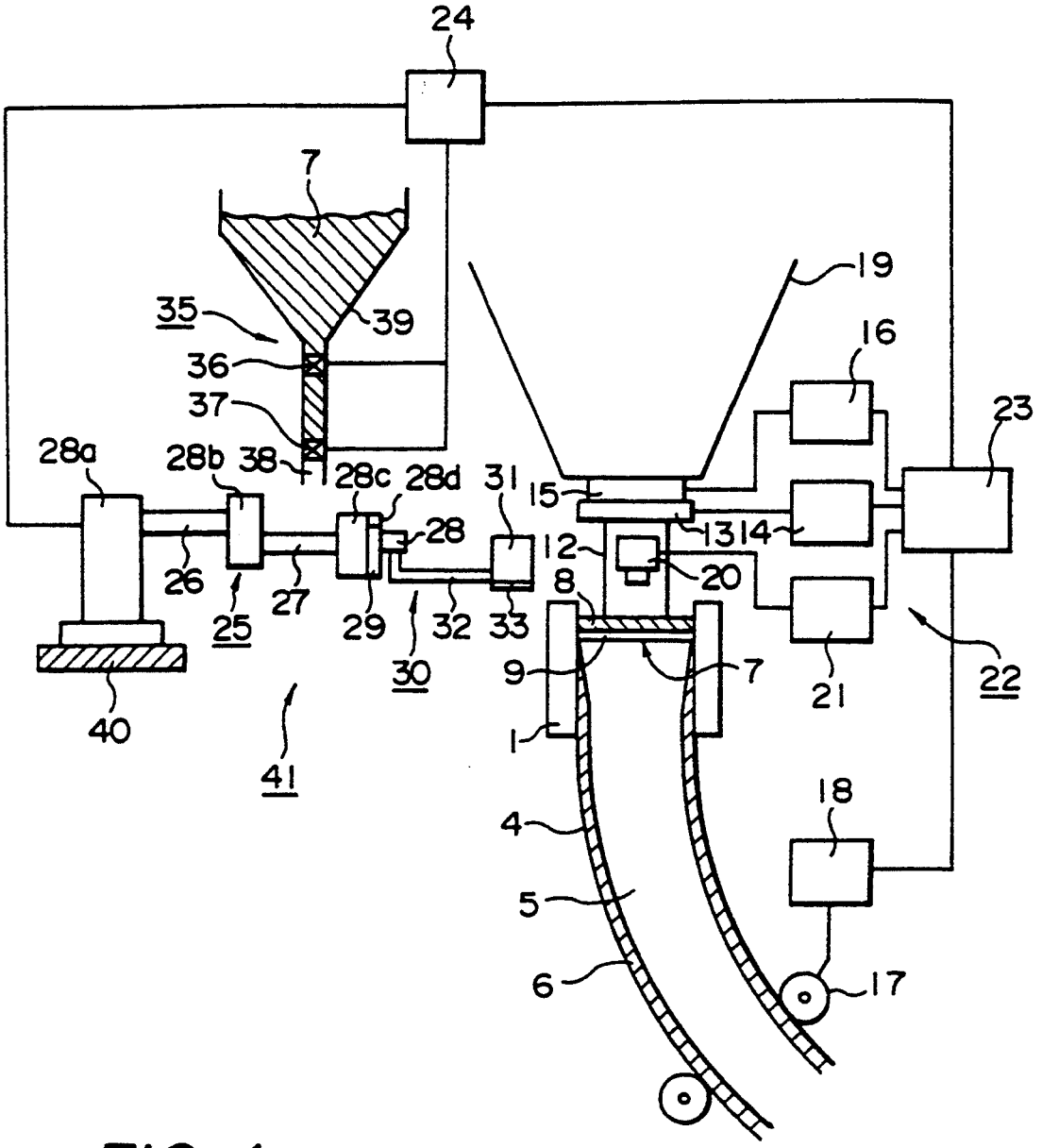
FIGS. 1 to 24 are a first group of drawings related to an embodiment I.

FIG. 1 is a view showing one example of an overall concept of the present invention. In FIG. 1, designated by reference numeral 1 is a mold, 4 is a casting being cast into products, 5 is a melt (molten steel), 6 is a solidified shell produced from the melt 5 upon cooling thereof, and 7 is powder supplied (or scattered) in the mold 1 to mainly form a non-molten powder layer 8 and a molten powder layer 9, also in FIG. 1, numeral 12 is a pouring nozzle being of the SN (sliding nozzle) type in this embodiment, and 13 and 14 are flow rate controllers for the melt. Designated as 15 and 16 are flow rate controllers for gas blown into the pouring nozzle 17 and 18 are controllers for a casting speed of the casting 4, and 19 is a tundish.

Further, designated as 22 is a melt surface abnormal condition detecting device and 41 is a melt surface abnormality preventing device. The melt surface abnormal condition detecting device 22 comprises a pair of image sensors 20 installed above the melt surface within the mold at positions opposite to each other with the pouring nozzle 12 located therebetween; an arithmetic processing unit 21 for processing input images of a melt surface condition applied from the image sensors 20 from time to time, as described later, and detecting a melt surface abnormal condition such as biased flow, boiling or lack of powder; and a controller 23 for instructing, based on detection of a melt surface abnormal condition, various actions (described later) to be carried out for stabilizing the melt surface abnormality, and issuing control commands to the respective devices and units.

In this embodiment, although the image sensors 20 are installed in one pair at positions opposite to each other with the pouring nozzle 12 located therebetween, two or more pairs may be provided when the entire region of the melt surface within the mold cannot be covered by only one pair of image sensors in their viewing fields.

The melt surface abnormality preventing device 41 comprises a powder supply unit 30, a multi-articulated support arm 25 supporting the powder supply unit 30 at the distal end thereof, a feed unit (or feeder) 35 for feeding powder to the powder supply unit 30, a drive unit 28 for driving the support arm 25, and a powder supply (or scatter) controller 24 for driving and controlling the powder supply unit 30 and the support arm 25 based on detected signals relating to the occurrence of lack of powder and the lack of powder position. The powder supply unit 30 has a cup-like reservoir 31 for storing a preset amount of the powder 7. The reservoir 31 is, as described later, arranged to be open at its bottom or turnable. The support arm 25 comprises a plurality of arms (two arms 26, 27 in this embodiments) interconnected through arm drivers 28*a*–28*c* each having a rotatable shaft built therein, so that the arms can be rotated about the respective rotatable shafts in an articulated manner. In addition, the support arm 25 is provided at the distal end thereof with a lift driver 28*d* and a lift frame 29 to provide a vertical movement ability. The powder supply unit 30, specifically, the reservoir 31 connected to the distal end of the support arm 25 through a connector 28, can thus be moved back and forth as well as up and down above the melt surface within the mold 1.

Although the support arm 25 of the horizontally articulated type is used in this embodiment, any desired type arm may be employed so long as it allows the powder supply unit 30 to freely move within the mold 1. From the inventors experience, however, the above mentioned horizontally articulated arm has been found to be preferable because a space around the mold 1 and the tundish 19 is usually very small and narrow. Also, the combination and number of respective components of the support arm 25 and the drive unit 28 may be determined appropriately dependent on an installation space in the working site so as to ensure effective operation.

In response to a command from the powder supply (or scatter) controller 24, the reservoir 31 can be moved to a predetermined location within the mold 1, and the powder 7 can then be supplied by opening the bottom of the reservoir 31 or turning (tilting) it. In this embodiment, the support arm 25 and the feed unit 35 of the powder 7 are mounted on a base 40 on which the tundish 19 is rested. But, a part or all of those system components, for example, the multi-articulated support arm 25 and the drive unit 28 for driving the support arm 25, may be constituted in self-propelled fashion, as required.

Next, a method of detecting a melt surface abnormal condition will be described below.

Brightness of the melt surface within the mold 1 appears in a very wide range from a dark state where the melt surface is entirely covered with the non-molten powder 8, to a light state as found in the event of boiling where the melt surface is covered with flames caused when the gas blown into the pouring nozzle 12 is discharged to the melt surface within the mold 1 in a large amount, or with the molten powder 9 exposed or emerged upon violent and wavy movement of the melt surface. Brightness of the melt surface is also constantly fluctuated due to oscillations of the mold, discharge of the blown gas, and emergence of the molten powder layer 9. Paying attention to such fluctuated condition of brightness of the melt surface, the inventors have studied correlation between that fluctuated condition and the melt surface abnormalities. First, to precisely detect brightness of the melt surface, an image sensor 20 was installed in positions above and facing the melt surface within the mold 1. Since the pouring nozzle 12 is disposed at the center of the mold 1, use of the single sensor 20 is difficult for viewing the whole of the mold 1 and cannot precisely detect brightness of the melt surface with such high accuracy as intended by the present invention. Therefore, the image sensor 20 is installed as a pair at positions opposite to each other with the pouring nozzle 12 located therebetween, or in two or more pairs when the entire melt surface region within the mold cannot be covered by a total viewing field of one pair of image sensors for the reason of size of castings to be cast. Although the image sensor 20 can be of any desired type, for example, a camera utilizing a vidicon generally used in video cameras, the inventors have employed, as a result of close study, CCD or C-MOS cameras using solid-state image sensors which can be easily reduced in size and are preferable to cope with phenomena of image burning and residual images. This is due to the fact that because brightness of the melt surface is constantly fluctuated in a fairly wide range as mentioned above, such cameras are required to be durable against phenomena of image burning and residual image, and also to be small from the standpoint of a space available above the mold. Incidentally, the CCD or C-MOS cameras are adjusted in irises such that they become substantially saturated in the event of boiling.

Figure 2:
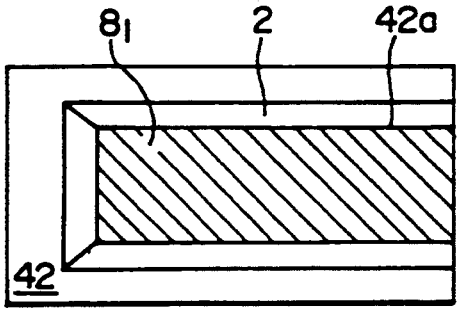
Figure 3:
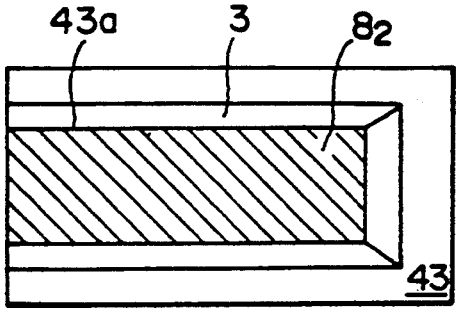

FIGS. 2 and 3 are images of the melt surface picked up by the CCD or C-MOS cameras, each of the images representing a melt surface condition within the mold on either side of the pouring nozzle. It is assumed that FIG. 2 is an N-side image and FIG. 3 is an S-side image. The cameras are so disposed as to leave the pouring nozzle out of their viewing fields, because the pouring nozzle is always in a light state during casting operation. In FIGS. 2 and 3, designated by 2, 3 are wall surfaces of the mold 1 contacting with the casting 4 being cast into products and the powder $8_1$, and $8_2$ is non-molten powder layer of the powder 7 supplied (or scattered) over the melt surface. An original image 42 or 43 as shown in FIG. 2, 3 is input to the arithmetic processing unit 21 which processes only an image **42*a* or 43*a* in a frame corresponding to the melt surface region within the mold hatched in FIG. 2 or 3 for detection of the melt surface abnormality based on the input image, as described later. For practical use of the present invention, a profile of the image 42*a* or 43*a* corresponding to the melt surface region within the mold is not necessary, defined strictly along the boundary between the mold wall surface 2 or 3** and the melt surface region.

Figure 4:
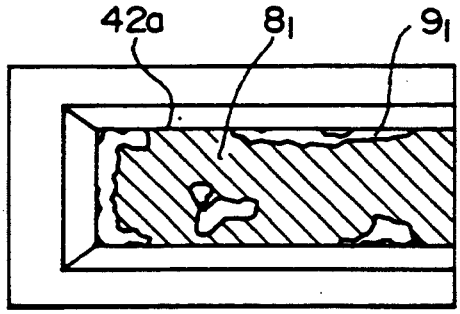
Figure 5:
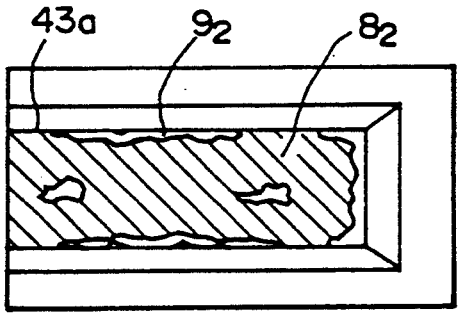
Figure 6:
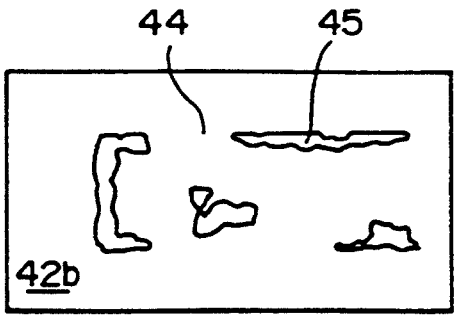
Figure 7:
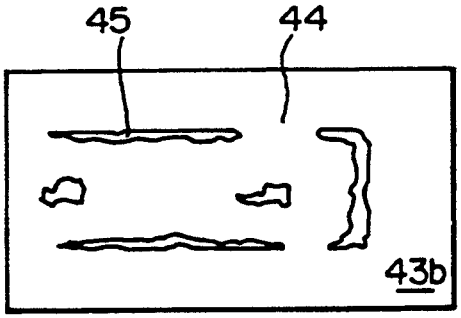

The inventors have examined correlation between the above images and a melt surface abnormal condition from the various standpoints. At the outset, a reference threshold level was set between brightness of the non-molten powder layer 8 and brightness of the molten powder layer 9 to process the input image for conversion to binary, or light and dark representation in such a manner that respective pixels jointly constituting the input image are judged to be dark if pixel's brightness is comparable to that in a case where the melt surface is covered with the non-molten powder layer 8, and to be light if pixel's brightness is comparable to that in a case where the molten powder surface 9 is emerged to the melt surface. FIGS. 4 and 5 are other examples of the N-side and S-side images, showing states where the molten powder layers 9 are emerged in the non-molten powder layers 8 within the melt surface regions **42*a*, 43*a*, respectively, FIGS. 6 and 7 are binary images 42*b*, 43*b* resulting from converting the input images of a melt surface condition corresponding to FIGS. 4 and 5 to a binary representation, respectively, by the above mentioned method. In these binary images 42*b*, 43*b*, the emerged parts of the molten powder layers 9 over the melt surface are indicated as light portions 45, while the remaining non-molten powder layers 8 are indicated as dark portions 44**.

Next, the inventors determined the ratio of the area of the light portions in the binary images, such as, the emerged parts of the molten powder layer 9, (hereinafter referred to as light portion area) to the entire regions of the melt surface within the viewing fields of the cameras corresponding to the melt surface regions **42*a* and 43*a* (that is, total area of the emerged parts of the molten powder layer 9 and the remaining non-molten powder layer 8), that is, the ratio of the light portion area to the melt surface area within the viewing fields of the cameras (that ratio is called the light portion area ratio in this specification and hereinafter referred to simply as area ratio Rn), and then also examined time-dependent changes in the area ratio Rn. The reason for using the area ratio here is because various examinations have revealed that the regions 42***a*, 43*a* corresponding to the entire melt surface to be observed do not necessarily become the same area at all times due to varying size of castings to be cast into products, for example, and also varied in area for different melt surface abnormal phenomena or even the same melt surface abnormal phenomenon, thereby leading to difficulties in steadily detecting the respective melt surface abnormal phenomena in a quantitative manner. In view of the above, it has been decided to calculate the area ratio of the light portion area in the melt surface to the regions 42*a*, 43*a* corresponding to the entire melt surface to be observed. It should be understood that in a case where the melt surface abnormal condition can be detected and processed constantly under the same conditions for the regions 42*a*, 43*a* corresponding to the entire melt surface to be observed, an absolute value of the area may be used rather than the area ratio in relation to the detecting procedures explained below.

Figure 8:
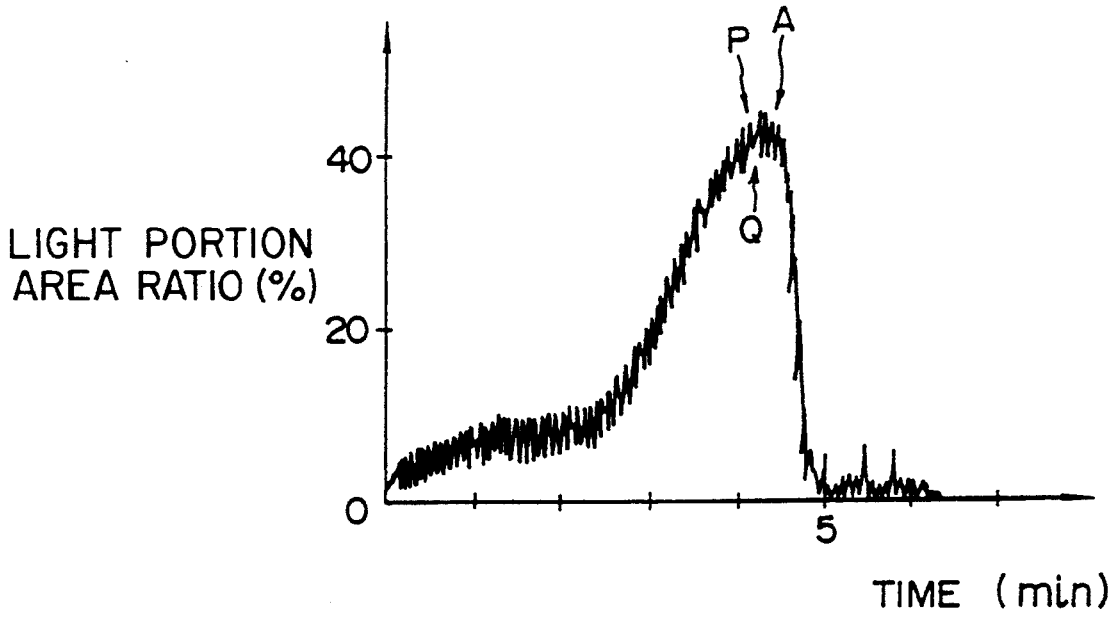

FIG. 8 is a graph showing one example of an examined result during the casting operation, in which the vertical axis represents the area ratio Rn and the horizontal axis represents the lapse of time.

In this example that there occurred lack of powder as one of the melt surface abnormalities, parallel to measurement of the area ratio, a skilled operator monitored a melt surface condition and scattered powder from his judgment at the time point indicated by an arrow A in FIG. 8. It will thus be seen that the area ratio Rn is increased with the lapse of time and then abruptly reduced at the time of scatter of the powder.

In FIG. 8, fine fluctuations of the area ratio Rn as indicated by arrows P, Q are caused by oscillations of the mold 1. Specifically, when the melt surface is relatively risen up upon a descent of the mold 1, the molten powder layer 9 is marged in a large part to provide the maximum as indicated by P.

Figure 9:
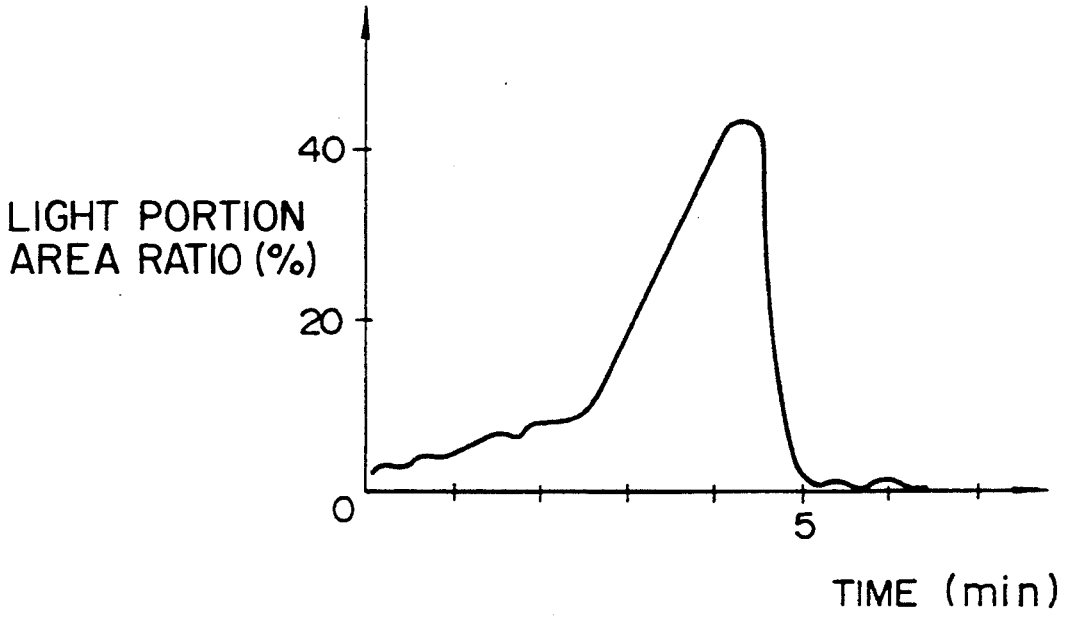

Conversely, when the mold 1 is ascended, the emerged part of the molten powder layer 9 is hidden and the non-molten powder layer 8 occupies a larger part, thereby providing the minimum as indicated by Q. In addition, the gas blown into the pouring nozzle is periodically discharged to and disappears from the melt surface corresponding to oscillations of the mold 1, and this can also produce the fine fluctuations including extreme. Stated otherwise, the area ratio Rn is finely fluctuated due to wavy movement of the melt surface caused by the mold oscillations and the like. In the method of precisely detecting a melt surface condition, the fluctuations like P, Q caused by, for example, the mold oscillations become disturbances which are objectionable for the arithmetic processing to detect the melt surface abnormality. Accordingly, the effect of such disturbances has to be eliminated. As one eliminating method, it can be considered to calculate a time-series average of instantaneous values of the light portion area detected at respective preset time points. While depending on a length of the time for the time-series average, processing becomes relatively intricate in this method. Besides, in order to precisely eliminate the disturbances, a length of the time for calculating the time-series average must be prolonged to some extent (at least longer than an oscillating period of the mold). Accordingly, the resulting increased processing time is unfavorable for the purpose of detecting a melt surface abnormal condition precisely and quickly. In this embodiment, therefore, the logical products of the binary images 42*b* and 43*b* are taken during a duration corresponding to the oscillating period of the mold 1, thereby to eliminate periodic or abrupt fluctuations of the light portion area in the melt surface images. FIG. 9 shows a processed result obtained by taking the logical products of the binary images in the region corresponding to that of FIG. 8. It will be seen that there scarcely appear fine fluctuations in the processed result of FIG. 8, and the time-dependent changes in the area ratio Rn is clarified to ensure more stable detection, as a result of satisfactory elimination of the disturbances.

Figure 10:
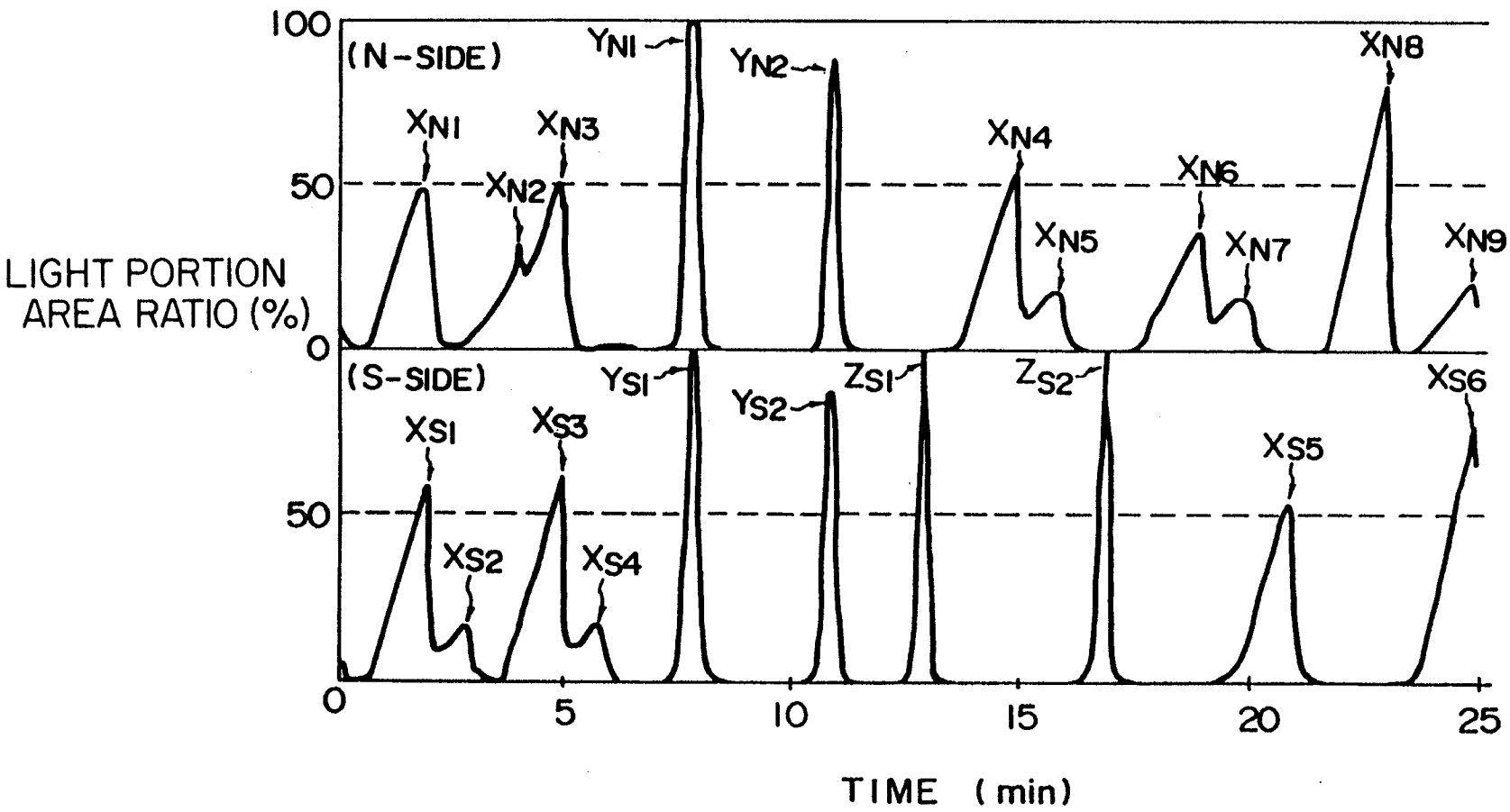
Figure 11:
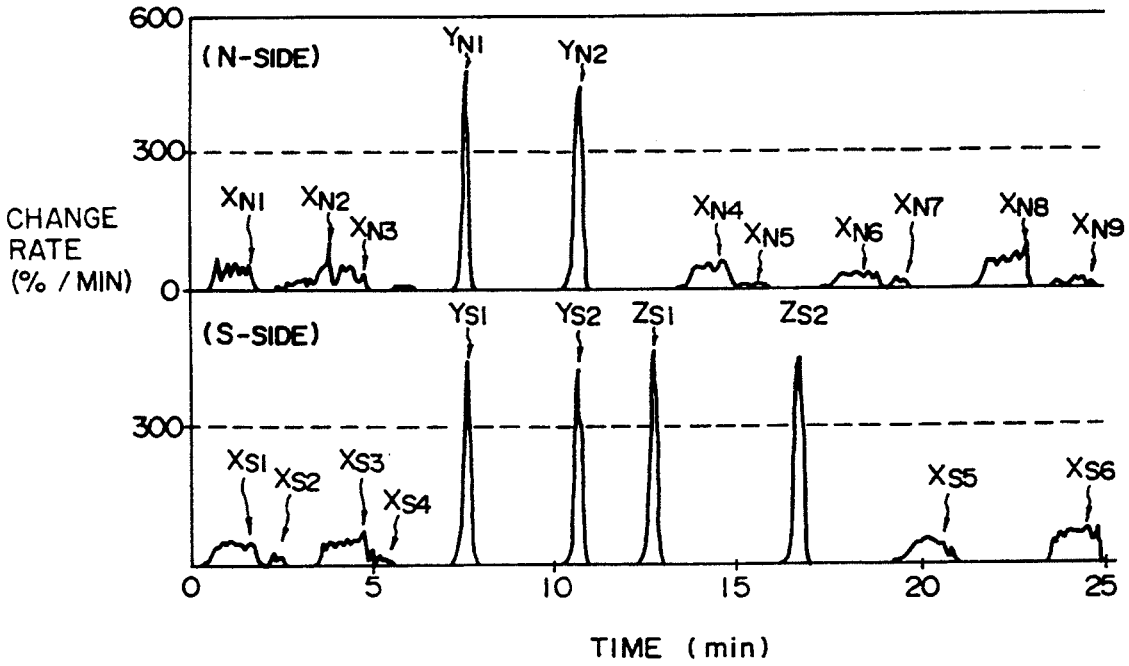

The time-dependent changes in the area ratio Rn for the mold during the casting operation were measured while eliminating the disturbances by the above method. FIG. 10 shows one example of a measured result of the area ratio Rn. FIG. 10 comprises a set of upper and lower graphs which correspond to the results obtained by processing, through the above described manner, the input images from the N- and S-sides, that is, from the two cameras installed in positions opposite to each other with the pouring nozzle located therebetween, respectively. Thus, the upper graph represents the processed result of the N-side image, while the lower graph represents that of the S-side image. In FIG. 10, arrows X, Y and Z indicate the timings at which the melt surface abnormalities such as lack of powder (powder scatter), boiling and biased flow occurred, respectively, Subscripts indicate the side, N-side or S-side, and the number of occurred times from the start of measurement. In this embodiment, parallel to the above measurement, a skilled operator monitored a melt surface condition and, when some melt surface abnormality occurred, he took an action to stabilize that melt surface abnormality. The arrow X represents an example where lack of powder occurred and the powder was scattered at the arrow x from judgment of the operator. It will be seen that the area ratio Rn is increased with the lapse of time and then abruptly reduced at the same time as scatter of the powder. Likewise, at the arrows, Y, Z representing the occurrence of boiling and biased flow, respectively, any one or more of the following, casting speed control, flow rate control of the gas blown into the pouring nozzle, flow rate control of the melt poured into the mold, and scatter of the powder, were carried out based on the judgment of the operator to solve the melt surface abnormalities. In any cases, the timings selected to eliminate the melt surface abnormalities match those timings at which the area ratio Rn is abruptly reduced. From FIG. 10, correlation between the abnormal phenomena occurred in the melt surface and the time-dependent changes in the area ratio Rn is apparent. But, while FIG. 10 makes clear a qualitative tendency that leads to the respective abnormal phenomena, the area ratios Rn at the timings to take actions are somewhat different from one another and not enough stable in level to ensure precise detection of the abnormal phenomena. This means the necessity of further quantative evaluation of the data. Therefore, change rates Dn of the area ratio Rn per unit time were examined. FIG. 11 is a graph showing the change rates Dn with the lapse of time, in which the horizontal axis represents a time base on the same scale as that of FIG. 10. Note that the change rates after the timings to eliminate the melt surface abnormalities, that is , negative change rates, are not shown in FIG. 11, because those change rates correspond to a decrease in the area ratio Rn incidental to, for example, scatter of the powder and hence are meaningless for detection of an abnormal condition.

From such evaluation, it is first found that the occurrence of biased flow and boiling can be precisely detected based on the area ratio Rn and the change ratio Dn thereof shown in FIGS. 10 and 11. More specifically, the area ratio Rn is relatively varied and not stable in level as indicated by $Y_{N1}$, $Y_{S1}$ and $Y_{N2}$, $Y_{S2}$, such that it may sometimes take a level comparable to that in a case of lack of powder. However, the change rate of the area ratio Rn is at most 150%/min at the occurrence of lack of powder, while it shows a much larger value beyond 300%/min at the occurrence of biased flow and boiling. Further, such large positive change rates are observed on only either one side with respect to the pouring nozzle Like $Z_{S1}$, $Z_{S2}$ at the occurrence of biased flow, but are observed substantially at the same time on both the opposite sides of the pouring nozzle at the occurrence of boiling. It was thus found that the occurrence of biased flow and boiling could be detected distinctively from comparison of the change rates Dn of the area ratios Rn obtained for the opposite sides. Here, am the occurrence of boiling, the area ratios for the corresponding sides or zones are relatively varied due to flames of the blown gas and the like. In other words, the area ratios Rn are saturated up to 100% in some cases like $Y_{N1}$, $Y_{S1}$, but not saturated up to 100% in other cases like $Y_{N2}$, $Y_{S2}$. The latter cases where the area ratios Rn are not saturated up to 100% correspond to a phenomenon that the melt surface is forced to warily move due to a light degree of boiling, so-called rippling phenomenon. Since the rippling phenomenon can be eliminated or prevented in the similar manner as that in the event of boiling, there is usually no need to further discriminate rippling from boiling. On demand, however, such discrimination can be made by detecting whether or not the value of the area ratio Rn is saturated at the occurrence of abnormality.

Then, for detection of an abnormality related to the powder, that is, lack of powder, it was found that both the area ratio Rn and the change rate Dn were required to be taken into consideration. This is because, in FIGS. 10 and 11, some area ratios Rn as indicated by arrows $X_{N8}$, $X_{S6}$, for example, may have a level comparable to that in a case of boiling (rippling) as indicated by arrows $Y_{N2}$, $Y_{S2}$, while the changes rates Dn of the area ratios Rn per unit time are always significantly small as high as 150%/min, as mentioned above. However, also as stated above, the area ratio Rn and the change rate Dn observed at the occurrence of lack of powder are both relatively varied and not stable in level. This is attributable to the fact that those zones in the melt surface which are subjected to lack of powder are not uniformly distributed over the whole area, but localized into some parts, that is the zones subjected to lack of powder are changed in the mold between the pouring nozzle and the short side wall opposite thereto on each of the N- and S-sides, namely, in a direction of width of the mold, whereby the light portions are also changed corresponding to the varying area of the zones subjected to lack of powder. Accordingly, it is required for the detection of lack of powder to monitor the melt surface within the mold in a quantitative manner for both positions and conditions of the lack of powder thereat. Therefore, the images 42*a* and 43*a* of the melt surface within the mold were each subdivided into multiple zones.

Here, the division into multiple zones is made in accordance with the mode or state how lack of powder occurs. This point will be taken into further consideration below. Since the powder is melted and then consumed while flowing into between the mold walls and a casting, lack of powder is frequently caused along the mold walls as a phenomenon appeared on the melt surface. In general, however, the powder is in the form of fine particles or granules which have a rest angle of about 30°–60° in either case, so that the scattered powder will not be kept at one location. Therefore, the powder at the center in a direction of thickness of the mold, in both non-molten and molten states, tends to move in all directions on the plane of the melt surface with wavy movement of the melt surface due to oscillations of the mold. Here, the movement mode of the powder on the melt surface within the mold is dependent on fluctuations of the melt surface, entire mass balance of the powder over the melt surface, thermal balance of the powder in a molten state, and the like. Thus, lack of powder may happen at the central region at a direction of thickness of the mold. Specifically, it has been found from observation of the melt surface that, while undergoing some variations, the powder is usually moved in a direction of thickness of the mold at a speed comparable to or about four times that in a direction of width the mold. Further, although the powder can be scattered in various manners, it is in any case followed that, the powder is supplied not at a single point, but over some supply zone. From the foregoing, the division of the image into too many zones is apparently ineffective and meaningless, because it reduces a processing speed for recognition of a melt surface abnormality, which in turn leads to a delay in detection and hence beginning of a necessary action to be taken, thereby increasing the probability of an outbreak of any operational trouble such as sticking type BO (breakout), for instance. Accordingly, in view of the above mentioned movement mode of the powder, it is sufficient to divide the image into three or less zones in a direction of thickness of the mold, and into the zones in number from the nearly same number as the above to four in a direction of width of the mold.

Figure 12:
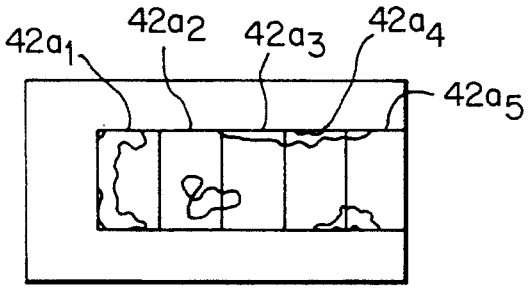
Figure 13:
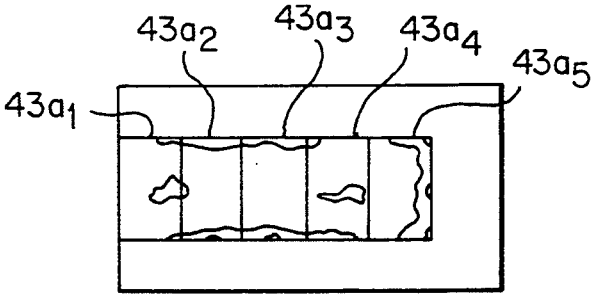
Figure 14:
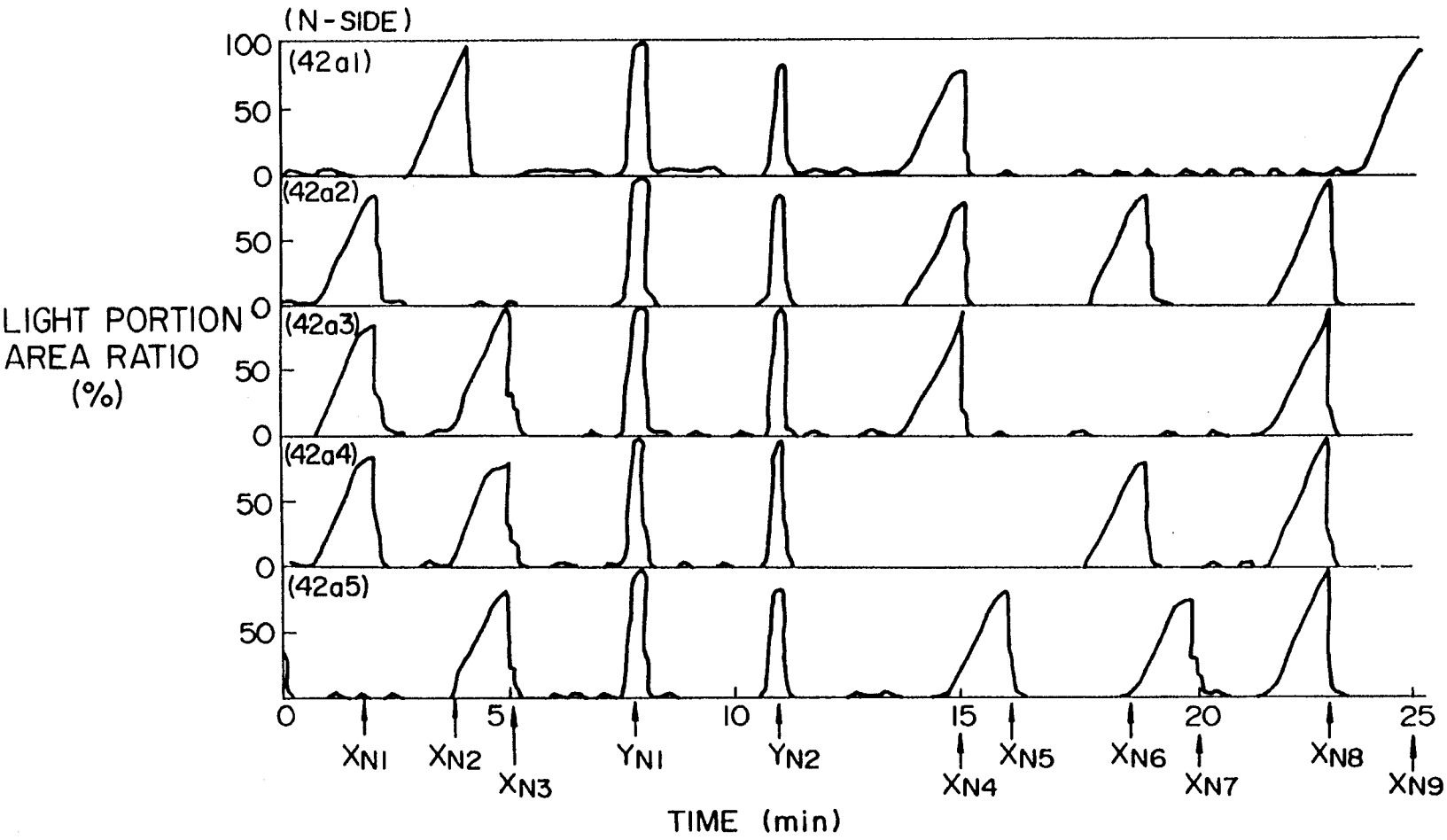
Figure 15:
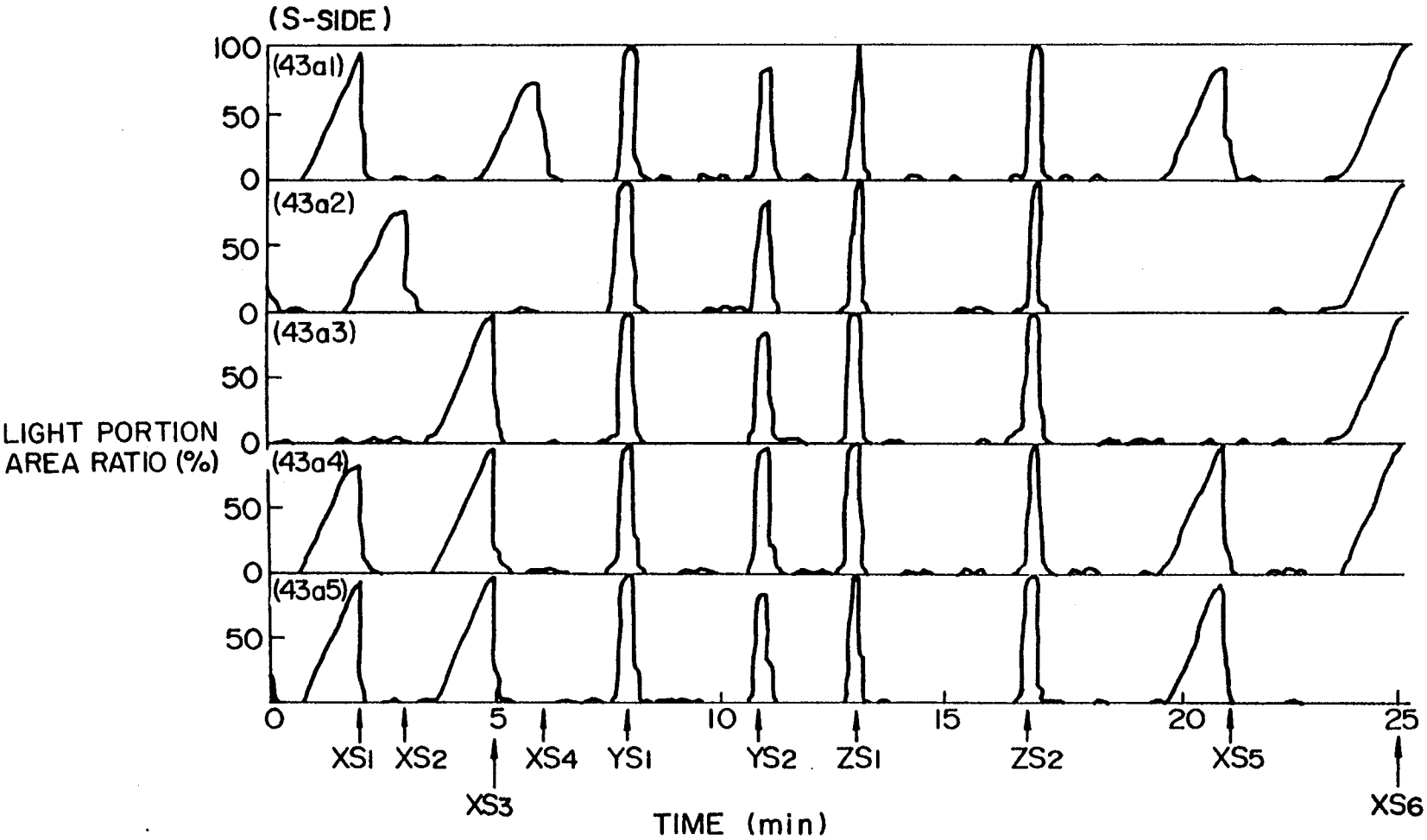
Figure 16:
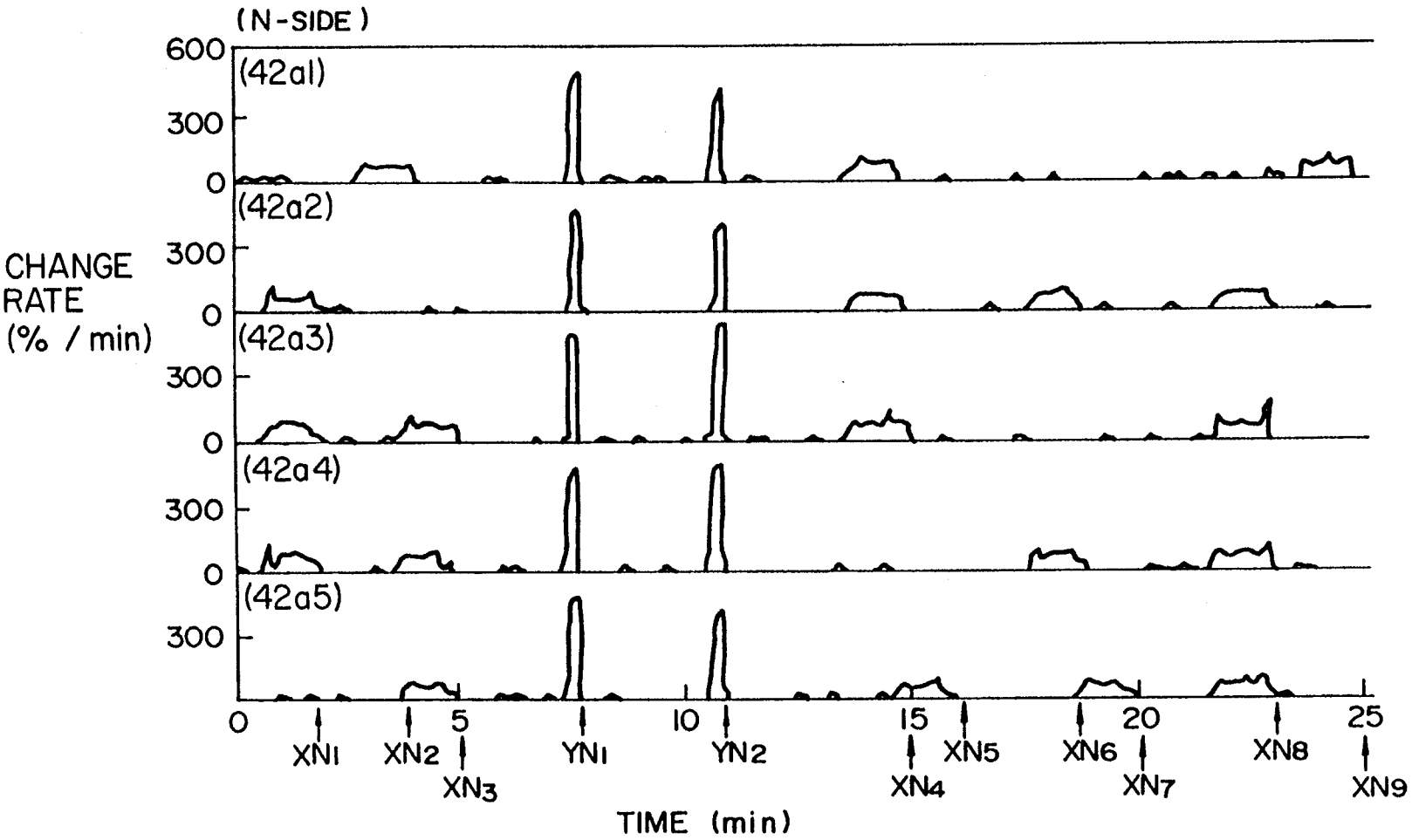
Figure 17:
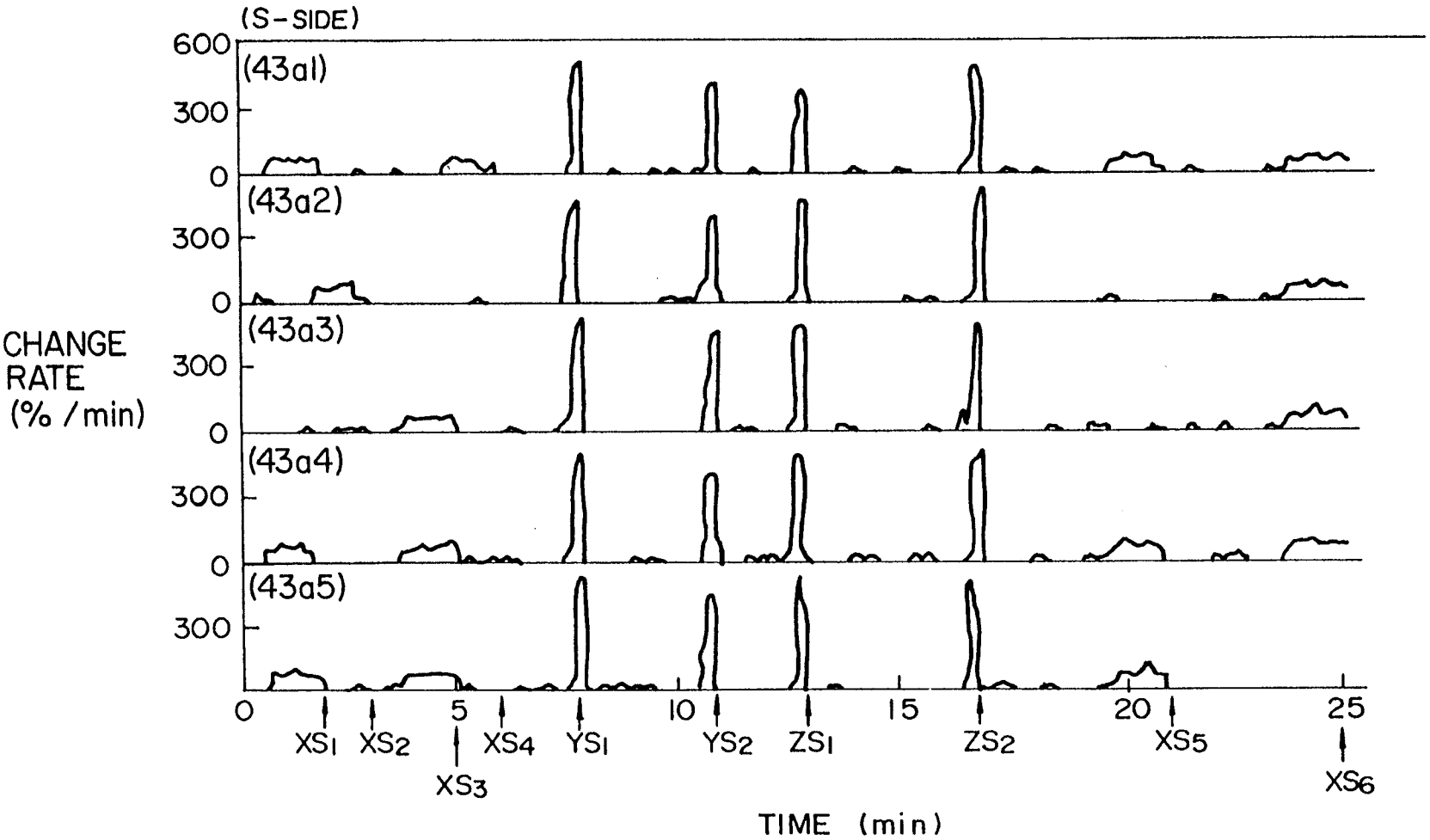

Taking into account the foregoing, in this embodiment, the melt surface regions within the mold corresponding to the images 42*a*, 43*a* in FIGS. 2 and 3 are divided into five zones 42*a*1–42*a*5 and 43*a*1–43*a*5 as shown in FIGS. 12 and 13 for the opposite N- and S-sides with respect to the pouring nozzle, respectively. The divided zones have all the same size in both sides. The total size of all the zones on each side is 500 mm in the direction of thickness and 250 mm in the direction of width. Each divided zone has a length of 100 mm in the direction of width. For the respective zones which are individually subjected to similar examination as that in the above case, the measured results of area ratios Rnn are shown in FIGS. 14, 15 and the measured results of changes rates Dnn are shown in FIGS. 16, 17, in which drawings the horizontal axis as a time base has the same scale as that of FIG. 10. FIGS. 14 to 17 each comprises five graphs which correspond to the measured results of the respective divided zones in FIGS. 12 and 13. Thus, those five graphs correspond to the zones 42*a*1–42*a*5 from above for each of FIGS. 14 and 16, and to the zones 43*a*1–43*a*5 from above for each of FIGS. 15 and 17, respectively. As with the above case, correlation between the phenomena occurred in the melt surface and time-dependent changes in both the area ratios Rnn and the change rates Dnn is clear. It is also apparent that the division of the image enables to monitor the respective divided zones in a stable and quantitative manner for detection of lack of powder. More specifically, in any event of lack of powder, biased flow and boiling, the area ratios Rnn reach a high level of 80–90% or more. But, as described above, it is found also, in case of dividing the image, that the change rates Dnn show a large variation of 300%/min or more at the occurrence of biased flow and boiling, while they become small at most 150%/min at the occurrence of lack of powder, thereby making it possible to discriminate lack of powder from biased flow and boiling. Furthermore, in contrast with a variable and unstable state in level of the area ratios Rn and the change rates Dn at the occurrence of lack of powder as appeared in FIGS. 10 and 11, the division of the image enables to detect a condition of lack of powder for the respective divided zones in a still more clear and stable manner. More specifically, when lack of powder has occurred in any one zone, the light portion area ratio Rnn is increased almost in that zone alone as seen at the lapsed time points 3, 15, 20 and 25 minutes in FIG. 14 and at the lapsed time points 3 and 6 minutes in FIG. 15. Such a condition of lack of powder can be detected by setting reference levels (or values) of the area ratio Rnn and the change rate Dnn for each of the divided zones, and then determining whether the detected value exceeds the reference level of the area ratio Rnn, but not the reference level of the change rate Dnn. Also, when lack of powder has occurred over a plurality of zones, the area ratios Rnn are increased in those respective zones as seen at the lapsed time points 2, 5, 15 and 23 minutes in FIG. 14 and at the lapsed time points 2, 5, 21 and 25 minutes in FIG. 15, similarly to the above. In this case, too, lack of powder can be detected by setting reference levels of the area ratios Rnn and the change rates dnn for the respective zones, and then determining whether the detected values exceed the reference levels of the area ratios Rnn, but not the reference levels of the change rates Dnn. Since each reference level has to be set in accordance with actual operating situations, the respective reference levels are required to be set to match individual cases dependent on, for example, size of a casting to be cast into products and environments around the mold.

In addition, at least some of the divided zones may have the same reference level, or all the zones may have reference levels different from one another. In this embodiment, biased flow, boiling and lack of powder could be detected by respectively setting a reference level of the area ratio at 70% uniformly and that of the change rate at 150%/min uniformly. Note that the reference levels are not limited to those values as see in this embodiment, because they should be set dependent on such conditions as size of the pouring nozzle, length of the pouring nozzle projecting above the melt surface, and cross-sectional size of a casting to be cast into products, as required.

In this way, it is possible to steadily and quantitatively detect conditions and positions of lack of powder. Also, it is needless to say that boiling and biased flow can be detected by obtaining the change rates Dnn of the area ratios Rnn for the respective zones and comparing the change rates Dnn of the corresponding zones on the opposite sides of the pouring nozzle to each other, in a case of image subdivision as well. However, since biased flow and boiling have to be detected in a shortest time, they are usually detected by the above mentioned method using the entire regions on both sides of the pouring nozzle without dividing their images. It should be understood that such a technique is not necessarily needed in a case where the division of the image will not arise problems, for example, significant delay in detection, in view of the relation between the operating situations and the detection time. Thus, the melt surface abnormal phenomena such as lack of powder, biased flow and boiling can be automatically detected in a stable and quantitative manner.

In the above description, automatic detection of the melt surface abnormal phenomena is made by processing the image information obtained by the image sensors installed above the melt surface within the mold. In addition to that, it is also possible to detect the melt surface abnormal phenomena for the purpose of stable casting operation, by incorporating temperature information from thermocouples built in the mold wall. More specifically, thermocouples are embedded in the mold wall at a certain depth from its surface in plural series along a direction of casting and in plural number along a circumferential direction of the mold to measure temperatures at the respective embedded points, so that heat flux at the respective built-in points as well as an amount of heat drawn out of the solidified shell of the casting being cast into products are calculated based on the embedded situations, and a heat drawn condition, such as, a condition of the intruding powder, is monitored in a circumferential direction of the mold, thereby detecting an abnormal condition in the mold. For example, when the amounts of drawn heat are abnormally varied in a circumferential direction of the mold, this is judged as a state where the powder does not flow into between the mold and the solidified shell with satisfactorily uniform distribution. Such an abnormality can be eliminated by, for example, supplying (or scattering) the powder to a region corresponding to the circumferential location at which the powder was found short, modifying a taper of the mold, or changing a casting speed.

Next, there will be described a melt surface abnormality preventing method which is effective in stabilizing a melt surface abnormal condition immediately after it has been detected.

To begin with, a preventing method to be effected when the occurrence of biased flow or boiling has been detected by the melt surface abnormal condition detecting method as mentioned above will be described.

When boiling occurs, the volume of the blown gas in a flow passage of the melt is increased and the flow rate of the melt is hence relatively reduced. Accordingly, it is required to adjust a casting speed to match the flow rate of the melt at that time. At the same time, the flow rate of the melt is also adjusted in order to suppress fluctuations of the melt surface level within the mold. Further, the flow rate of the blown gas is then adjusted to match the occurred situations, thereby to eliminate a boiling phenomenon. If lack of powder is found simultaneously, the powder is scattered to the lack position thereof.

At any stage during the preventing procedures, the above adjustments may be stopped at that stage if the stage has been stabilized. After stabilization, the operating conditions are gradually restored to those immediately prior to the occurrence of the abnormality. Next, in the event of biased flow, it is observed in many cases that the flow passage of the melt is disturbed by deposits such as $Al_2O_3$ precipitated or separated out in the melt flow passage. Therefore, a biased flow state is eliminated through a slightly varied adjustment of the flow rate of the melt by, for example, moving a sliding nozzle (SN) vibratingly with small strokes, when it is used for adjusting the flow rate of the melt, thereby to change a condition of the deposits, or regulating the flow rate of the blown gas. At this time, the casting speed may additionally be adjusted in order to suppress fluctuations of the melt surface level. Further, if lack of powder is found simultaneously, the powder is supplied to the position of lack thereof. The preventing method of the present invention, to be effected when some melt surface abnormality has been automatically detected by the melt surface abnormal condition detecting method, can be performed by the controller 23 which instructs and controls actions needed to stabilize the melt surface abnormality in response to detection of an abnormal condition. Thus, the controller 23 is operated to issue an alarm, allowing an operator to take a proper action in response to the alarm, or to directly issue a control signal to the casting speed controller 18, the blown gas flow rate controller 16, the melt flow rate controller 14, and/or the powder supply unit 30 for automatic control to eliminate the abnormality. In a case of the latter automatic control, the casting speed, the flow rate of the blown gas or the flow rate of the melt is first lowered down to setting values which are determined dependent on the operating conditions, for example, width of a casting and casting speed, as established at the time of the occurrence of an abnormality, thereby to automatically detect the melt surface abnormality. If the occurred abnormality has been prevented or eliminated, the operating conditions are then gradually restored to those established when the abnormality occurred. If not prevented or eliminated, the above variables are further lowered down to other setting values which are determined dependent on the operating conditions as that time, for repeating similar control. When the occurrence of biased flow or boiling is detected by the melt surface abnormal condition method in this way, a proper action is taken to stabilize the melt surface abnormal condition.

Next, a preventing device to be operated when lack of powder has been detected by the melt surface abnormal condition method will be described below.

Figure 18:
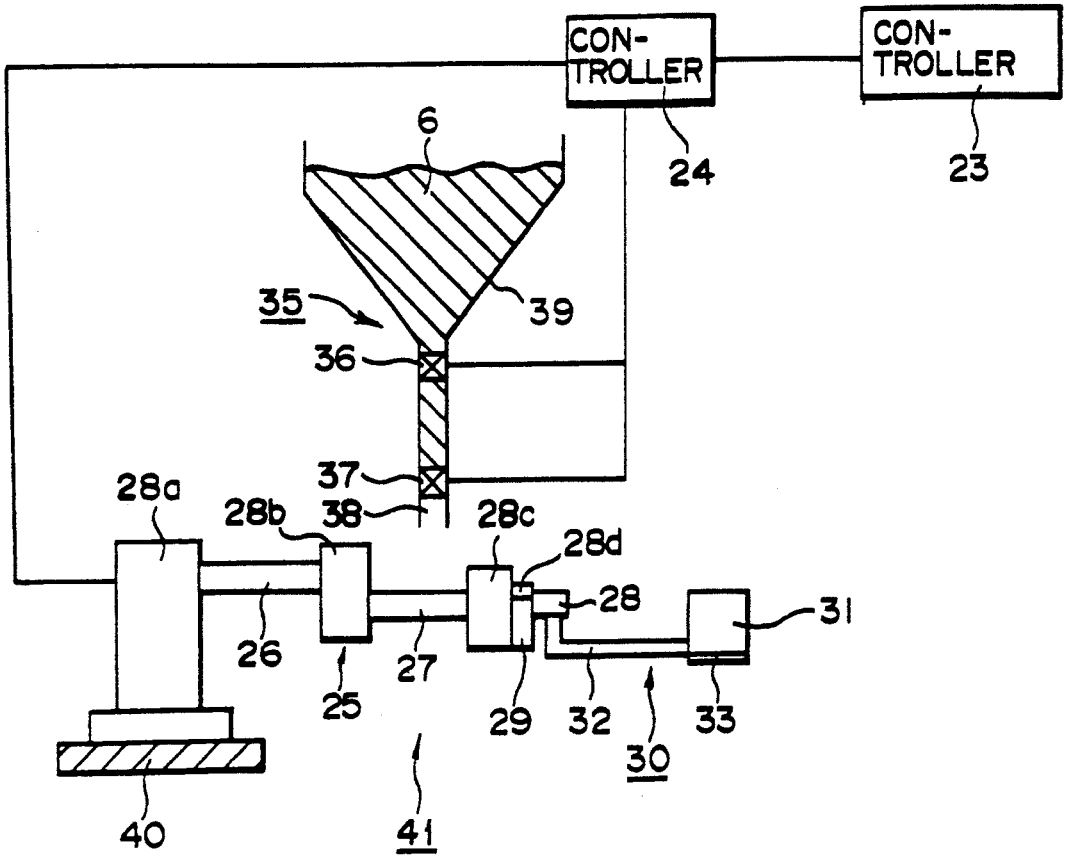

Since lack of powder is detected for each of the divided zones of the melt surface as mentioned above, the powder is scattered to the area corresponding to the divided zone where the powder was found short. Conventional powder supply units have been accompanied by not problems such as clogging of a pipe, as explained above. Therefore, the present invention has employed a powder supply unit of the type that is separated into a powder supply section and a powder scattering section, as shown in FIG. 18. Designated by 30 is the powder scattering unit which comprises a cup-like reservoir 31 for storing a preset amount of the powder 7 corresponding to each of the divided zones, and a support frame 32 supporting the reservoir 31 and mounted to the distal end of the multi-articulated support arm 25 (comprising two support arms 26, 27 in this embodiment which are referred to collectively as support arm 25).

The support arm 25 is constituted, as explained above, such that a plurality of support arms 26, 27 are interconnected through arm drivers **28*a*–28*c* each having a rotatable shaft built therein, whereby the support arms can be rotated about the respective rotatable shafts in an articulated manner. In addition, the support arm 25 is provided at the distal end thereof with a lift driver 28*d* and a lift frame 29 to provide a vertically moving ability. The support frame 32 supported on the distal end of the support arm 25 through a connector 28 can thus be moved back and forth as well as up and down above the melt surface within the mold 1 by controllably driving the arm drivers 28*a*–28*c* and the lift driver 28*d***.

The powder supply unit 30, specifically the reservoir 31, is supplied with the preset amount of powder 7 by a feeder 35 which comprises a hopper 39, valves 36, 37, and a feed nozzle 38. In response to a control signal from the controller 23 which issues a command for a position of lack of the powder, and the like, a controller 24 drives and controls a later-described drive mechanism of the powder scattering unit 30 and the arm drivers **28*a*–28*c* (referred to collectively as drive unit 28) of the support arm 25, thereby supplying the powder to the zone corresponding to a position of lack of the powder detected by the melt surface abnormal condition detecting method explained above. When a condition of lack of powder has been detected over a plurality of zones simultaneously as appeared at the elapsed time points 5 and 25 minutes in FIGS. 14 and 15, for example, the controller 23** decides the priority of scatter for those zones where lack of powder has been detected, thereby permitting to carry out efficient powder scatter.

Figure 19:
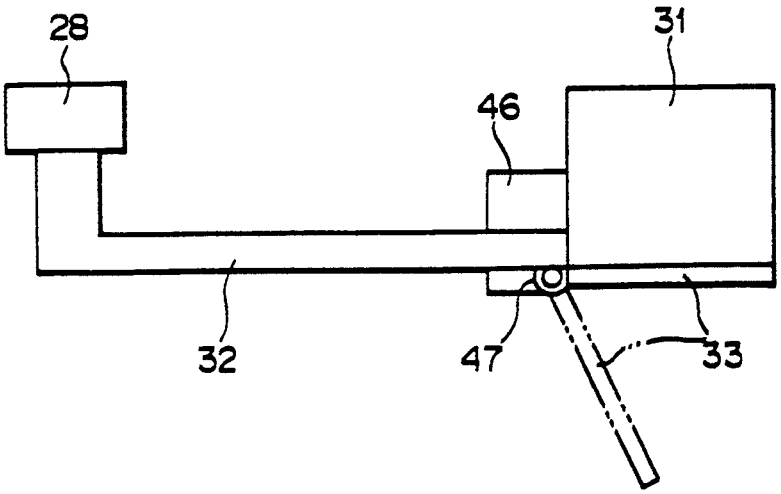
Figure 20:
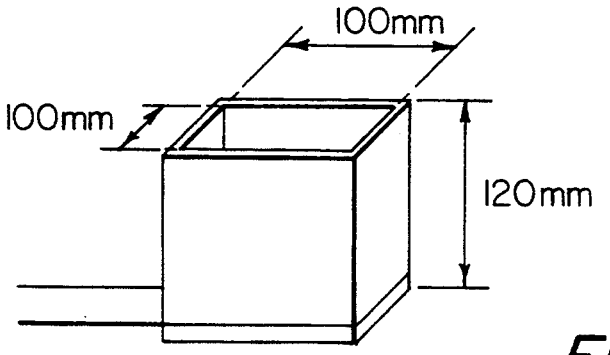
Figure 21:
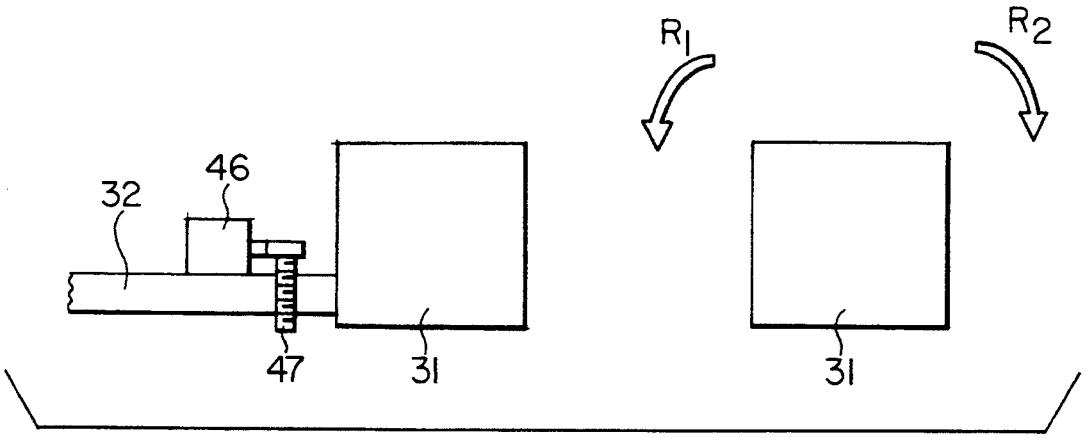
Figure 22:
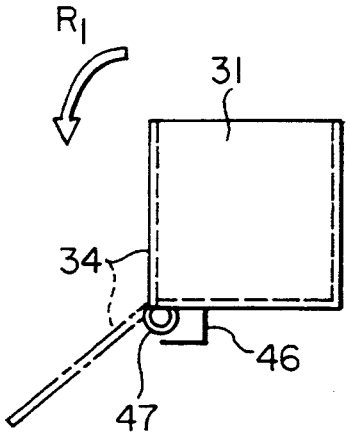
Figure 23:
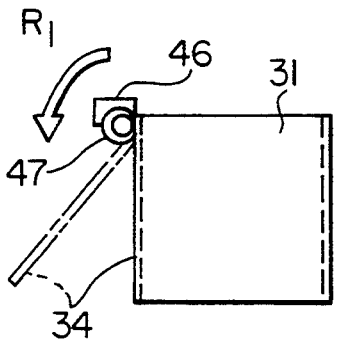
Figure 24:
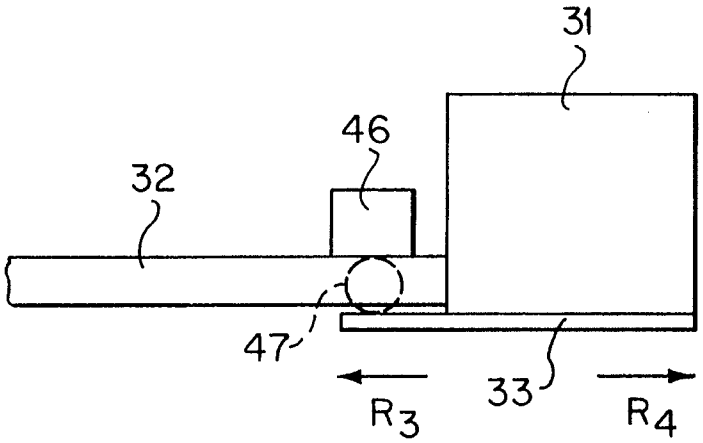

FIG. 19 is a partial structural view showing one example of the powder supplying section including a reservoir 31 used in this embodiment for storing a preset amount of the powder 7. This example comprises the reservoir 31 for storing the powder, a support frame 32 for supporting the reservoir 31, a bottom lid 33 to be opened at the time of supplying the powder 7, a drive motor 46 for driving the bottom lid 33 to open and close, and a rotatable shaft 47. Here, the volume of the reservoir 31 for storing the powder 7 is selected as follows. First, the plane area of the reservoir 31 is set to be less than the size of each divided zone, taking into account downward spread of the powder when supplied. Then, the height of the reservoir 31 is a factor determining the total volume thereof, and hence required to be set so as to make a powder supply rate, which is determined dependent on both an operation speed of the powder supply unit 30 and the volume of the reservoir 31, not less than a maximum consumed rate of the powder during the casting operation. In this embodiment, therefore, since the required volume of the reservoir 31 becomes 1 Q under assumption that the maximum consumed rate of the powder during the casting operation is 2.4 kg/min, the powder supply time (period) per stroke is 20 sec and specific gravity of the powder is 0.8, the dimensions of the reservoir 31 were set to have length, width and height of 100 mm×100 mm×120 mm as shown in FIG. 20 based on the area of each divided area, respectively, in view of a rest angle found in supply of the powder from the feed nozzle 38 to the reservoir 31 as well. In a case where the reservoir 31 cannot have the sufficient dimensions due to restrictions in equipment layout such that the maximum consumed rate of the powder largely exceeds the supply rate of the powder supply unit 30, the powder may be supplied by providing plurality of the powder supply units 30 for example two, which are each allocated to cover one of the melt surface regions on the opposite sides with respect to the pouring nozzle 12. The powder feed unit 35 is selected to provide a slope angle allowing the powder to drop by gravity or dead load from the hopper 39 to a feed port 38 capable of facing the reservoir 31. A fixed feed amount of the powder from the hopper 39 to the reservoir 31 can be adjusted by changing a diameter or length of a pipe connecting the upper valve 36 and the lower valve 37. The powder can be fed to the reservoir 31 which has been preparatorily moved below the feed port 38, on demand, by following the procedures of closing the lower valve 37, opening the upper valve 36, closing the upper valve 36 and then opening the lower valve 37. In a case where various types of powder are used during the casting operation, it is possible to adapt for such a case by providing a plurality of hoppers corresponding to the powder types used, sharing the pipe downstream of the upper valve 36 or the feeder nozzle 38, and arranging recovery lines led back to the respective hoppers. The powder can be scattered into the mold in various manners. While this embodiment employs scatter means of the type in which the single bottom lid 33 is opened, the bottom lid may be comprised of plural members. Also, as shown in FIG. 21, the reservoir 31 may itself be turned or tilted in a direction of an arrow R1 or R2 for scattering the powder. Alternatively, as shown in FIGS. 22 and 23, the powder may be scattered by pivoting a side plate 34 and turning the reservoir 31 in a direction of an arrow R1. As an alternative, as shown in FIG. 24, the bottom lid 33 may be turned or slid in a direction of an arrow R3 or R4 for scattering the powder. In this way, the powder is supplied by the powder supply unit 30 to the zone corresponding to a position of lack of the powder that is detected by the melt surface abnormal condition detecting method.

As a result of implementing the casting operation by using the melt surface abnormal condition detecting method, the melt surface abnormality preventing method and the powder lack preventing device, as explained above, under the casting conditions that the cross-sectional size of castings is 250×1250 mm and the casting speed is 1.6 m/min, that casting operation could be stably implemented with no intervention of operators. In other words, even when the melt surface abnormality such as boiling or biased flow occurred upon changes in the weight of the melt within the tundish due to replacement of ladles during the continuous casting process in which a plurality of different ladles are used, it was possible to quickly detect and stabilize an abnormal condition and also to promptly detect lack of powder for supplying the powder. Furthermore, the castings thus cast into products were completely free from any surface flaws and other defects and hence very excellent in quality.

In short, the method and apparatus of this embodiment enables to automatically detect and prevent an abnormal condition of the melt surface within the mold. As a result, it becomes feasible to cut down an amount of manual work required around the mold, which has been so far an obstacle in saving human labors, and to provide the stable continuous casting operation with less variations otherwise possibly caused by operators, as well as the good quality of castings.

The second embodiment deals with the problems related to blow of inert gas into a melt (see the above section B).

Figure 25:
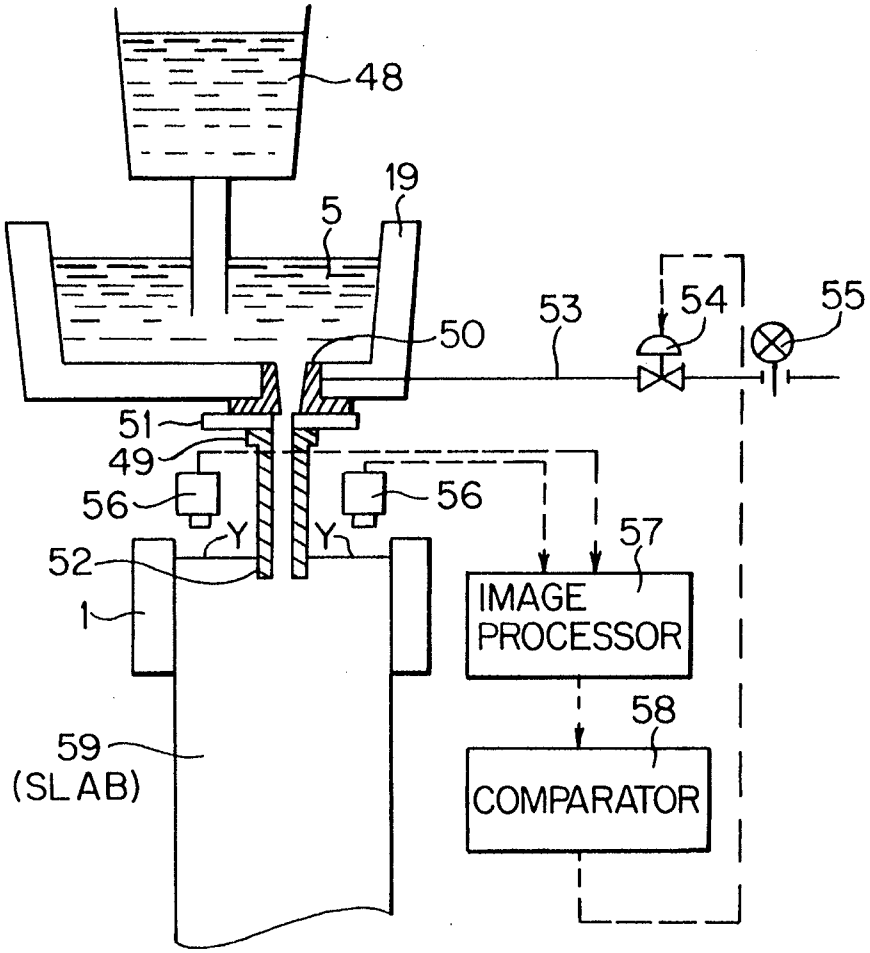
FIGS. 25 to 29 are a second group of drawings related to an embodiment II.

FIG. 25 is a view showing an example of implementing this embodiment in a general continuous casting equipment. A melt (molten steel) 5 is once stored from a ladle 48 into a tundish 19 and then poured into a mold 1 through a nozzle 49. The nozzle 49 of this embodiment comprises an upper nozzle 50 mounted to a bottom wall of the tundish 19, a sliding nozzle 51 mounted at the bottom of the tundish 19 in contact with the upper nozzle 50, and a pouring nozzle 52 attached integrally to a movable plane of the sliding nozzle 51. A gas supply line 53 is connected at its fore end to the upper nozzle 50 so that gas is blown into a flow of the melt in the upper nozzle 50 through its wall.

In this embodiment, a small-type CCD camera is used as an image sensing device (or image sensor) 56. The image sensing device 56 is installed above the mold including a pair of sensors, each locating on either side of the pouring nozzle 52. The image sensing devices 56 pick up images of the surface of the molten steel, that is, melt surface y, within the mold during continuous casting, and apply detected image signals to an image processor 57. For recognizing bubbles produced on the melt surface y within the mold, the image processor 57 first converts the image signals to a binary representation, that is, bilevel signal. The melt surface y is usually covered with powder and hence indicated as a dark portion in the image. If bubbles are produced on the melt surface y, the melt is exposed or emerged as a light portion with the bubbles. Therefore, only the bubbles can be recognized as a light portion by making a binary representation with a threshold level set so as to discriminate between the dark powder portion and the light melt emerged portion. Then, noises included in binary images caused by, for example, flames flared up from the melt surface y are removed by subjecting the binary images to the AND-ing process plural times in a time-series manner, and then superposing them. Flames are momentarily changed in their positions and sized, while bubbles remain as a light portion at the same position for a longer time than flames. Accordingly, by taking the binary images plural times for a short period of time and subjecting them to the AND-ing process, the noises due to flames can be removed. Then, the number of light portion islands caused by bubbles in the binary images, which has been processed to extract only the bubble data, is measured by counting them on the images, thereby detecting the number of bubbles floating over the melt surface y.

Further, the size (area) of flames flared up from the melt surface y within the mold by burning of powder components are measured. While flames flared up from the melt surface y are thus caused by burning of powder components, when a larger amount of gas is supplied into the melt, an amount of burning gas generated from the powder is also increased incidental to movement of the gas up to the melt surface, causing the flames to be flared up in larger size. Accordingly, a flow rate (amount) of gas supplied into the mold can be grasped by measuring the size of the flames. As procedures of measuring the size of the flames, the image is first converted to a binary representation with a threshold level appropriately preset, because the flames are indicated as a light portion in the image. Only the light portion fluctuating in a short time is then extracted contrarily to the method of detecting the bubbles. This extraction can be achieved by OR-processing the binary images which have been taken several times in a time-series manner. Afterward, the size of the extracted flames is measured from the resulting image.

The number of bubbles and the size of flames thus detected are input to a comparator 58. The comparator 58 stores therein correlation between a flow rate of the blown gas and the number of bubbles within a range up to the occurrence of boiling and nozzle clogging, and upper and lower limit values (hereinafter referred to collectively as "allowable limit values") of a flow rate of the blown gas previously derived from the correlation. The detected values for the number of bubbles and the size of flames obtained through the above mentioned processing carried out by the image processor 57 are compared with the allowable limit values in the comparator 59, thereby to perform flow rate control so that the gas is blown within the allowable limit values. More specifically, when the detected values exceed the allowable upper limit values, the comparator 58 issues a control signal to a valve 54 installed in the gas supply line 53, thereby making control to reduce a flow rate of the blown gas. On the contrary, when the detected values fall below the allowable lower limit values, a control signal is issued to the valve 54 to increase a flow rate of the blown gas, thereby ensuring that a proper flow rate of the blown gas within the allowable limit values is always supplied during continuous casting.

Adjustment of the gas supply valve 54 is not necessarily limited to an automatic manner effected using the comparator 58. Alternatively, in accordance with an indication of the proper gas flow rate shown by the comparator 58, an operator may adjust the valve 54 while looking at a flow meter 55. Further, like a control device as disclosed in Japanese Utility Model Laid-Open No. 62-142463, it is also possible to obtain a required flow rate of gas to match an amount of the poured melt which is calculated based on the head size of the tundish, the width and thickness of castings, and the casting speed. A difference between that required flow rate of gas and the flow rate of gas detected as described above within the allowable limit values is then determined, and the resulting differential flow rate is employed as a modification value for a calculated gas flow rate setting value to be used by the comparator. With this technique, calculation of the proper gas flow rate is not necessarily required to be carried out from time to time, and may be performed only at start-up of the casting operation, or at the time of changes in the operating conditions or the conditions of hardware such as the nozzle. As a result, the burden imposed on the image processing and the like is alleviated.

Figure 26:
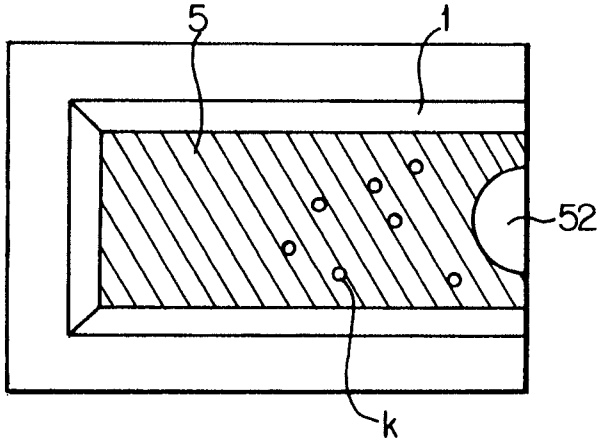
Figure 27:
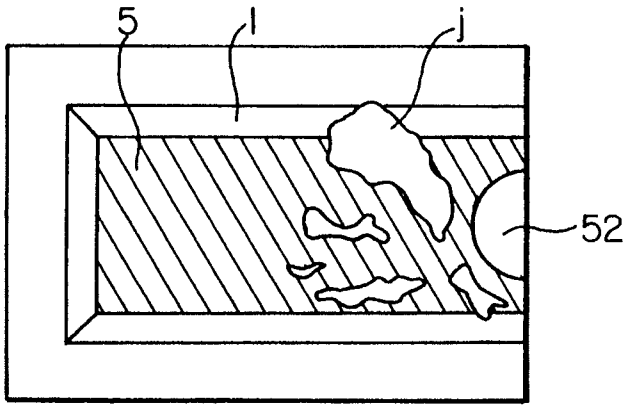
Figure 28:
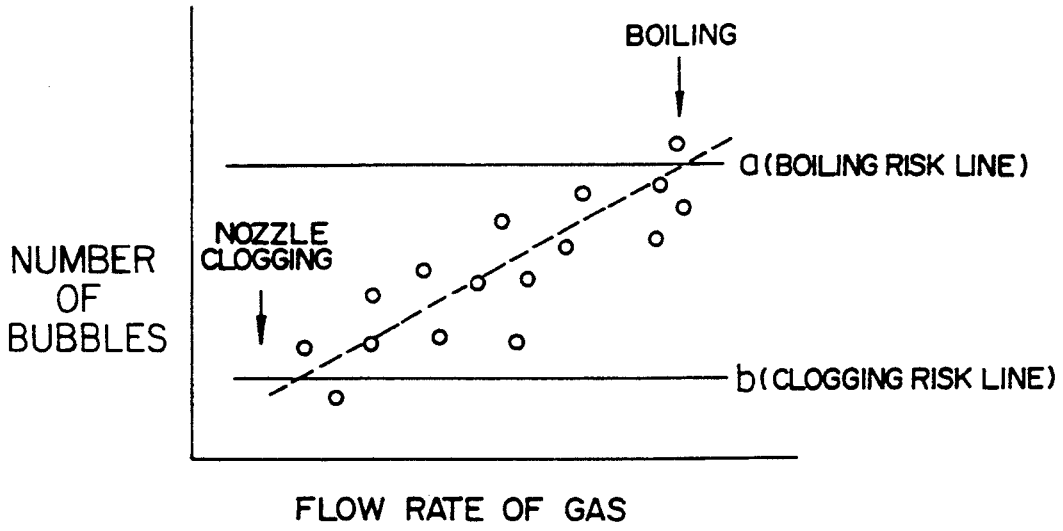

FIGS. 26 and 27 are each a binary representation of an image picked up by either one of the image sensing devices 56 directed to the melt surface within the mold. FIG. 26 shows a state where the gas blown into the melt within the mold is moved up to the melt surface and bubbles k are produced on the melt surface. The number of those bubbles is detected to determine a proper value for the flow rate of the blown gas. FIG. 28 is a graph showing one example of an examined result of the relationship between the number of bubbles and a flow rate of blown gas. It will be seen that the number of bubbles is increased with an increase in the flow rate of gas and, when the flow rate of gas exceeds a certain value, there occurs a boiling phenomenon. Further, the flow rate of gas is decreased with a decrease in the number of bubbles, eventually leading to clogging of the nozzle. In short, it was confirmed that there was clear correlation between the flow rate of gas and the number of bubbles. The control can be practiced by, after determining the above correlation dependent on the equipment conditions and the operating conditions in advance, setting a maximum value of the number of bubbles at lower than which the stable casting operation can be continued without causing the boiling phenomenon, that is, upper limit value, and a minimum value of the number of bubbles at higher than which the stable casting operation can be continued without causing clogging of the nozzle, that is, lower limit value. It has also been found that the upper and lower limit values may be set for safety while leaving an allowance of about 20% with respective to each of a boiling risk line a and a clogging risk lien line b shown in FIG. 28.

Figure 29:
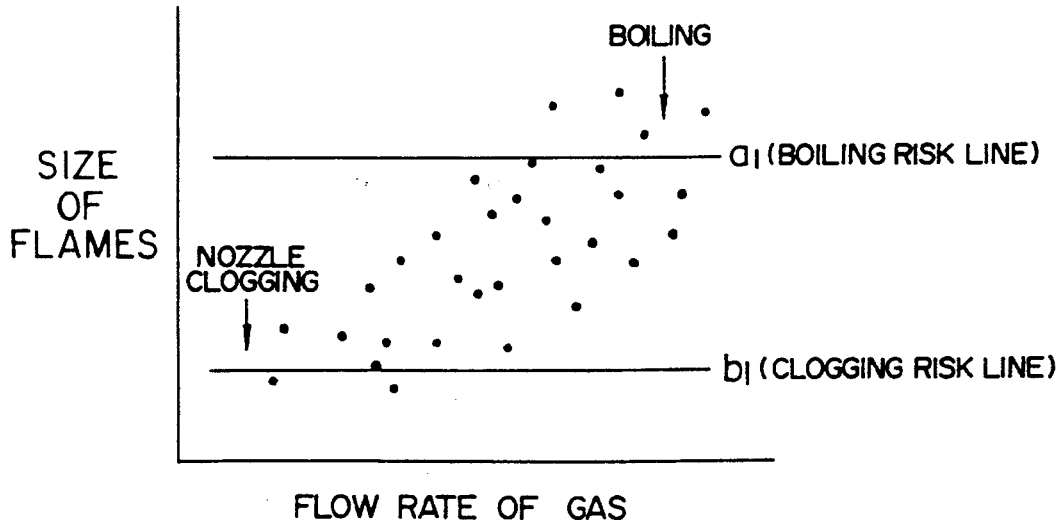

FIG. 27 shows a result of detecting flames i flared up on the melt surface when the gas blown into the melt within the mold is moved up to the melt surface and combustible components of the powder are burnt. The result of FIG. 27 is obtained by converting an original image to a binary representation and extracting only a light portion of the flames. The size of the flames i can be detected by obtaining a binary image through the above conversion to clarify images of the flames i and then measuring the area of the light portion. FIG. 29 is a graph showing one example of an examined result of the relationship between the size of flames and a flow rate of blown gas. The flow rate of gas is increased with an increase in the size or area of flames, while it is decreased with a decrease in the area of flames. For the size of flames as well, upper and lower limit values are set with a boiling risk line a1 and a clogging risk line b1 being taken as references, respectively, similarly to the case of FIG. 28. The stable continuous casting operation can thus be continued by ensuring a flow rate of the blown gas within the allowable limit values.

As will be apparent from FIGS. 28 and 29, however, the correlation between the size of flames and the flow rate of gas is considerably varies as compared with the correlation between the number of bubbles and the flow raze of gas. In a case of desiring to improve controllability by setting the allowable limit values closer to the boiling risk line a and the clogging risk line b, for example, it is preferable to use the detected value for the number of bubbles. On the other hand, the size of flames is advantageous in prompt response to changes in the flow rate of gas. Accordingly, whether to use the detected value for the number of bubbles or the detected value for the size of flames may be determined dependent on, for example, the equipment and operating conditions as well as other environmental conditions. It is also possible to use both of them.

As described above, this embodiment makes it possible to improve the quality of castings and significantly reduce the probability of nozzle clogging, by determining a proper value for the flow rate of gas blown into the melt for control off the blown gas.

The third embodiment deals with the problem of slag beard formation (see the above section C) .

As a result of repeatedly observing a melt surface condition, the inventors found that there is a slight or delicate difference between powder, a slag beard and a wall surface within the mold. Therefore, the inventors installed an image sensor utilizing a TV camera or the like above the mold in a location facing a melt surface within the mold and examined lightness or brightness of the melt surface including the mold wall surface.

Figure 30A:
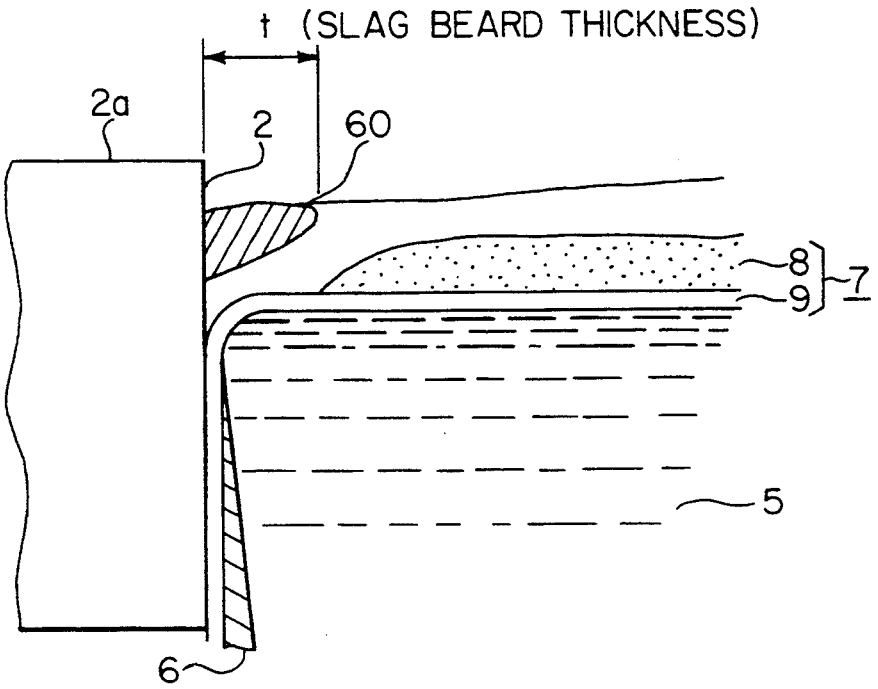
[FIGS. 30 to 35 are a third group of drawings related to an embodiment III]
Figure 30B:
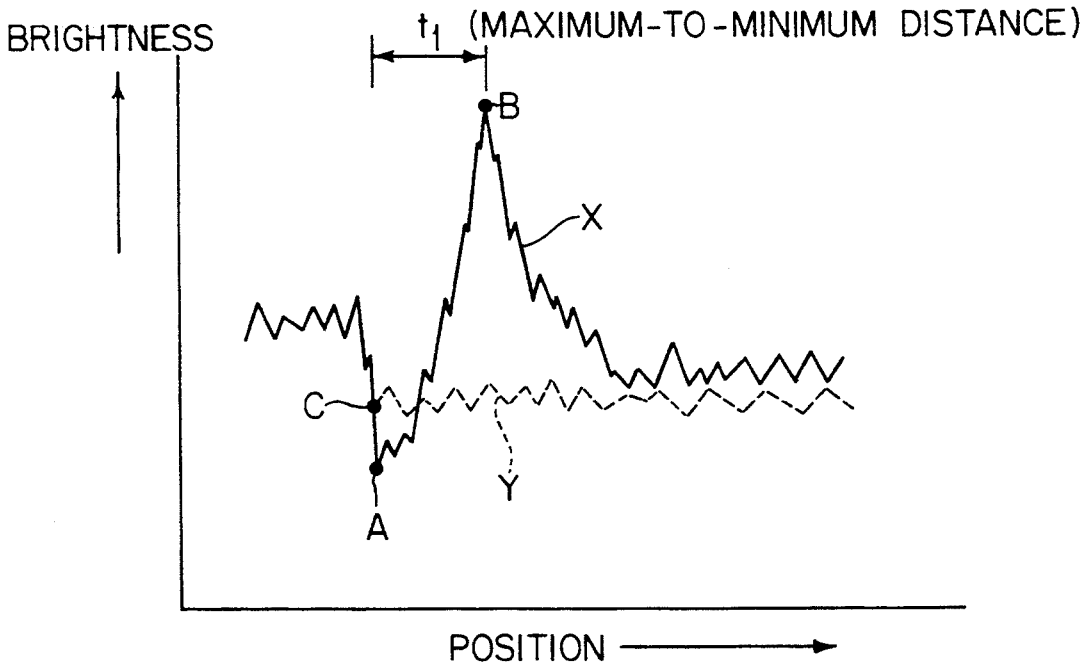

FIG. 30 shows one example of a result of the above examination in contrast with a partial sectional view illustrative of a melt surface condition within the mold. In FIG. 30, designated by 1 is a mold, 5 is a melt (molten steel), 6 is a solidified shell produced by being contacted with the mold 1 and cooled, and 7 is powder comprising non-molten powder 8 and molten powder 9. The reference 60 is a slag beard formed of the molten powder 9 which has adhered or deposited and grown on the mold wall surface 2 by being cooled by the mold 1. An amount of the slag beard 60 projecting into the mold, that is, thickness of the slag beard 60, is indicated by t.

Brightness of the melt surface was measured by installing a pair of image sensors 30 at the bottom of a tundish 19 in locations opposite to each other, as shown in later-described FIG. 31, detecting the melt surface vicinity (which hereinafter collectively implies the melt surface within the mold, the mold wall surface, etc.) by the image sensors 20 in the form of an image signal or a brightness signal, and then determining distribution of brightness along a line L intersecting the mold wall surface 2 and shown in later-described FIG. 32. The resulting distribution of brightness is indicated by a solid line X in FIG. 30.

As will be seen from FIG. 30, an upper surface 2*a* of the mold 1 exhibits relatively high brightness, because it reflects light therefrom. On the other hand, a surface portion of the non-molten powder 8 exhibits a lower level of brightness, because it comprises a layer of just scattered powder at a lower temperature and is in the form of powder having lower light reflectance. However, if the slag beard 60 is formed, an adhering portion (A) of the slag beard 60 to the mold wall surface 2 exhibits extremely low brightness, because it is cooled by the mold 1 down to a low temperature and has characteristics less effective to reflect light. With increasing a distance from the mold 1, a temperature of the slag beard 60 is raised by being subjected to heat of the molten powder 9 so that brightness is also raised correspondingly (from A to B). At a distal end (B) of the slag beard 60 most remote from the mold wall surface 2, brightness becomes maximum and indicates a sharp peak in the distribution of brightness, because the molten powder 9 is caused to appear and disappear due to oscillations of the mold 1 and the slag beard 60 is itself red-heated by heat of the molten powder 9. Meanwhile, if the slag beard 60 is not formed, the melt surface is uniformly covered with the non-molten powder 8, whereby the distribution of brightness provides a flat profile substantially free of a peak, as shown in a dotted line Y in FIG. 30.

Accordingly, by measuring the distribution of brightness in the melt surface vicinity along a line intersecting the mold, preferably a line substantially perpendicular to the mold wall surface 2, it becomes possible to detect a melt surface condition, that is, a position of the mold wall surface 2, and recognition of the slag beard 60, the non-molten powder 8 and the molten powder 9, particularly, a condition of the formed slag beard 60 such as the presence or absence of the slag beard 60 and size (thickness) thereof.

In other words, by measuring the distribution of brightness along the line L, and determining the presence or absence of the maximum value B above a predetermined level and the minimum value A below a predetermined level, as well as a distance between the positions where the maximum value B and the minimum value A are detected (hereinafter referred to simply as maximum to-minimum distance) t1, it becomes possible to detect the presence (corresponding to the presence of the maximum value B and the minimum value A) or absence of the slag beard 60, and a thickness t thereof (for example, size of the slag beard slag 60; in a horizontal direction) .

Thus, a condition of the formed slag beard 60 can be detected through procedures of previously determining an indication pattern of the maximum value B and the minimum value A, as well as correlation between the detected maximum-to-minimum distance t1 and the thickness t of the actually formed slag beard 60, dependent on the equipment conditions around the mold, the operating conditions, characteristics of the installed image sensors and a signal processing system, and then measuring the actual distribution of brightness representing a melt surface condition from time to time during the casting operation.

Figure 31:
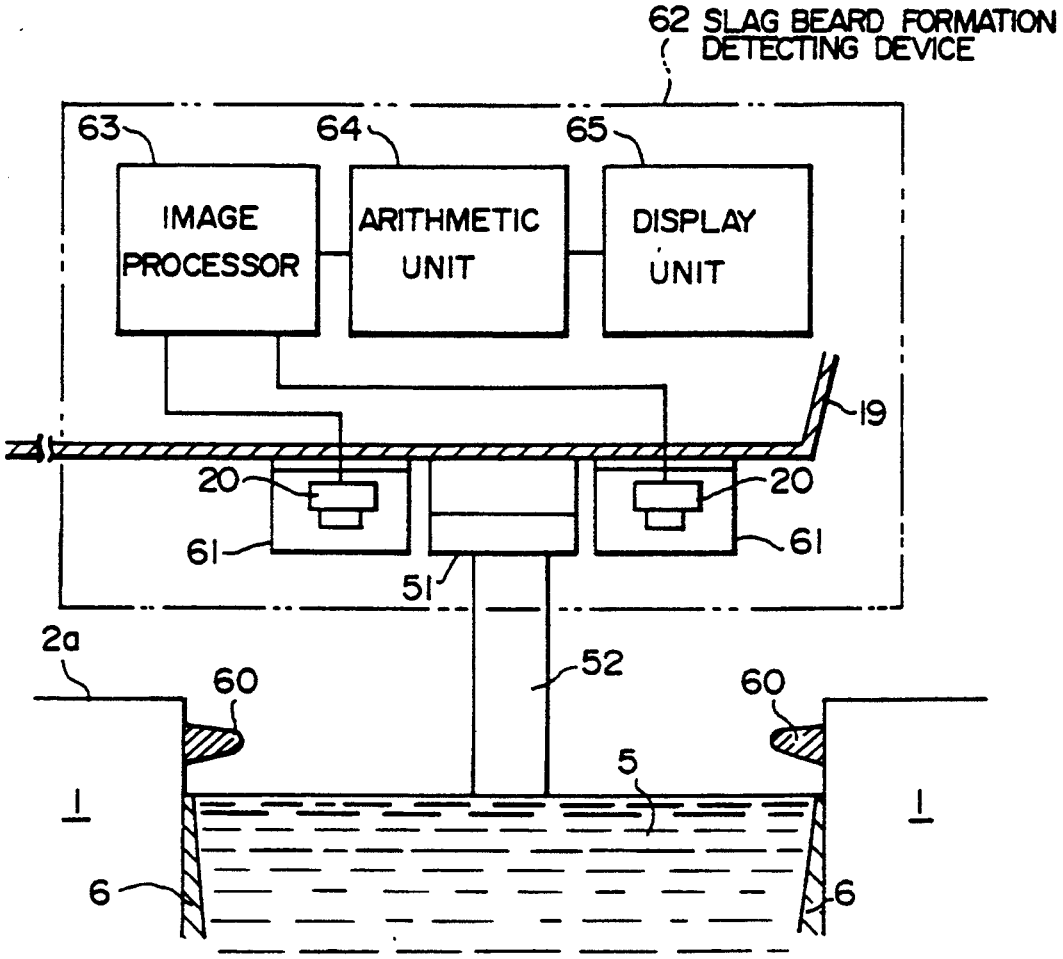

FIG. 31 is a block diagram showing one example of a device for detecting a condition of slag beard formation in accordance with the present invention. Designated by 62 is a slag beard formation detecting device, 52 is a pouring nozzle for the melt 5, 51 is a sliding nozzle, and 19 is a tundish.

Designated by 20 is an image sensor for detecting the melt surface vicinity within the mold 1. In this embodiment, the image sensor 20, including one pair of sensors is installed above the mold 1 in opposite relation to the pouring nozzle 52, so that at least one image sensor can view the entire melt surface vicinity on either side about the pouring nozzle 52. Designated by 61 is a cooling and dustproof box for protecting the image sensor 20. Each image sensor 20 has its bottom surface formed of heat-resistant and transparent glass, and is constituted so as to allow cooling air to circulate the interior thereof. The cooling and dustproof boxes 61 have a practically valuable function of effectively protecting the image sensors 20 even under such severe environments where the image sensors 20 are installed near the melt 5 and subjected to heat from the melt 5 and dust such as the powder 7. Designated by 63 is an image processor for processing images of the melt surface vicinity picked up by the image sensors 20 in a digital manner, 64 is an arithmetic unit for arithmetically and logically processing the image data from the image processing unit 63 and determining a condition of the formed slag beard 60, and 65 is a display unit for displaying a detected result for the condition of slag rim formation.

The image sensor 20 may be of any desired type, for example, a camera utilizing a vidicon usually employed in a video camera, as long as it can pick up the melt surface vicinity in the form of an image, that is, a brightness signal. Based on experience and various studies, however, the inventors have confirmed that those cameras utilizing coupled charged devices (CCD), such as, CCD cameras, are excellent in responsity and less affected by residual images, and hence that they are optimum in effectively presenting functions necessary for the present invention.

Further, since the pouring nozzle (or dipped nozzle) 52 is disposed at the center of the mold 1, and the tundish 19, the sliding nozzle 51 and so forth are disposed above the mold 1, a space around the image sensors 20 is very small and narrow. It is therefore usual that the image sensors 20 have difficulties in their arrangement remote from the mold 1, and must be installed at positions near the melt surface. This sometimes restricts the total viewing field of the image sensors 20 dependent on, for example, their types and characteristics. In such cases, the image sensor 20 may be installed in two or more pairs in locations opposite to each other with the pouring nozzle 52 located therebetween.

In some cases, however, only one pair of image sensors 20 can be installed due to restrictive conditions such as the equipment positions around the mold, as well as structure and size of a slag beard removing device (later described). In these cases, a required viewing field can be obtained by using a wide-angle optical lens for the image sensor 20.

A melt surface condition detected by the image sensors 20 is periodically input as image signals to the image processor 63. The image processor 63 subjects the image input signals from the image sensors 20 to digital processing described below, thereby periodically determining distribution of brightness along the check line L set so as to intersect the mold wall surface 2.

More specifically, the image processor 63 first determines the profile of the mold, 1, i.e., the mold wall surface 2 appeared in the images represented by the image signals, and then detects (derives) the position of the mold wall surface 2 on the images. Taking into account that brightness is high in the upper surface 2*a* of the mold and abruptly reduced at the mold wall surface 2 contacting the slag beard 60 or the non-molten powder 8 as shown in FIG. 30, the mold wall surface 2 is determined by detecting the minimum value A or a bent point C in the distribution of brightness. Since the position of the mold wall surface 2 is of course constant under the same equipment conditions, that position detected or set through the first processing can be used continuously. There is thus no need for determining the position of the mold wall surface many times.

Figure 32:
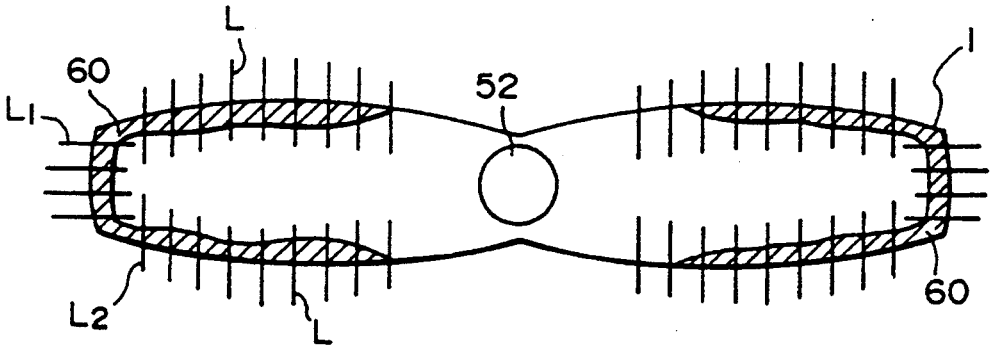

After detecting or setting the position of the mold wall surface 2, lines intersecting the mold wall surface 2 (hereinafter referred to as check lines L) are then defined as shown in FIG. 32. The check lines L are set such that they intersect the mold wall surface 2 around the periphery of the mold with a predetermined spacing therebetween, and each have a length extending to a position nearer to the center of the mold 1 than the position at which the slag beard 60 is expected to form. The check lines L are preferably set perpendicular to the mold wall surface 2, but may be deviated to some degree from perpendicular relation in a strict sense. This is because when the mold 1 having a rectangular shape is picked up from above by the image sensors 20 utilizing wide-angle lenses, the resulting image of the mold is distorted as shown in FIG. 32.

Specifically, the region near the center of each image sensor 20 is picked up in the form relatively analogous to the real image, while the picked-up image is distorted in the region remote from the center such that linear lines are shifted or swollen outwardly. Accordingly, it is difficult to draw the check lines L precisely perpendicular to the mold wall surface 2 based on the image signal from the image sensor 20. However, such distortion of the image can be corrected through geometrical calculations. In this example, therefore, the check lines L are drawn on the image screen picked up by the image sensors 20, as shown in FIG. 32, and an actual condition of slag rim formation is determined after being corrected through geometrical calculations. An example of FIG. 32 shows a case of casting of 250 mm×1350 mm in size, in which check lines L are set for each of the image sensors 20. In total, 44 check lines L are set for both the image sensors 20 and illustrated in a single composite image. Here, each of the check lines L comprises 55 pixels. In addition, no check lines L are set in the vicinity of the pouring nozzle 52 because the slag rim 60 is less liable to form. Depending on the width or thickness of the mold 1 changed on demand, the number of the check lines L may be increased or decreased.

Then, the image signals representing a melt surface condition and input from time to time are converted to distribution of brightness along each of the check lines L. The distribution of brightness thus taken at some moment along one of the check lines L is the solid lines X shown in FIG. 30, which corresponds to the distribution of brightness along the check line L1 in FIG. 32.

The time-dependent distributions of brightness determined by the image processor 63 along the respective check lines L are input to the arithmetic unit 64 which arithmetically and logically processes the input signals to judge a condition of the formed slag beard 64.

More specifically, the arithmetic unit 64 first detects the minimum value A, the bent point C and the maximum value B mentioned above. In other words, it determines the presence or absence of the minimum value A and the maximum value B and, if present, then calculates the maximum-to-minimum distance therebetween.

The position where the slag beard 60 is adhering to the mold wall surface 2, that is, the minimum value A, can be determined by, for example, scanning the distribution of brightness shown in FIG. 30 from the left, that is, the side adjacent the mold upper surface 2*a*, to the right (or toward the center of the mold), and detecting the position where brightness is abruptly dropped and gives the minimum value. This detection process is equivalent to that for the mold wall surface 2 described above. The detected position of the mold wall surface 2 may thus be regarded as an adhesion point of the slag beard 60. Likewise, the position of distal end of the slag beard 60 can be detected by determining a peak at which brightness rises sharply, or a peak exceeding a predetermined level, that is, the maximum value B, as will be seen from FIG. 30. When an amount of powder becomes short, in particular, parts of the molten powder 9 may momentarily be exposed or emerged to the surface due to oscillations of the mold 1. In this case, the exposed part(s) of the molten powder 9 have very high brightness and hence the sharp peak appears at two or more positions, resulting in a fear that the peak incidental to the molten powder 9 may be erroneously recognized as the distal end of the slag beard. Such erroneous recognition can be prevented by, for example, detecting only the first rising peak starting from the mold wall surface 2 as the maximum value B, or measuring several time-series distributions of brightness and then smoothing or averaging them.

When only the bent point C appears and the maximum value B is not detected, this is judged to be in a normal state where no slag beard 60 is formed.

Next, an amount of the formed slag beard 60, that is, thickness t of the slag beard, can be estimated by determining the distance 11 between the positions where the minimum value A and the maximum value B occur in the distribution of brightness. More specifically, by previously deriving correlation between the maximum to-minimum distance t1 determined from the distribution of brightness and the thickness t of the actually formed slag rim, dependent on the intersect angle and length of each check line L with respect to the mold wall surface 2, as well as the equipment conditions, the slag beard thickness t can be precisely estimated based on the maximum-to-minimum distance t1 which is detected from time to time during the casting operation. It is also possible to set procedures for the geometrical arithmetic processing mentioned above and then correct the maximum to-minimum distance t1 derived from the distribution of brightness through those processing procedures. The maximum-to-minimum distance t1 is calculated by, that is, counting the number of pixels between the minimum value A and the maximum value B.

By deriving the distributions of brightness for all the check lines L shown in FIG. 32, it becomes possible to detect a condition of the formed slag beard 60, the size (horizontal breadth) thereof and so forth for the entire mold. The condition of the formed slag beard 60 thus detected by the arithmetic unit 64 is displayed on the display unit or indicator 65.

Figure 33:
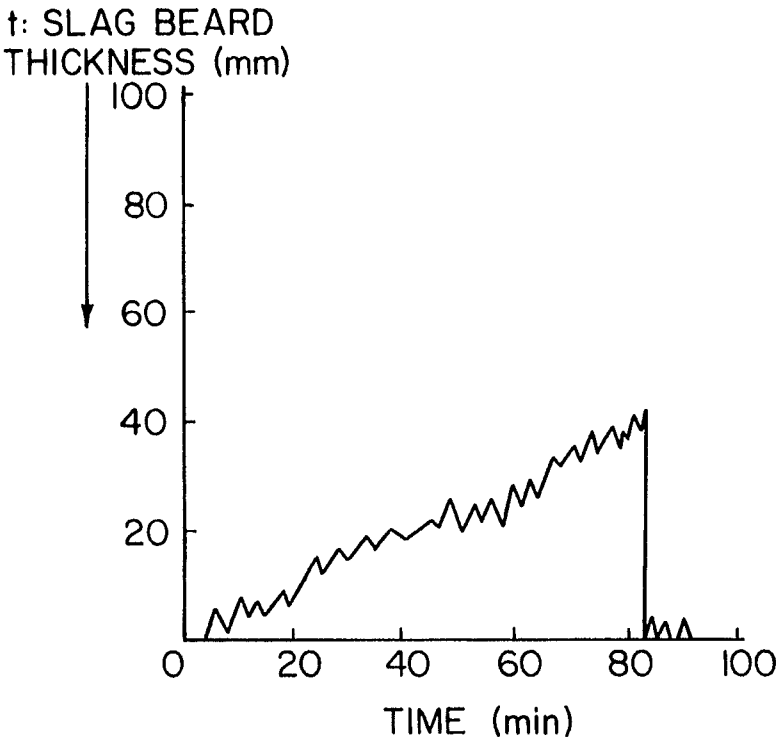

FIG. 33 is a graph showing one example of detecting a condition of slag beard formation along the check line L2 (locating at 70 mm from one short side of the mold) in FIG. 32 under the operating conditions where the casting size is 250 mm×1350 mm and the casting speed is 1.4 m/min.

In this example, in parallel to the above measurement, a skilled operator measured the thickness t of the formed slag beard 60 using a scale, and the measured result was compared with the thickness of the slag beard 60 detected in accordance with the present invention. As a result, it was confirmed that there was no appreciable difference between the thickness of the slag beard 60 in accordance with the present invention and the thickness thereof actually measured by the skilled operator, and hence that the condition of the formed slag beard 60 can be precisely detected by practicing the present invention. An abrupt descent in brightness at the elapsed time point of about 80 minutes in FIG. 33 is resulted from the operator sticking to drop the slag beard 60, and precisely corresponds to the condition of the formed slag beard 60.

There will now be described a device for removing the slag beard based on detection of slag beard formation obtained by the above described method.

Figure 34:
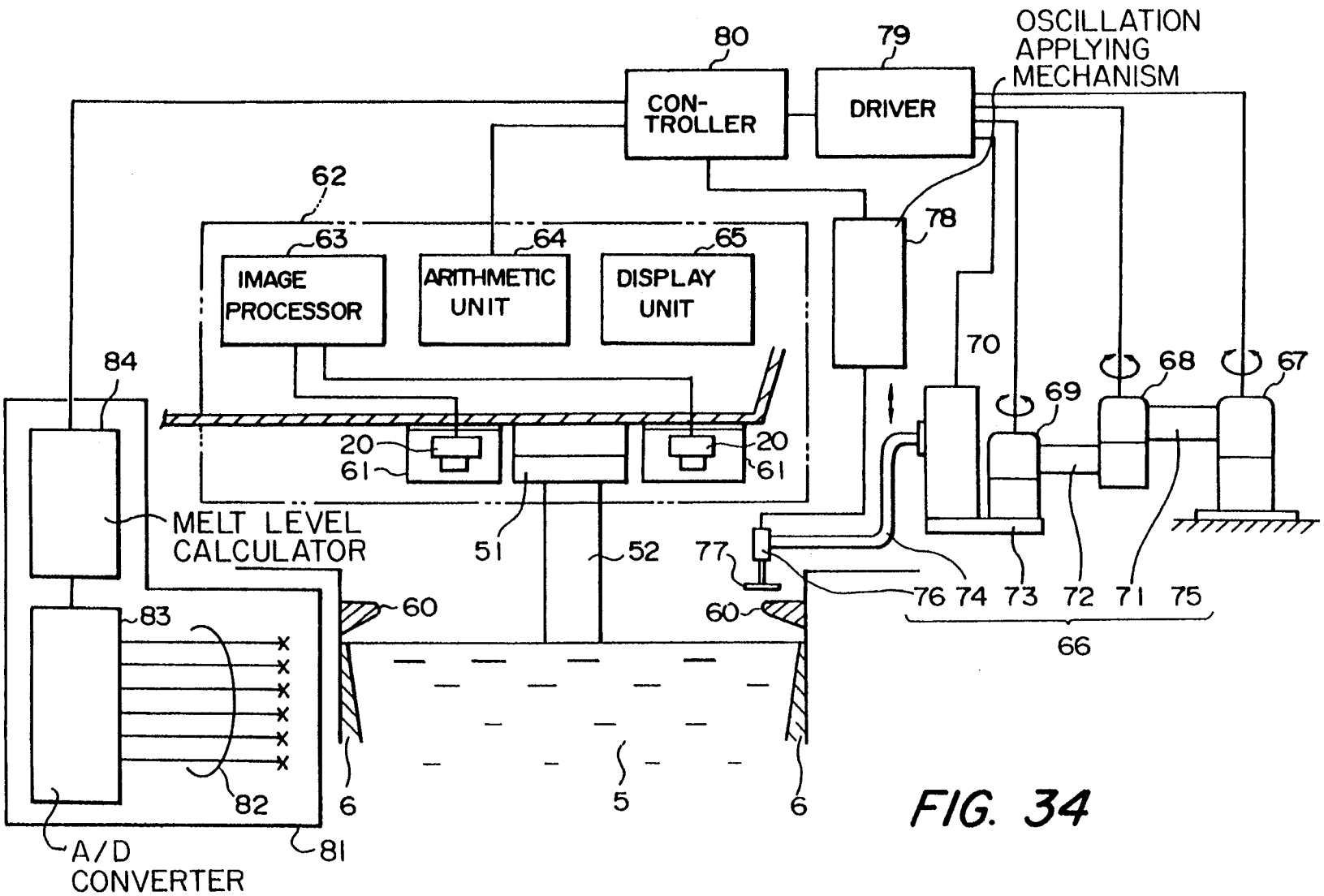

FIG. 34 is a block diagram showing one example of a slag beard detecting and removing device in accordance with the present invention.

In FIG. 34, designated by 76 is a hitting oscillator with an oscillation applying mechanism to break or crush the slag beard 60. Designated as 66 is a multi-articulated arm which comprises a first rotatable drive shaft 67, a second rotatable drive shaft 68, a third rotatable drive shaft 69, a vertically movable shaft 70, a first arm 71, a second arm 72, a third arm 73, a fourth arm 74, a mount base 75, and the like, and which is driven to rotate and move vertically. The hitting oscillator 76 is mounted to the distal end of the multi-articulated arm 66. Thus, the hitting oscillator 76 is structured such that it can be freely moved within the mold 1 by driving the arm 66. Designated by 78 is an oscillation applying mechanism for driving the hitting oscillator 76. In this example, the oscillation applying mechanism 78 is of the type that supplies compressed air to reciprocate (or oscillate) the hitting oscillator 76 in a vertical direction. The electrically-operated or any other desired type may instead be employed. From experience of the inventors, however, it has been found that the pneumatic type mechanism is most excellent as far as reliability and hitting ability of the mechanism under the associated environmental conditions.

Designated by 79 is a driver for driving the arm 66, and 80 is a controller for issuing a drive start command signal to the hitting oscillator 76 through the oscillation applying mechanism 78 and position control signal to the driver 79 in response to the detection of slag beard formation. Designated by 81 is a melt surface level detector for detecting a surface level of the melt, the detector 81 comprising a group of thermocouples 82, an A/D converter 83 for converting an analog signal to a digital signal, and a melt level calculator 84. The same reference numerals as those in FIGS. 30 and 31 designate the same components and their explanation is omitted here.

Operation of the slag rim detecting and removing device will be described below.

First, information on the presence or absence of the formed slag beard along the respective check lines L and the values of the slag beard thickness t are input to the controller 80 from the slag beard formation detecting device 62 mentioned above. The controller 80 previously stores therein the thickness of the slag beard at which it should be removed (hereinafter referred to as removal reference value D), and compares this removal reference value D with the slag beard thickness t actually detected and applied from the detecting device 62 during the casting operation. If there is found any check line L for which the slag rim thickness t actually detected is larger than the removal reference value d, this is judged as an indication for the need of removing the slag beard, immediately followed by calculating the planar or two-dimensional position coordinates of that check line L in the mold 1.

Based on the above calculated result, the controller 80 issues a position control command to the driver 79 for the arm 66, so that the hitting oscillator 76 mounted at the distal end of the arm 66 is moved to a position corresponding to the formed slag beard. When the hitting oscillator 76 is moved to a position corresponding to the formed slag beard, a drive command is immediately issued to the oscillation applying mechanism 78 to start oscillating the hitting oscillator 76. Then, oscillations are applied to the slag beard 60 while descending the hitting oscillator 76, thereby breaking and crushing the slag beard 60 for removal thereof. The broken and crushed pieces of the slag beard 60 are dropped into the mold and then remelted upon being subjected to heat of the melt 5, so that they restore original function of powder while moving along the mold wall surface.

In this connection, the hitting oscillator 76 can be moved precisely above the formed slag beard, because it can take a precise planar position by the slag beard formation detecting device 62 as mentioned above. However, it is hard to confirm a vertical position at which the slag beard is formed. From the experience of the inventors who collected data related to slag beard formation within the mold 1 and studied them from various viewpoints, it has been found that the slag beard is formed at a certain height from the surface level of the melt 5. Therefore, the slag beard may be effectively removed by adopting a method of moving the hitting oscillator 76 to a position above the formed slag beard and then lowering it down to a level near the usual melt surface level while applying oscillations to the hitting oscillator 76, or a technique of attaching a touch type sensor at the tip end of the hitting oscillator 76 and starting to oscillate the hitting oscillator 76 by a trigger signal issued when the hitting oscillator 76 contacts the slag beard 60.

In order to more precisely grasp the vertical position of the slag beard, the example of FIG. 34 adopts a well-known melt surface level detector 81 arranged to embed the group of thermocouples 82 in the mold 1 and detect a surface level of the melt 5 based on the temperature information detected therefrom. A current melt surface level signal is taken by the melt surface level detector 81 and input to the controller 80 during the casting operation. That melt surface level signal is added with a distance from the melt surface to the position at which the slag beard is formed, the distance being previously determined from the past experience and stored in the controller 80, thereby to detect the vertical position of the formed slag beard.

Although the arm 66 of the horizontally multi-articulated type was used in this example, an arm of the vertically multi-articulated type may be employed so long as the hitting oscillator 76 can freely move within the mold 1. However, because of a very small and narrow space around the mold 1 and the tundish 19, the arm of the horizontally multi-articulated type is more preferable. Also, an oscillating member 77 mounted at the distal end of the hitting oscillator 76 is preferably formed of a rectangular plate of iron due to the need for clearly removing even the slag beard 60 which has been formed at angled corners of the mold 1. Since the slag beard can be broken and crushed just by slightly contacting the hitting oscillator 76 with the slag beard 60 while moving the hitting oscillator 76 from a position right above the slag beard 60 downwardly, the hitting oscillator 76 is not required to be operated in such a manner as to forcibly penetrate or intrude into the slag beard 60 for removing it. Forcible intrusion of the hitting oscillator 76 is undesirable because the solidifying interface of the casting may be damaged upon such intrusion.

Figure 35:
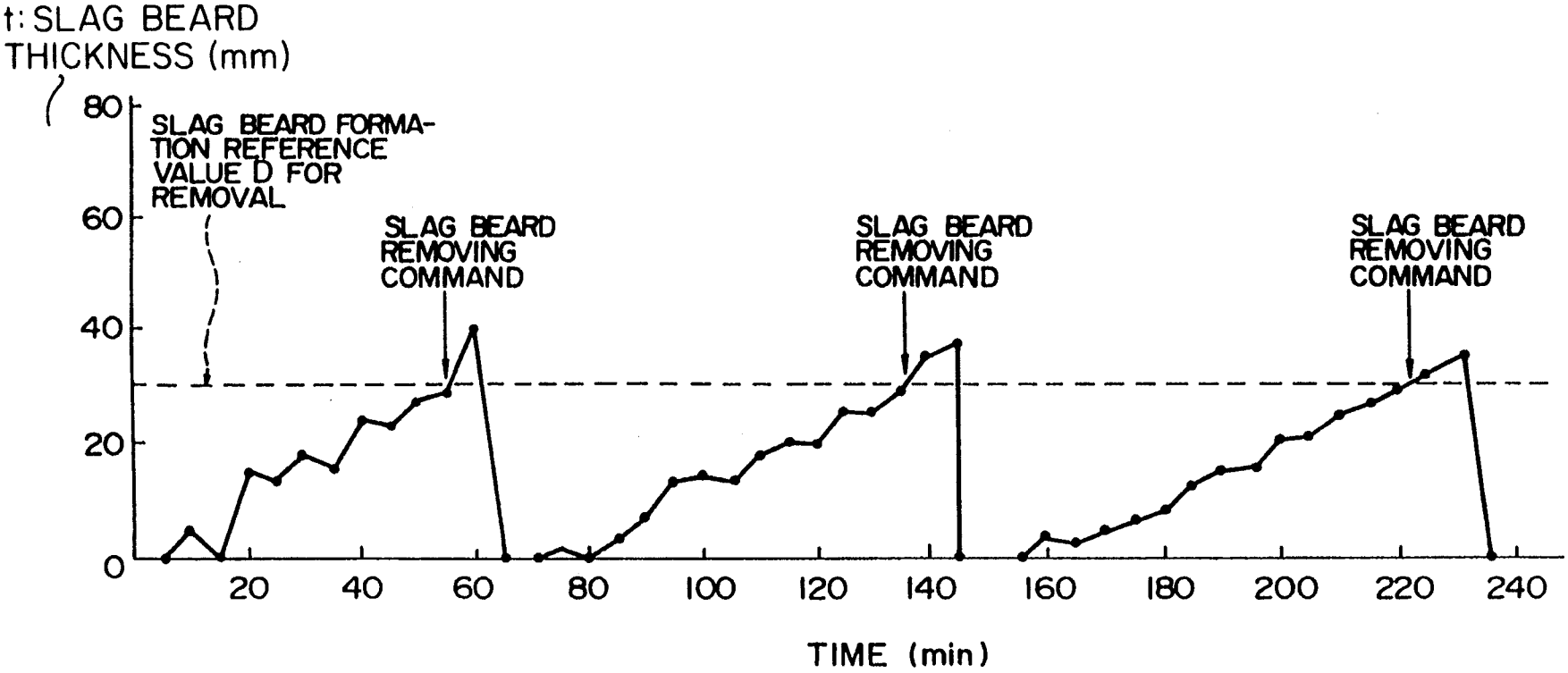

FIG. 35 shows one example of a result of the operation actually carried out using the slag beard detecting and removing device as mentioned above, under the casting conditions where the casting size is 250 mm×1350 mm and the casting speed is 1.4 m/min. FIG. 35 indicates time-series changes in the thickness of slag rim for a preset particular check line L. This example is so arranged that whenever the thickness of slag rim exceeds the removal reference value D (here set to be 30 mm empirically), a slag rim removing command is issued. As will be seen from FIG. 35, whenever the thickness of slag beard exceeds the removal reference value D, the removing device is operated effectively to surely remove the slag beard. Thus, it became possible to efficiently detect a condition of slag beard formation without intervention of any operators, and to remove the slag beard based on the detected result. Also, the castings having been cast in this example were completely free of surface defects and extremely excellent in quality.

As described above, the method and apparatus of this embodiment enable to automatically detect a condition of slag beard formation and to remove the formed slag beard during continuous casting. In other words, it is possible to achieve the automated slag beard removing operation which has been a key point in realizing the complete automated casting operation in continuous casting up to date. This not only provides a great motive factor toward the completely automated casting operation in continuous casting, but also ensures the stable continuous casting operation and production of castings with good quality.

This is an embodiment dealing with the problem of Deckels formation (see the above section D).

Figure 36:
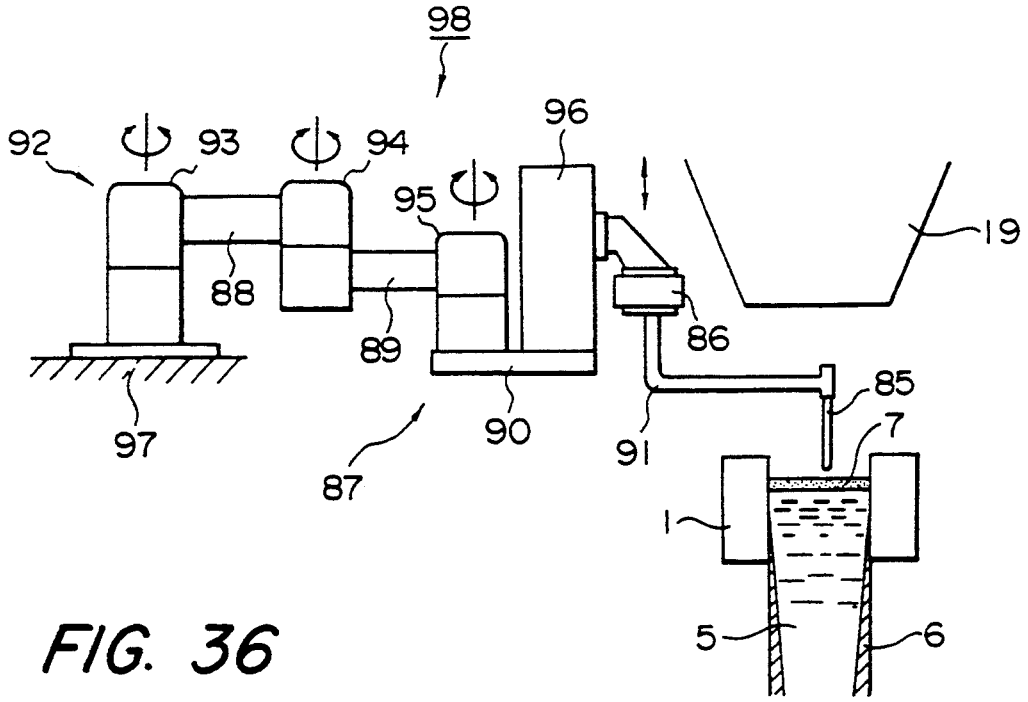

FIG. 36 is a block diagram showing one example of a Deckel formation detecting device in accordance with this embodiment. In FIG. 36, designated by 1 is a mold for continuous casting, 5 is a melt (molten steel), 6 is a solidified shell produced by being cooled by the mold 1, and 7 is mold powder. Designated by 98 is a Deckel formation detecting device (hereinafter referred to simply as detecting device) of this embodiment. The detecting device 98 comprises a sensor rod 85 dipped into the melt 56 within the mold 1, a load sensor 86 for detecting the load exerted on the sensor rod 85, a multi-articulated support arm (hereinafter referred to simply as support arm) 87 for supporting at its distal end the sensor rod 85, and a driver 92 for driving the support arm 87. In this embodiment, the support arm 87 is mounted on a base 97 near the mold 1. Numeral 19 in FIG. 36 designates a tundish.

Figure 37:
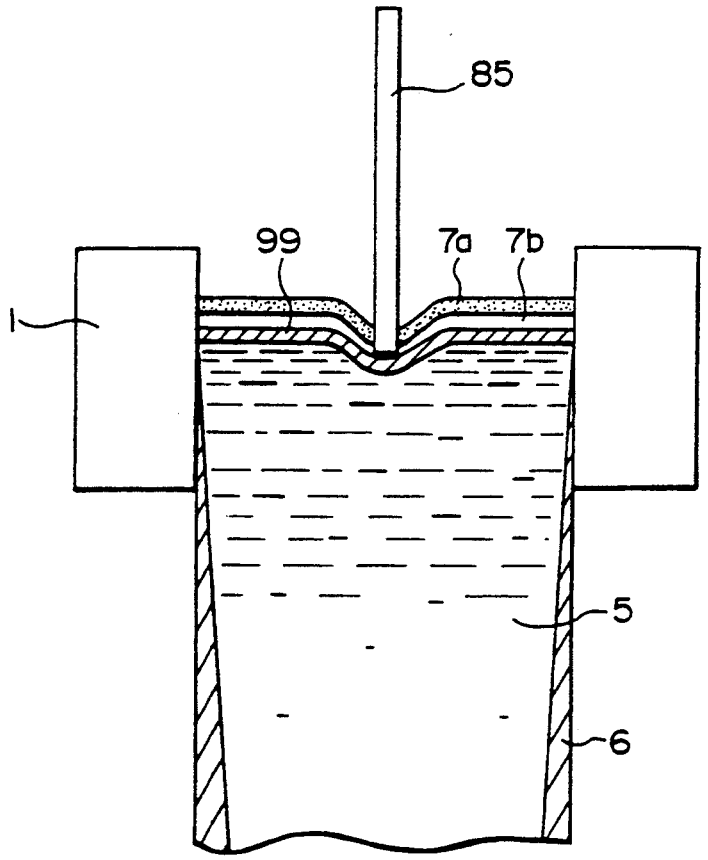

FIG. 37 is an enlarged sectional view of the mold 1 in which the Deckel 99 is formed. As explained above, the Deckel 99 is solid resulted from solidification of the melt 5 and formed into a leather-cover shape on a surface of the melt 5. The Deckel 99 is formed all over the melt surface in some cases as shown in FIG. 37, and over partial regions of the melt surface in other cases, though not shown. In any cases, however, there float non-molten mold powder **7*a* and molten mold powder 7*b* above the Deckel 99, so that the Deckel 99 is always covered with those two types of mold powder This embodiment is so arranged that the sensor rod 85 is dipped into the melt 5 within the mold 5 to detect the load exerted on the sensor rod 85 at that time. More specifically, when the sensor rod 85 is dipped into the melt 5, on which the Deckel 99 is formed, and then pushed downwardly, the sensor rod 85 is subjected to upward reaction exerted from the Deckel 99 being pressed. (The reaction will be called load in this specification). On the other hand, if the Deckel 99 is absent, no appreciable load is exerted on the sensor rod 85. This is because the sensor rod 85 and the melt 5 have substantially equal specific gravity. Thus, if the sensor rod 85 is made of steel, for example, its specific gravity is about 7.8 g/cm , while the melt 5** has specific gravity of about 7.5 g/cm3.

The inventors have examined the above load that is exerted upon formation of the Deckel.

Figure 38:
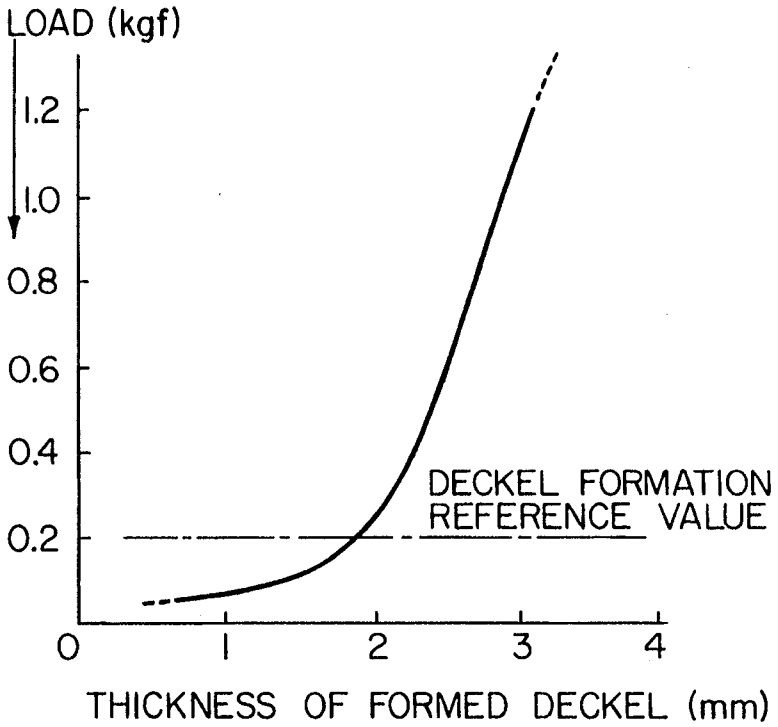

FIG. 38 is a graph showing one example of an examined result. In this examination, the Deckel was formed intentionally and the sensor rod 85 was pushed against the formed Deckel to detect the load exerted on the sensor rod 85. As will be seen from FIG. 38, when the Deckel is about 1 mm or less thick, the load is very small so as to be undetectable. However, when the Deckel becomes about 2 mm or more thick and forms such a Deckel layer as essentially affecting the casting operation, the load is abruptly increased and can be made clearly distinct from the case where the Deckel is absent. (That load which starts increasing abruptly and at which formation of the Deckel is confirmed will hereinafter be called a Deckel formation reference value.) The load exerted on the sensor rod 85 from the Deckel and measured in this embodiment for detecting formation of the Deckel may be given by dipping the sensor rod 85 into the melt and measuring the resistant load while moving it horizontally, rather than the load produced upon the sensor rod 85 being pushed into the melt.

By previously deriving the relationship or correlation between the thickness of Deckel and the load exerted on the sensor rod 85 dependent on the equipment and operating conditions during continuous casting, whether or not the Deckel is formed can be grasped in a quantitative manner using the load sensor 86 to detect the load exerted on the sensor rod 85 dipped into the melt 5 within the mold 1.

The sensor rod 85 is supported at the distal end of the support arm 87 such that it can be freely raised or lowered and moved horizontally even in a small and narrow space in which the tundish 19 is installed. The support arm 87 of this embodiment has three rotatable arms 88, 89 and 90, and a liftable arm 91. The rotatable arms 88, 89 and 90 are associated with rotation drivers 93–95, respectively, and the liftable arm 91 is associated with a lift driver 96. When the rotation drivers 93–95 are controllably driven, the arms 88–90 are rotated about the rotation drivers 93–95, respectively, so that the sensor rod 85 supported the distal end of the support arm 87 can be freely moved.

Further, when the lift driver 96 is controllably driven, the liftable arm 91 is moved vertically, allowing the sensor rod 85 to be located at an arbitrary position in the mold 1 and dipped into the melt in cooperation with the movement of the arms 88–90. The load sensor 86 is interposed in the fore end arm 91 for supporting the sensor rod 85, and arranged so as to detect the reaction load exerted on the sensor rod 85 through the fore end arm 91.

In the foregoing example, the support arm 87 includes the four drivers 92 (i.e., rotation drivers 93–95 and lift driver 96), and the load sensor 86 is positioned remote from the sensor rod 85. But, the number of the drivers 92 may be any desired one within a range where the sensor rod 85 can be freely moved in the mold 1. Also, the load sensor 86 may be disposed in any desired position in the multi-articulated support arm 87 without problem. However, the above example in which the load sensor 86 is positioned remote from the very hot melt 5, is more effective in protecting the load sensor 86 as a precision device from heat at high temperatures. As the load sensor 86, there was employed a 6-axis load sensor capable of detecting three components of load in a direction in which the sensor rod is pushed into the melt (for example, vertical direction =Z-axis direction) and in a horizontal direction in which the sensor rod is moved in the melt (for example, X- and Y-axis directions), as well as three components of moment about the X-, Y- and Z-axes. Where the sensor rod 85 and the arm are moved in a small and narrow space with a possible fear of these moving members bumping against the tundish 19 and the mold 1, use of the 6-axis load sensor is advantageous in that it can detect the direction of such bumping, if occurred, and hence permits to take such a proper action as immediately retracting the bumped members in an opposite direction based on the detected by the load sensor. However, in a case where that fear does not count and detection of the Z axis load is just needed, a simple load gauging device comprising a known strain gauge attached to an appropriate location, for example, may be used in place of the load sensor 86.

Furthermore, the sensor rod 85 may be formed of any suitable material such as ceramics, heat-resistance alloys or steel. During the process where the sensor rod 85 is dipped into and then withdrawn from the melt 5 respectively, the melt 5 gradually gets solidified and deposited on the sensor rod 85, whereby the sensor rod 85 becomes useless semi-permanently at some future time. For the reason, the support arm 87 is desirously provided at its distal end with a mechanism capable of easily attaching and detaching the sensor rod 85.

Next, a method for detecting a condition of Deckel formation with the detecting device 98 will be described below. First, the drivers 93–96 of the support arm 87 are driven and controlled for moving the sensor rod 85 supported at the distal end of the support arm 87 to a predetermined position above the melt 5 within the mold 1. Such a position may be selected in a region where the Deckel is expected to more likely to form from the past experience, or may be set in one of the regions defined by dividing the melt surface in the mold with certain intervals. When the sensor rod 85 has moved to the predetermined position, the lift driver 96 is then driven to dip the sensor rod 85 into the melt 5. Simultaneously with the sensor rod 85 being pushed and dipped into the melt 5, the load exerted on the sensor rod 85 is continuously detected by the load sensor 86. A detected value of the load sensor 86 is monitored and compared with the Deckel formation reference value, so that a condition of the formed Deckel can be precisely detected.

Figure 39:
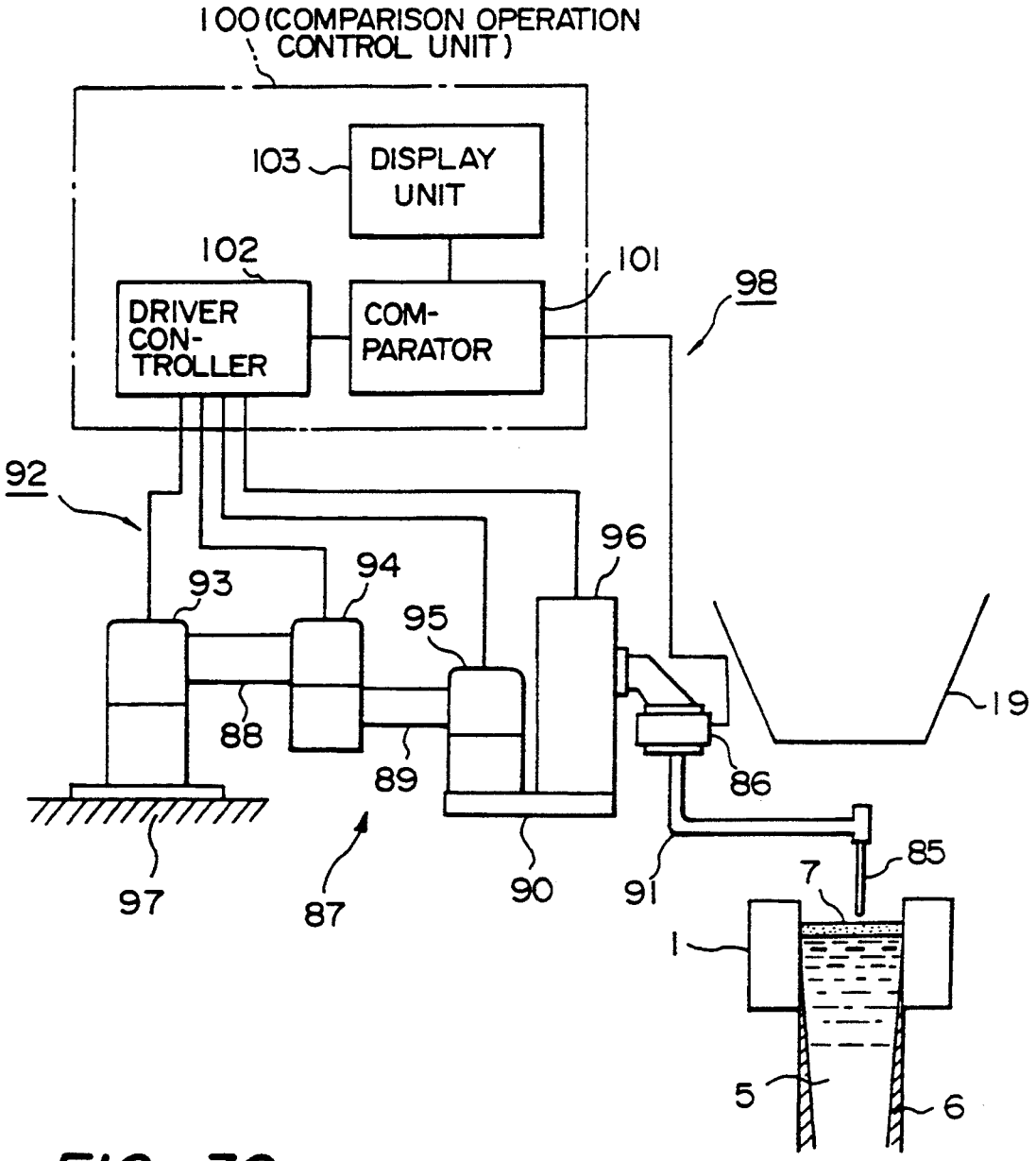

FIG. 39 is a block diagram showing one example of a device for effectively removing the formed Deckel when formation of the Deckel is detected by the above described detecting device 98, such as, one example of a Deckel removing device with this embodiment. The same reference numerals in FIG. 39 as those in FIG. 36 designate the same components and their explanation is omitted here. Referring to FIG. 39, designated by 100 is a comparison operation control unit with a #unction of detecting a condition of the formed Deckel 99 and controlling the sensor rod 85 immediately upon detecting formation of the Deckel to start Deckel removing process. More specifically, the comparison operation control unit 100 previously stores therein the Deckel formation reference value, preset dependent on the current operating conditions, and also receives a detected value from the load sensor 86 during the casting operation. Designated by 101 is a comparator for comparing the Deckel formation reference value and the detected value from the load sensor 86. When the comparator 101 confirms that the detected value from the load sensor exceeds the Deckel formation reference value, a signal indicative of it is immediately issued to a driver controller 102 which in turn issues drive commands to the respective drivers 92. Further, 103 is a display unit or indicator for displaying the result of the comparator 101.

The display unit 103 is arranged to indicate alarm information, for example, when the detected value from the load sensor exceeds the Deckel formation reference value.

Removal of the Deckel 99 is effected as follows. For example, when the Deckel 99 is dipped by the sensor rod 85 into a deep position within the melt 5, it is remelted and removed by being subjected to heat of the melt 5. In a case where the Deckel 99 is not remelted with just dipping, the melt may be agitated or stirred for more effective heat transfer. From the inventors experience, most of the Deckels 99 has been found to remelt simply by dipping them into a deep position within the melt using the sensor rod 85.

Also, it is therefore preferable that the operation of agitating the melt is minimized in a point of preventing the occurrence of possible defects on castings.

Figure 40:
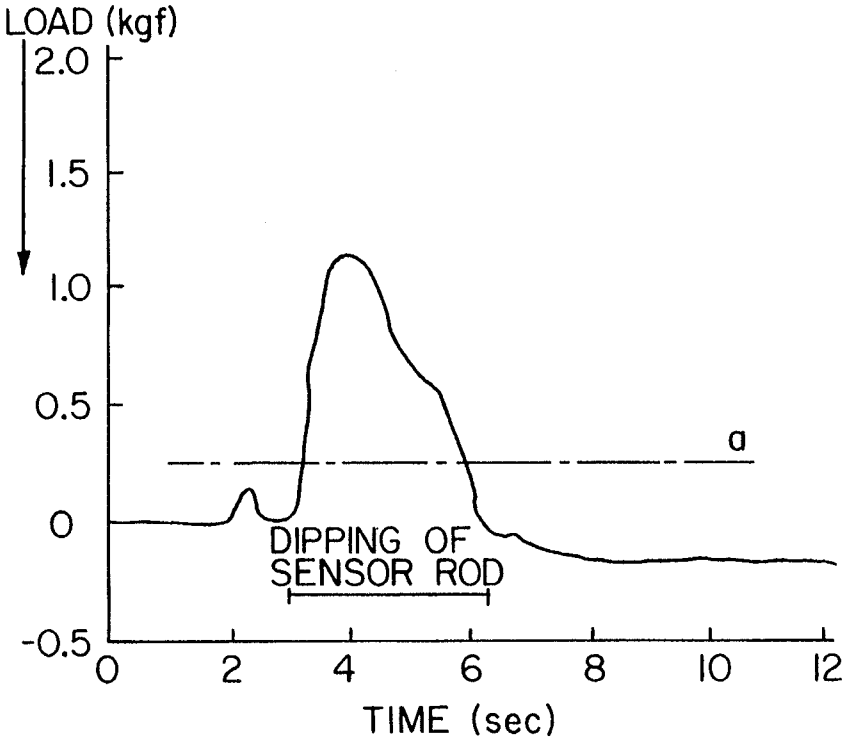
FIGS. 36 to 40 are a fourth group of drawings related to an embodiment IV.

FIG. 40 is a graph showing one example of a result of practicing this embodiment under the operating conditions where the cross-sectional size of castings is 250 mm×1200 mm and the casting speed is 0.8 m/min. In this example, the Deckel removing device shown in FIG. 39 is used to directly push the sensor rod 85 into a deeper position within the melt when formation of the Deckel is detected. FIG. 40 shows one example of a change mode of the load exerted on the sensor rod 85 in this case. The Deckel formation reference value was set to 0.25 kgf from the past data obtained under the same conditions. As will be seen from FIG. 40, when the sensor rod 85 was dipped into the melt, the load was immediately increased exceeding the Deckel formation reference value indicated by a one-dot chain line a, whereby formation of a Deckel was confirmed. In response to the confirmation, the driver controller 102 of the comparison operation control unit 100 issued a control signal, causing the sensor rod 85 to be pushed into a deeper position and held there. As a result, the load was gradually reduced down to a level less than the Deckel formation reference value at the elapsed time point of about 6 sec. This indicated that the formed Deckel was remelted and removed.

In parallel, the above process was manually monitored by an operator. As a result, it was confirmed that formation and removal of the Deckel automatically detected in that example precisely corresponded to the actually monitored process.

As described above, the device of this embodiment enables to automatically detect and remove a Deckel. This eliminates the need of carrying out direct manual work by operators, thereby improving a degree of safety and surely preventing errors in operation incidental to the manual work. It becomes also possible to achieve the completely automated casting operation by combining the device of this embodiment with other automated equipment for use in the casting operation during continuous casting such as a mold powder automatic supply device, for example.

The fifth embodiment deals with the problems related to automation of the operation (see above section E).

Figure 41:
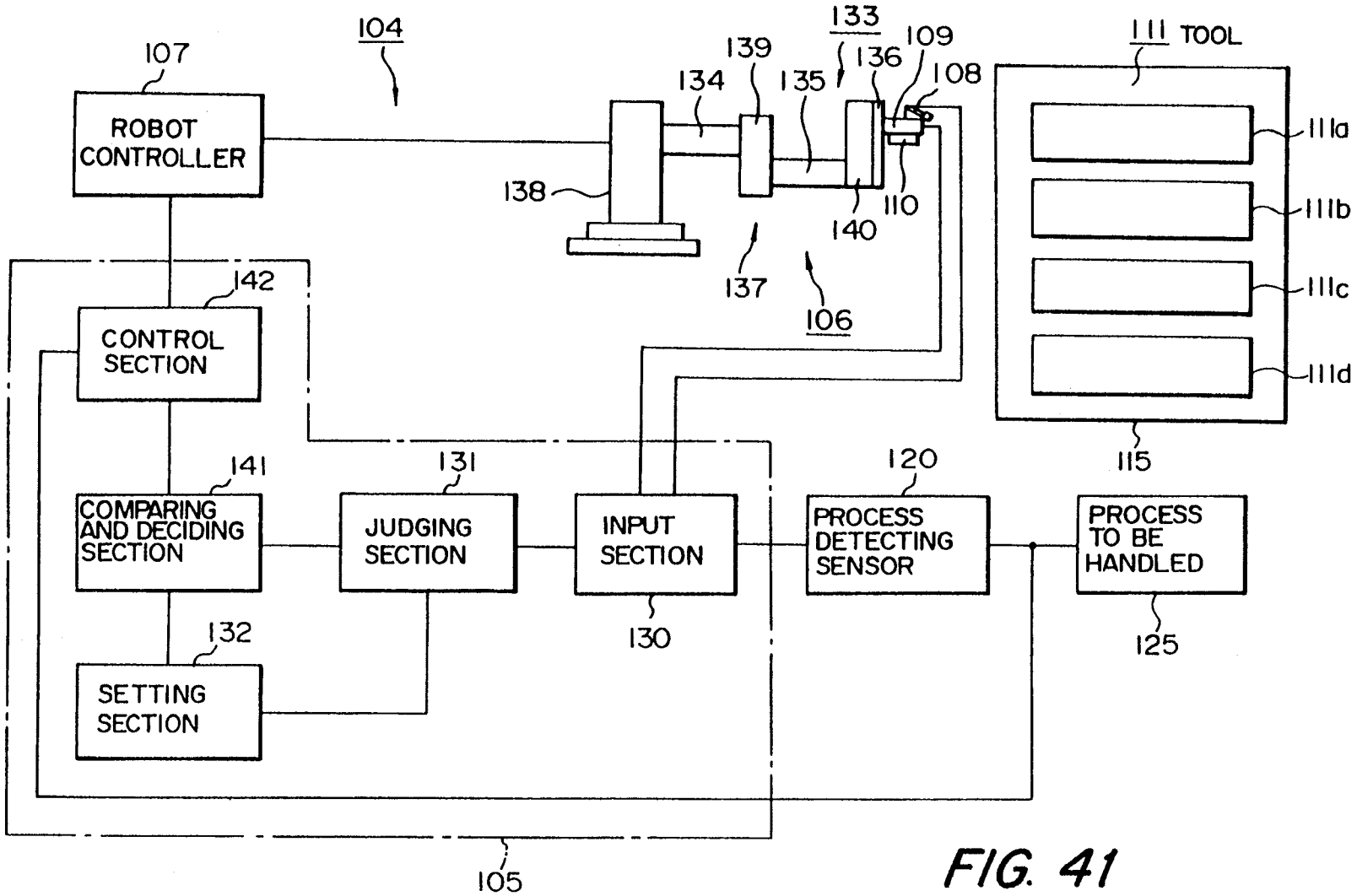
[FIGS. 41 to 48 are a fifth group of drawings related to an embodiment V]

FIG. 41 is an entire block diagram showing one example of a multi-functional robot according to this embodiment.

Referring to FIG. 41, a multi-functional robot 104 is a universal robot having a support arm of the horizontally multi-articulated type, which comprises a synthetic judgment controller 105 and a robot body 106. The robot body 106 comprises a multi-articulated support arm 133 consisting of support arms 134, 135 and 136 interconnected in a rotatable and liftable manner, and arm drivers 138, 139 and 140 for driving the support arms 134, 135 and 136, respectively. The robot body 106 is thus arranged such that by driving the arm drivers 138, 139 and 140 individually, the support arms 134, 135 and 136 are rotated horizontally or moved vertically, allowing the distal end of the robot body to be moved to an arbitrary position. Although the multi-articulated support arm 133 adopted in this example is constituted as the horizontally multi-articulated type that only the support arm 136 is moved vertically during up and down strokes of the arm driver 400, any other type arm may be used so long as a tool 111 (described later) can freely move within a working region. Also, the combination and number of respective components of the support arm 133 and the arm drive unit 137 (including all the arm drivers 138, 139 and 140) are not limited to this example, because they should be so properly decided as to ensure the most efficient operation dependent on an available space.

At the distal end of the robot body 106 (i.e., distal end of the support arm 136 in this example), there are installed a visual sensor 108, a load sensor 109 and an ATC mechanism 110 (all described later). The visual sensor 108 is to pick up an image of the working region of the robot, and positioned in such a location as to enable to viewing of the working region. The visual sensor 108 may be installed on an appropriate mount base near the working region, for example, rather than the distal end of the support arm 136. Alternatively, the visual sensor 108 may be provided in plural, at least one near the working region and at least one at the distal end of the support arm 133. The ATC mechanism 110 is to change or attach and detach various types of tools 111 in response to a tool change command signal (describe later), and comprises, through not shown, a grip portion driven by air, hydraulic fluid or the like and a sensor portion for confirming an attached or detached state of the tools 111. There are prepared a plurality of tools 111 which are constituted to have mechanism and structure suitable for respective works and set on a tool stand 115 provided near the robot 106. The load sensor 109 is to detect the load exerted on the distal end of the tool 111 attached to the ATC mechanism 110, and is usually disposed between the distal end of the support arm 133 and the ATC mechanism 110. This load sensor 109 is preferably of a 6-axis type sensor because it is effective in obtaining more precise three-dimensional load information.

On the other hand, operating situations of line and process to be handled by the robot (hereinafter referred to collectively as process) 125, such as a line speed and line stop, are detected by a process detecting sensor 120 comprising individual sensors properly combined dependent on the contents to be detected.

The synthetic judgment controller 105 comprises an input section 130 to which is applied picked-up image information from the visual sensor 108, load information from the load sensor 109, and a process detection signal from the process detecting sensor 120; a judging section 131 for processing the input signals from the input section 130 in accordance with the sequence previously arranged and set, and then judging situations of the working contents and the working region of the robot at the current time; a setting section 132 for previously setting priority of the working positions and the working contents based on the current operating conditions of the process to be handled by the robot and situations in the working region of the robot; a comparing and deciding section 141 for comparing a signal from the judging section 131 with that from the setting section 132, and scheduling and deciding the highest priority or most efficient working content dependent on the current situations; and a control section 142 issuing one or more control signals (described later) based on decision of the working content made by the comparing and deciding section 141. The input section 130 processes and sorts the picked-up image information, the load information and the process detection signal in a prescribed manner using an image processor, an arithmetic unit and so forth, and then applies the processed result to the judging section 131.

The decision of the working content made by the comparing and deciding section 141 by comparing both the signals from the judging section 131 and the setting section 132 to each other, is input to the control section 142. The control section 142 issues, based on the decided working content, a change command signal for the tool 111 to the ATC mechanism 110, a drive control signal to the arm drive unit 137, and/or a control signal to the process 125. Depending on the operating condition, one or more of those control signals are issued, simultaneously in the latter case, to instruct the robot 104 to carry out the work fitted for maximum efficiency work. In this embodiment, the control signals from the control section 142 are input to the process 125 and a robot controller 107 for controlling the associated portions in the process 125, and the ATC mechanism 110 and the arm drive unit 137 via the robot controller 107.

This embodiment will now be described in more detail in connection with an application example thereof to a packaging process for electric parts. In that packaging process, the plural tools 111 are used to perform various works, such as palletizing (or material handling), fitting and bolt fastening, for plural parts at plural positions. Thus, the single work or plural works are carried out at various working positions for each tool or each part. To begin with, the visual sensor 108 monitors visual situations of a line, such as positional and rotational deviations of the parts, and variations in a stop position of the line, which are changed from time to time. Further, the load sensor 109 monitors a load conditions, such as a press strength or torque, when the robot 104 carried out the work of fitting or bolt fastening, and also measure and take load information used for control during the work. In a normal state, the signals from the visual sensor 108, the load sensor 109 and the process detecting sensor 120 are input to the judging section 131 through the input section 130. The judging section 131 monitors and recognizes situations of the process. If no abnormality is found, the comparing and deciding section 141 decides the working content in accordance with the priority of works preset in the setting section 132, and then applies that decided working content to the control section 142. The control signals from the control section 142 are, as mentioned above, input to the process 125 and robot controller 107 for controlling the associated portions in the process 125, and the ATC mechanism 110 and the arm drive unit 137 via the robot controller 107, respectively, thereby permitting the robot 104 to carry out the work with maximum efficiency.

Meanwhile, if the judging section 131 judges from the information from the input section 130 that there occurs any abnormality in positional or rotational deviations of the parts, a stop position of the line, torque or the like, the comparing and deciding section 141 takes in and compares information on, such as, the state of the process and the state of robot operation from the judging section 131 at the current time, the content of the occurred abnormality, the possible working contents of the robot at the current time, as well as information on the preset priority from the setting section 132, thereby arranging and scheduling the works to be handled by the robot since then through its own processing and deciding the working contents and their priority, followed by operating and controlling the robot and so forth as mentioned above. In the event that there occur many abnormalities and hence multiple work commands including those for normal works are issued successively, the working efficiency could not be so sufficiently increased as to catch up with the progress of the operation, if the works are executed simply following the priority preset for a normal case. This tends to cause serious problems such as stop of the line, equipment trouble, and degradation in quality. For the reason, it is very important and effective to provide the synthetic judgment controller 105 capable of preventing those problems with certainty.

Next, there will be described below an example where the robot is applied to a casting operation process in continuous casting.

Figure 42:
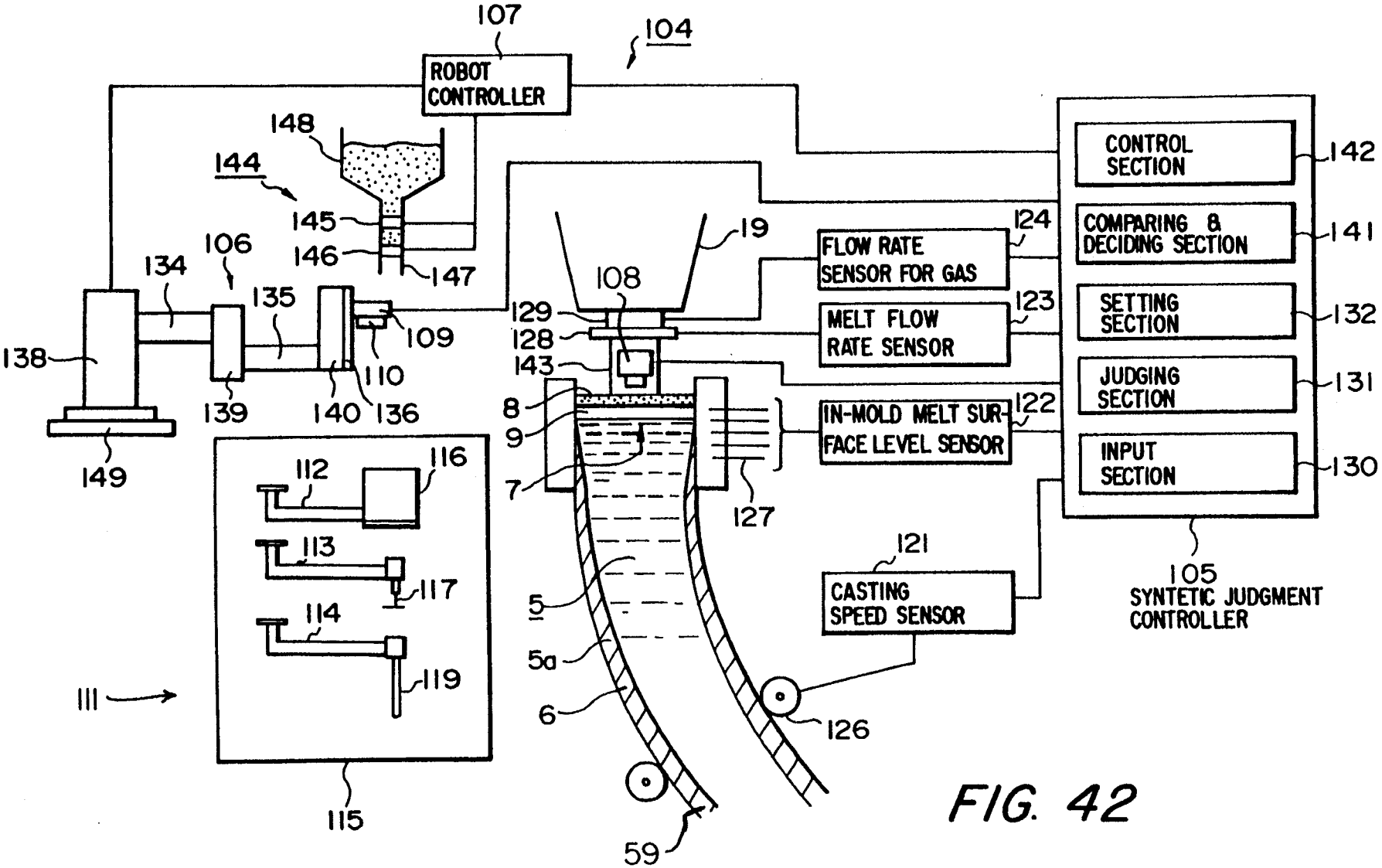

FIG. 42 is an overall block diagram showing one example of a multi-functional robot in accordance with this embodiment which is applied to a casting operation process. Referring to FIG. 42, designated by 1 is a mold, 59 is a casting being cast into a product, 5 is a melt (molten steel), 6 is a solidified shell produced from the melt 5 upon cooling thereof, 7 is powder, and 143 is a pouring nozzle. The powder 7 is in the layer form mainly comprising a non-molten powder layer 8 and a molten powder layer 9. Designated by 121–124 are process detecting sensors; 121 is a casting speed sensor, 122 is an in-mold melt surface level sensor, 23 is a melt flow rate sensor, and 124 is a flow rate sensor for gas blown into the pouring nozzle 143. Designated by 126–129 are controllers for a process 125. More specifically, 126 is a casting speed controller, and 127 is a controller for a melt surface level within the mold, the controller 127 comprising thermocouples in this example. Designated by 128 is a melt flow rate controller which comprises a sliding nozzle (hereinafter referred to as SN) in this embodiment, and 129 is a flow rate controller for gas blown into the pouring nozzle 143. Further, 19 designates a tundish. As described later in more detail, a multi-functional robot 104 of this example is to monitor a condition of the melt surface within the mold under casting, which condition is changed from time to time in the casting operation process of continuous casting, to detect an abnormal condition occurred on the melt surface, such as lack of powder, boiling/biased flow, formation of a slag beard or formation of a Deckel, to arrange and schedule the working contents to be fit for the most efficient sequence of works, for example, and to carry out multi-functional works using the robot and so forth for stabilizing an abnormal state of the melt surface, thereby eliminating the occurred abnormality.

In this example, a visual (image) sensor 108 is to pick up an image of a melt surface condition within the mold, which is to be handled by the multi-functional robot 104 and changed from time to time, and installed in pair at positions opposite to each other with the pouring nozzle 143 located therebetween. However, where the total region of the melt surface within the mold cannot be covered by only one pair of visual sensors in their viewing fields because of the large size of castings to be cast into products, the visual sensors may be provided in two or more pairs. Also, a load sensor 109 is of a 6-axis type sensor which measures load, torque, and the like exerted on the distal end of a tool. An ATC mechanism 110 controls change or attachment or detachment of tools 111, such as a powder scattering unit 112, a slag beard removing unit 113 and a Deckel detecting unit 114 (all described later), as well as an arm drive unit 137, through a robot controller 197 in response to commands issued from a synthetic judgment controller 105. Those tools 111 are set on a tool stand 115 installed near a robot body 106.

The robot body 106 comprises a support arm 133 of the horizontally multi-articulated type (consisted of support arms 134, 135 and 136 in this embodiment), which supports at its distal end one of the tools 111, such as a powder scattering unit 3+12, a slag rim removing unit 113 and a Deckel detecting unit 114, via the load sensor 109 and the ATC mechanism 110, and which is arranged to be rotatable and liftable; and arm drivers 138, 139 and 140 (collectively referred to as drive unit 137) for driving the support arms 134, 135 and 136, respectively. Thus, the tool 111 supported at the distal end of the support arm 133, specifically the tip end of the tool 111, can be freely moved back and forth as well as up and down above and/or near the melt surface within the mold 1. In this example, the support arms 134, 135 and 136 are arranged into the horizontally multi-articulated type as mentioned above. But, any other type arm may be used as long as the tool 111 can freely move within the mold 1. However, it has been found in this example that the horizontally multi-articulated type arm is more preferable because a space around the mold 1 and the tundish 19 is so small and narrow that a great degree of freedom cannot be taken in a vertical direction. Furthermore, the combination and number of the support arm 134, 135 and 136 and the driver unit 137 (specifically arm drivers 138, 139 and 140) are not limited to this example, because they should be so properly decided as to ensure the most efficient operation dependent on an available space.

Designated by 144 is a powder supply unit for supplying the powder 7 to the powder scattering unit 112. The powder supply unit 144 comprises, for example, valves 145, 146 for dispersing the powder 7 on the basis of unit by unit volume, a nozzle 147 for supplying the powder 7 to a predetermined position, and a hopper 148. Control of the valves 145, 146, for dispensing the powder is carried out by the robot controller 107 similarly as control of the ATC mechanism and so forth.

Although in this example the robot body 106, the supply unit 144 for the powder 7, and the tool stand 115 are installed on a base 149 on which the tundish 19 is rested, a part or all of those members, in particular, the robot body 106 by way of example, may be constituted in self-propelled fashion, as required.

Designated by 105 is a synthetic judgment controller which comprises an input section 130, a judging section 131, a setting section 132, a comparing and deciding section 141, and a control section 142 similarly as the above explained example. The synthetic judgment controller 105 monitors a condition of the melt surface within the mold under casting, which condition is changed from time to time; detects an abnormal condition occurred on the melt surface, such as lack of powder, boiling/biased flow, formation of a slag beard or formation of a Deckel, based on information from the visual sensors, etc.; arranges and schedules the working contents to be fit for the most efficient sequence of works, for example; and carries out multi-functional works using the robot and so forth for stabilizing an abnormal state of the melt surface, thereby eliminating the occurred abnormality.

Next, practical functions of the foregoing multi-functional robot will be described in more detail.

Figure 43:
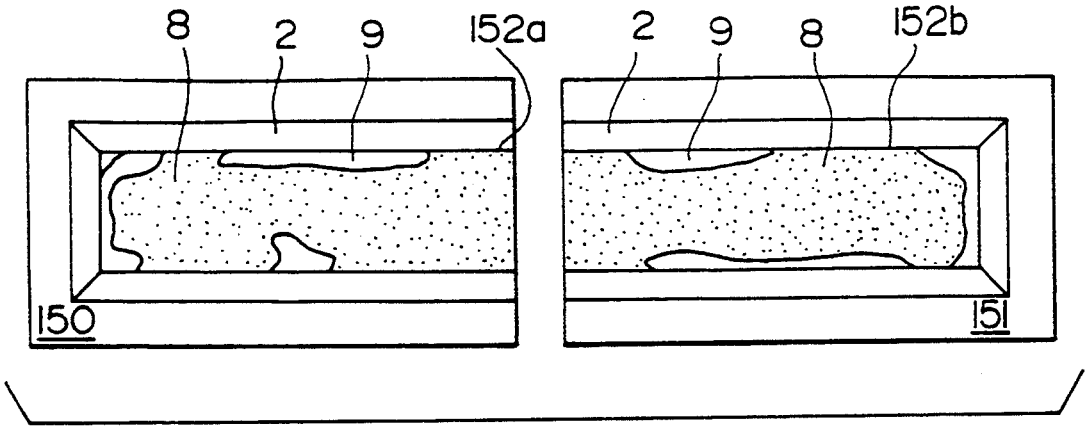

First, there will be explained a method of detecting the occurrence of boiling/biased flow or lack of powder and then preventing or eliminating it. FIG. 43 is a plan view of images of the melt surface within the mold under casting picked up by the visual sensors, wherein 150*a*, 151*b* each represent an image on either side of the pouring nozzle 143, and 152*a*, 152*b* indicate the melt surface regions within the mold corresponding to the images 150, 151, respectively. Designated by 2 is a mold inner wall on the inner side of which there appear non-molten powder parts 8 and molten powder parts 9. In order to detect an abnormality such as boiling/biased flow or lack of powder, an image processor in the input section 130 converts the original images 150*a*, 151*b* to a binary representation, that is, binary images 150*a*1, 151*b*1 shown in FIG. 44, where the parts of the molten powder layer 9 become light portions 158 and the parts of the non-molten powder layer 8 become dark portions 157. Then, the time-dependent changes and area of all the light portions 158 throughout the respective images are calculated to detect the occurrence of boiling/biased flow from the resulting degree of specific characteristics in the synthetic judgment controller 105 (input section 103—judging section 131). Furthermore, the images are divided into multiple zones 152*a*1–152*a*5, 152*b*1–152*b*5, respectively. The time-dependent changes and area of the light portions for each of the divided zones are calculated to detect a condition of lack of powder and a position of lack of powder in a manner similar to that in the above case. If the occurrence of boiling/biased flow is detected by the foregoing method, the synthetic judgment controller 105 (judging section 131—comparing and deciding section 141—control section 142) issues commands to control the process such as a casting speed and a flow rate of the melt, and also to supply the powder 7 by the powder supply unit 112, thereby eliminating the abnormal phenomenon. If lack of powder is detected, the synthetic judgment controller 105 similarly issues a command dependent on the detected lack position of powder and scatters the powder 7 to the corresponding position, thereby eliminating the condition of lack of powder. Here, the powder is scattered by the powder scattering unit 112. The powder supply unit 112 includes a cuplike reservoir 116 for storing a preset amount of the powder 7, the reservoir 116 being arranged such that it can be opened at its bottom or rotated. In response to commands from the synthetic judgment controller 105 and the robot controller 107, the reservoir 116 is moved to a predetermined location within the mold 1 and then opened at its bottom or rotated for scattering the powder 7.

Figure 45:
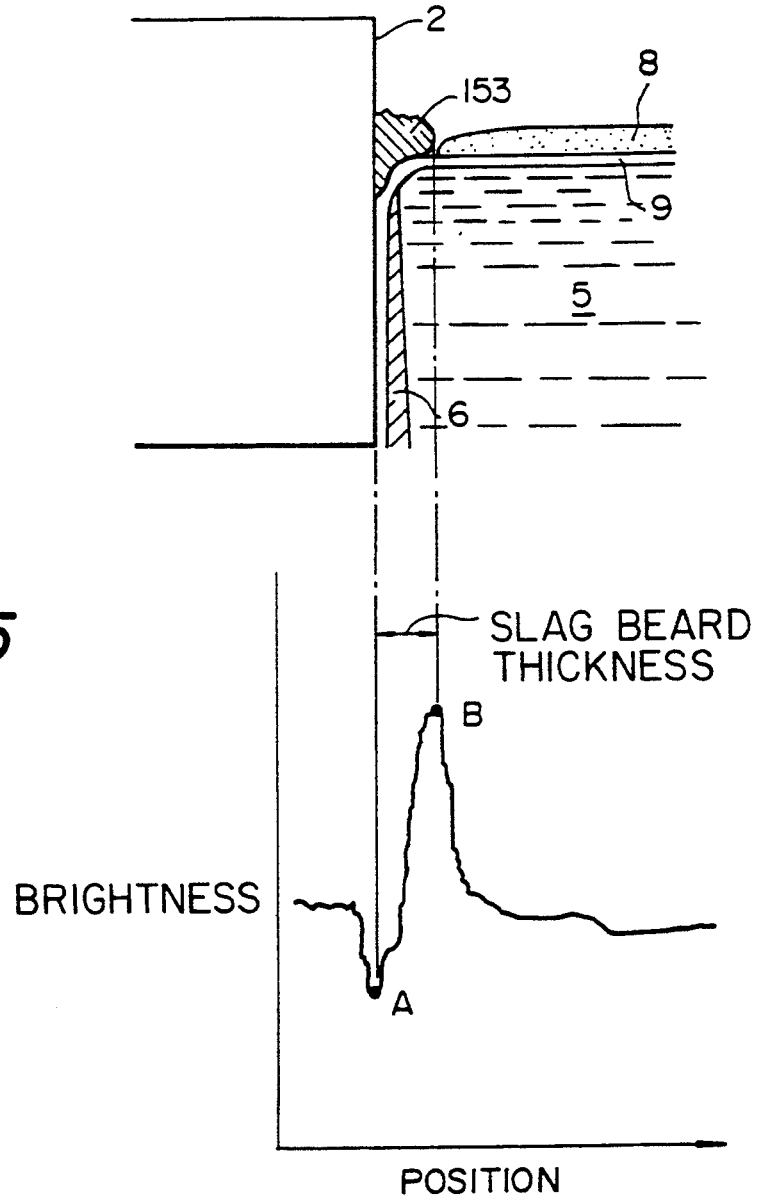
Figure 46:
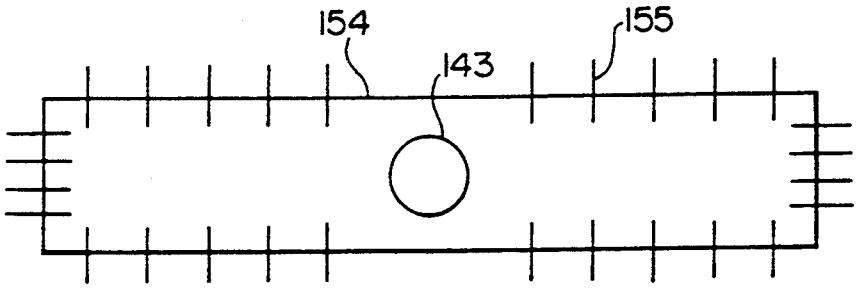

Secondly, there will be described a method of detecting a slag beard and preventing or eliminating it. FIG. 45 shows, in its upper half, a front sectional view taken vertically with respect to the mold in the vicinity of a meniscus during the casting operation and, in its lower half, distribution of brightness or lightness resulted when a condition of the interior of the mold is picked up or observed from above the mold. Designated by 153 is a slag beard produced when the molten powder 9 is cooled with the mold 1 so as to remelt and then adhere onto the mold inner wall 2. The slag beard 153 is more likely to produce upon fluctuations of the melt surface level. The slag beard thus formed is detected as follows. The processor in the input section 130 measures the distribution of brightness as shown in the lower half of FIG. 45. Then, the synthetic judgment controller 105 (input section 130—judging section 131) determines an A–B distance between a minimum point A, which corresponds to a boundary of the mold wall surface 2 and the slag beard 153 with low reflectance and at low temperatures, and a maximum point B, which corresponds to the distal end of the slag beard 153 where brightness becomes highest because the powder molten layer 9 is caused to appear and disappear due to oscillations of the mold and so forth. Based on the A–B distance, a thickness of the slag beard 153 is measured for detection of the formed slag beard. Note that the above peak in the distribution of brightness like B does not appear in the absence of the slag beard 153. FIG. 46 is a plan view showing measuring positions to detect the slag beard 153 through the above processing. Numeral 154 designates the entire region of the melt surface within the mold and 155 is a check line along which the above processing is performed for obtaining the distribution of brightness, with the pouring nozzle 143 being located at the center. If formation of the slag beard 153 and the formed position thereof are detected by the foregoing method, the synthetic judgment controller 105 (judging section 131—comparing and deciding section 141—control section 142) issues commands to remove the slag beard 153 at the corresponding position where the slag beard is formed. Here, the slag beard 153 is removed by the slag beard removing unit 113. The slag beard removing unit 113 has at its tip end a hitting oscillator 17 with an oscillation applying mechanism to crush the slag beard 153 or resonate the slag beard 153 for peeling it from the mold inner wall 2. In response to commands from the synthetic judgment controller 105 and the robot controller 107, the hitting oscillator 117 is moved to a predetermined location within the mold 1 and brought into contact with the slag beard 153 for removing it.

Figure 47:
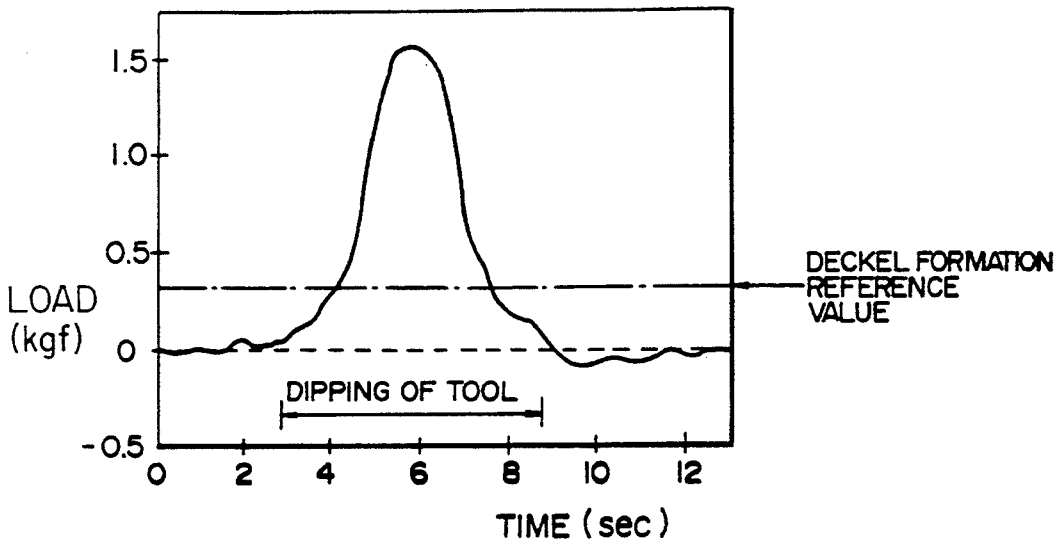
Figure 48:
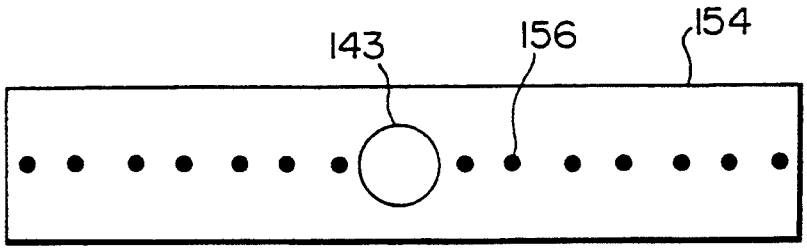

Thirdly, there will be described a method of detecting a Deckel and preventing or eliminating it. The Deckel means a phenomenon that the surface of the melt 5 within the mold 1 is cooled and solidified into the form of a leather cover. In particular, this phenomenon is more likely to occur at the initial stage of casting or when the casting speed is low. With this example, when the situations becomes more favorable for the Deckel to be formed, the synthetic judgment controller 105 (input section 130—judging section 131) issues commands to detect the Deckel based on information from the process controllers such as 121, 126. In response to the commands, the robot body 106 attaches the Deckel detecting unit 114 through the ATC mechanism 110 and then dips a sensor rod 119 at the distal end of the Deckel detecting unit 114 into the melt surface within the mold. Simultaneously, the load sensor 109 and a load calculator in the input section 130 measure the load exerted on the tip end of the sensor rod 119, and the synthetic judgment controller 105 (judging section 131—comparing and deciding section 141—control section 142) detects the presence or absence of the Deckel. FIG. 47 is a graph showing time-dependent changes in the load exerted on the sensor rod when it is dipped into the melt surface. As shown in FIG. 47, when the Deckel is formed, the tip end of the sensor rod 119 is subjected to reaction produced from the solidified steel, that is, Deckel. Thus, this reaction load is so increased beyond a Deckel formation reference value, which is a minimum reference value indicating the initial formation stage of the Deckel, that a large load value is detected. If the Deckel is not formed, there appears no peak shown in FIG. 47. The detected load value is less than the Deckel formation reference value, thereby providing a graph which includes no peak. When the formed Deckel is detected, the synthetic judgment controller 105 issues a command for the sensor rod 119 to push the Deckel further downwardly, for example, for causing the Deckel to remelt. FIG. 48 is a plan view showing measuring positions to detect the presence of a Deckel in the above mentioned manner. In FIG. 48, 156 is a check line along which the detection processing as explained above is carried out, 154 is the whole melt surface region within the mold, and 143 is a pouring nozzle.

Figure 44:
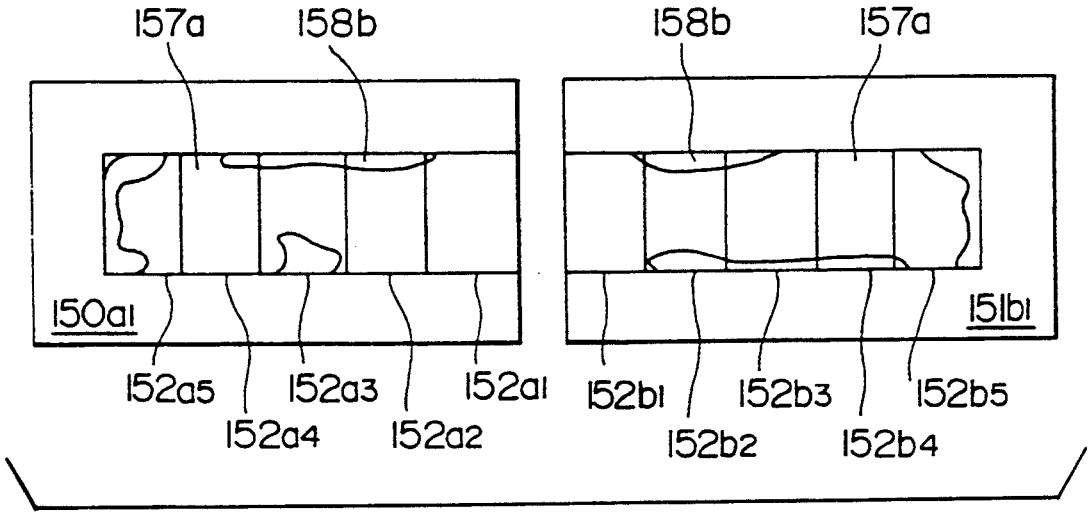

Fourthly, there will be described a method of operating the multi-functional robot 104 for the working contents and the working positions stated before. The priority to be followed by the multi-functional robot is set as follows by the setting section 132. There are many working contents such as elimination of boiling/biased flow, scatter of powder, removal of slag beard, and removal of Deckel. Further, each of the working contents is associated with control of a casting speed, flow rate of gas, and flow rate of melt, and includes a plurality of working positions as shown in FIGS. 44, 46 and 48. Therefore, priority among the working contents and the working positions is required to be set in advance to compare those contents and positions for proper section. First, in this embodiment, priority of the working contents was set based on the magnitudes with which they possibly affect the casting operation. The work sequence thus set is in order of elimination of boiling/biased flow, removal of Deckel, scatter of powder, and removal of slag beard. Then, for each of the working contents, the work sequence for the working positions, and the like, were set in consideration of characteristics of the respective detected phenomena relating to the continuous casting process. More specifically, as to boiling, since the volume of blown gas occupying in a flow passage of the melt is increased, the flow rate of melt is reduced relatively. Accordingly, it is required to set a casting speed to match the reduced flow rate of melt at that time. At the same time, in order to suppress fluctuations of the melt surface level within the mold, the flow rate of melt is also adjusted. Further, the flow rate of blown gas is adjusted to match the resulting condition to eliminate a state of boiling. If lack of powder is found simultaneously, the powder is scattered to the lack position thereof. Then, as to biased flow, since the flow passage of the melt is disturbed by deposits such as $Al_2O_3$ precipitated or separated out therein in many cases, a biased flow state is eliminated through slightly varied adjustment of the flow rate of melt by for example, moving a sliding nozzle (SN) vibratingly with small strokes, when it is used for adjusting the flow rate of melt, thereby to change a condition of the deposits, or regulating the flow rate of the blown gas. At this time, the casting speed may additionally be adjusted in order to suppress fluctuations of the melt surface level. Further, if lack of powder is found simultaneously, the powder is scattered to the lack position thereof. As to detection of the Deckel, it is taken into account that a flow of the melt discharged from the pouring nozzle 143 into the mold 1 is most likely to stagnate around the pouring nozzle on the melt surface. Therefore, priority of the working positions 156 was set such that the positions nearer the pouring nozzle had higher priority and, on the opposite sides of the pouring nozzle, higher priority is given to those positions located on the side where a flow of the discharged melt becomes more moderate from characteristics of flow rate control of the melt. As to scatter of the powder, since the powder flows into corners of the rectangular mold 1 in a larger amount, the positions near the short sides of the mold were given with higher priority. On the opposite sides of the pouring nozzle, higher priority is given to those positions located on the side where a flow of the discharged melt becomes more violent from characteristics of flow rate control of the melt, in contrast with the above. As to removal of the slag beard, it may obstruct inflow of the powder. Thus, priority was set as with the case of powder scatter for the same reasons as relating to inflow of the powder.

Fifthly, there will be described operation control of the multi-functional robot 104 to be carried out in the practical casting operation based on the priority mentioned above. The comparing and deciding section 141 performs the operation control as follows. During casting, operation commands for the plural working contents and the plural working positions as stated before are so often issued successively that those commands issued to effect actions necessary for the process of the multi-functional robot 104 become jammed in many cases. Therefore, operation control of the multi-functional robot 104 has to be carried out to handle the issued operation commands with maximum efficiency in such a manner as to prevent serious troubles and minimize adverse effect on the process. One example of the concept to realize this will be explained with reference to the following Table 1.

operation control of the multi-functional robot 104. Therefore, the works of eliminating boiling and biased flow are different from the work of powder scatter in the command count and priority, but equal thereto in working time. Priority in Table 1 is given by representing the priority preset by the setting section 132 in numerical values which are larger with higher priority. Its subscripts have the same meaning as that in a case of Command Count described above.

Then, there will be described one example of the concept of making operation control of the multi-functional robot 104 during the casting operation. Basically, the multi-functional robot 104 is controlled to operate following the foregoing priority preset by the setting section 132. During the practical casting operation, however, it often happens that the issued operation commands get in a jammed state. In such case, the operation control of the robot is proceeded as follows. First, the items in Table 1, that is, Type of Work, Command Count, Working Time (Start, Work (N-side), Move, Work (S-side), Communication, End) and Priority are

TABLE 1

| Types of Works | Command Counts (N/S) | Working Time (Related to Change of Tool) Start (N/S) | Work (N) | Move | Work (S) | Communication | End (N/S) | Priority (N/S) |
|---|---|---|---|---|---|---|---|---|
| Boiling/ | C sni | t psn | t pwni | t pm | t pwsi | t pc | t pen | p sni |
| Biased Flow | C ssi | t pss | | | | | t pes | P ssi |
| Deckel | C dni | t dsn | t dwni | t dm | t dwsi | t dc | t den | P dni |
| Removal | C dsi | t dss | | | | | t des | P dsi |
| Powder | C pni | t psn | t pwni | t pm | t pwi | t pc | t pen | P pni |
| Scatter | C psi | t pss | | | | | t pes | P psi |
| Slag Rim | C bni | t bsn | t bwni | t bm | t bwsi | t bc | t ben | P bni |
| Removal | C bsi | t bss | | | | | t bes | P bsi |

To begin with, terms and symbols used in Table 1 will be explained. N and S each represent either one of opposite areas or zones with respect to the pouring nozzle 143 as seen from in FIG. 46, for example. Command Count indicates the number of operation commands issued for the respective working contents and working positions at given time to cope with some melt surface abnormality recognized by the judging section 131. Its subscripts mean the type of work, the area (N or S) on either side with respect to the pouring nozzle 143, and a working position in that area, respectively, in this order. Working Time is related to change (attachment and detachment) and operation of the tool 111 of the multi-functional robot 104. This column includes, in order, Start (time required for attachment and move of the tool), Work (working time at the working position N), Move (moving time from the area N to S across the pouring nozzle 143), Work (working time at the working position S), Communication (communicating time of the commands and signals between the multi-functional robot 104 and the synthetic judgment controller 105), and End (time required for storing the tool 111 from the working position on the tool stand 115). Respective subscripts mean, in order, type of work (p: powder scatter, d: Deckel removal, b: slag beard removal), identification of the working content, the area on either side with respect to the pouring nozzle 143, and a working position in that area. Identification of the working contents is given by a subscript representing Start: a, Work: w, Move: m, Communication: c, or End: e. For boiling and biased flow, the action to be taken may include the work of powder scatter dependent on cases, in addition to process control. But, the process control can be made in parallel with operation of the robot, and only powder scatter is concerned with the generally indicated by n, $c_{ni}$, $t_{si}$, $t_{wni}$, $t_{mi}$, $t_{wsi'}$, $t_{ci}$, $t_{ei}$ and $P_{ni}$, respectively. Meaning of the subscripts is the same as that as explained above in connection with Table 1. Further, for each of the working contents and the working positions, an allowable time $t_{ani}$ within which the proper action has to be executed, counting from recognition of the occurred abnormality, is determined dependent on process situations. Then, during the casting operation, the comparing and deciding section 141 decides the works to be carried out within such a range as meeting Equations (1) nd (1') below:

$$t_{si}+t_{wni}+t_{ci}<t_{ani} \quad (1)$$

$$t_{si}+t_{wsi}+t_{ci}<t_{ani} \quad (1')$$

In addition, for each of the working contents and the working positions which provide Command Counts ($c_{ni}>0$), the comparing and judging section 141 monitors an emergency degree of work $E_{ni}$ expressed by the following Equations (2) and (2') at all times:

$$E_{ni}=(t_{si}+t_{wni}+t_{mi}+t_{ci}+t_{ei})/(C_{ni}\times P_{ni}) \quad (2)$$

$$E_{ni}=(t_{si}+t_{wsi}+t_{mi}+t_{ci}+t_{ei})/(C_{ni}\times P_{ni}) \quad (2')$$

On the other hand, for each of all the working contents and the working positions which provide Command Counts, all possible combinations $C_{ni}(t_{si}+t_{wni}+t_{mi}+t_{ci}+t_{ei})$ to be followed when performing the works are prepared and a working time $C_{tni}$ required for each combination is calculated. $C_{tni}$ is expressed by Equation (3) below;

$$C_{tni}=C_{ni}(\Sigma(t_{si}, t_{wni}, t_{mi}, t_{wsi}, t_{ci}, t_{ei}, )) \quad (3)$$

Next, the working time $C_{tni}$ required for each combination $C_{ni}$ is multiplied by the emergency degree of work $E_{ni}$ corresponding to the working position and the working content for the first work, thereby to derive a work priority index $P_{ni}$, which shall be monitored at all times, expressed by Equation (4) below:

$$P_{ni}=C_{tni}\times E_{ni} \quad (4)$$

Then, by comparing all the work priority indexed $P_{ni}$ thus derived to each other, those combinations $C_{ni}$ are selected in which any working content or working position having the minimum work priority index $P_{ni}$ is included within about the first ⅓ of the working time. Among those combinations $C_{ni}$, that combination $C_{ni}$ which has the working time $C_{tni}$ with the minimum work priority index $P_{ni}$ is decided as a highest priority working route at that comparing and deciding time point. After scheduling and deciding the work sequence in this way, a control command is issued to the control section 142. The above processing is carried out for each communication of the command between the multi-functional robot 104 and the synthetic judgment controller 105. However, this is not applied to such a case where some action or the like in a certain condition is uniquely determined dependent on, for example, process characteristics. Thus, operation of the multi-functional robot 104 is controlled based on a plurality of operation scheduling items, such as an emergency degree and an operating time of the robot, for each work process. It is to be noted that the operation control processing mentioned above only represents one example in which it is applied to the casting operation process for continuous casting and tuned to the process, and that the practical processing method is not limited to the foregoing example.

As fully described above, the multi-functional robot in this example is to handle a condition of the melt surface within the mold where operating environments are changed from time to time, and in the working process where a plurality of working contents have to be determined and carried out dependent on varying conditions of the operating environments detected by sensors and the like, this example makes it possible to perform multi-functional works efficiently by using the robot able to carry out plural works, and controlling the preset priority of works dependent on information related to the process and applied from the sensors, as well as working conditions of the robot. Note that the above mentioned sections in the synthetic judgment controller 105 are separated for convenience only from a point of individual functions. The respective sections are not necessarily all dependent or each constituted into a one-piece unit in a level of hardware and/or software. The optimum system configuration can be defined to match individual features of the application process. Furthermore, in the casting operation process for continuous casting to which the example is applied, since the molten steel is directly handled, the working place becomes about 80°–90° C. In a higher temperature region due to, for example, radiated heat from the pouring nozzle 143. In addition, presence of many dust sources such as powder and burning particles makes the working environments very dusty. Therefore, in order that the robot can be stably operated even under high-temperature, dusty environments, the following structures and measures are incorporated for protection against heat and dust.

1) The visual sensors 108 to be installed just above the melt surface are each placed in a box with its face directed to the melt surface formed of heat resistant glass. Cooling air is introduced to flow in the box and then ejected toward the melt surface for preventing adhesion of dust onto the glass surface.
2) An air curtain is formed along the front face of the tool stand 115. In particular, air is blown to a portion of each tool 111 at which it is detachably attached to the ATC mechanism 110, for preventing dust from adhering to that tool portion.
3) Air purge is also applied to a portion of the ATC mechanism 110 to which the tool 111 is detachably attached, at the time of change of the tool.
4) The support arm 133 is made dust-proof by blowing air into the interior thereof or using a magnetic fluid.
5) Air is blown to the arm drive unit 137 for cooling.

These protection structures and measures enable to ensure very stable intended functions even in the field of casting operation for a long time.

As a result of implementing the casting operation by using the multi-functional robot 104 under the casting conditions where the cross-sectional size of castings is 250 mm×1000 mm and the casting speed is 1.6 m/min, it was never found that operations of the multi-functional robot 104 were so extremely jammed that the casting operation was affected to a large extent. Also, the stable casting operation could be performed without intervention of any operators. In addition, the castings having been cast in this example were completely free of surface defects and extremely excellent in quality.

In short, the apparatus this embodiment makes it possible to automate the working process where a plurality of working contents have to be determined and carried out dependent on varying conditions of the operating environments detected by sensors and the like, by using a multi-functional robot able to carry out plural works, and controlling the preset priority of works dependent on information related to the process and applied from the sensors, as well as working conditions of the robot. It becomes thus possible to achieve a multi-functional robot which can perform various works with maximum efficiency even while monitoring a condition of the melt surface within the mold where operating environments are changed from time to time.

What is claimed is:

1. In a continuous casting apparatus including a mold and a multi-functional robot said robot further comprising:

a multi-articulated support arm, said support arm being freely rotatable and vertically movable, and having at its distal end an automatic tool changer mechanism, and a drive controller for driving said support arm;

at least one visual sensor disposed near a working region of said support arm for picking up images of the working region of said robot;

a load sensor disposed near said automatic tool changer mechanism for detecting the load exerted on a tip end of a tool;

a process detecting sensor for detecting operating conditions of said continuous casting process to be handled by said robot; and a synthetic judgement controller which includes:

a) an input means for receiving input signals from said visual, load and process detecting sensors;

b) a judging means for processing said input signals in accordance with a previously established sequence, and judging situations in working contents of said robot and the working region of said robot at a current time;

c) a setting means for pre-setting priority of working positions and the working contents based on current operating conditions of the process to be handled by said robot and situations in the working region of said robot;

d) a comparing and deciding means for comparing respective signals from said judging means and said setting section with each other, and scheduling and deciding the highest-priority or a most efficient working content dependent on the current situations; and e) a control means for issuing at least one of a tool change command signal to said automatic tool changer mechanism, a drive control signal to said support arm drive controller, and a control signal to control said process based on decision of the working contents made by said comparing and deciding means.

2. An apparatus according to claim 1 wherein:

said working region is a region around said mold for continuous casting;

said visual sensor includes at least one pair of image sensors for detecting a melt surface condition disposed at positions above said mold, which has a pouring nozzle being disposed in the center area of an upper opening portion of said mold, said image sensors being positioned on opposite side of said pouring nozzle;

said load sensor includes a sensor for detecting said load exerted from a melt within said mold on a sensor rod which is supported by said support arm and dipped into the melt surface within said mold for continuous casting;

said process detecting sensor includes a casting speed sensor, an in-mold melt surface level sensor, a melt flow rate sensor, and a flow rate sensor for gas blown into said pouring nozzle;

said working contents includes adjustment of a casting speed, adjustment of a flow rate of the melt, blow of gas into said pouring nozzle, scatter of powder into said mold, removal of a slag beard, and remelting of a Deckel by pushing the Deckel into the melt; and said tool includes means for supplying powder into said mold, a slag beard removing unit, and a Deckel removing unit.

3. An apparatus according to claim 2 wherein;

said powder supplying means has a powder reservoir for storing a preset amount of powder;

said slag beard removing unit is provided at its tip end with an oscillation applying mechanism designed to crush or resonate a slag beard for peeling the slag beard from a mold wall; and said Deckel detecting unit has said sensor rod.

4. An apparatus according to claim 3 wherein said control means includes a casting speed controller, an in-mold melt surface level casting speed controller, a melt flow rate controller, and a blown gas flow rate controller.

5. An apparatus according to claim 4 wherein said in-mold melt surface lever controller includes thermocouples.

6. An apparatus according to claim 4 wherein said melt flow rate controller includes a sliding nozzle.

7. An apparatus according to claim 4 wherein said blown gas flow rate controller includes a part thereof fitted to said pouring nozzle extending from a tundish into said mold.

8. An apparatus according to claim 3 wherein said means for supplying powder includes:

a powder supply unit for storing a preset amount of powder and capable of being opened at the bottom thereof or being turned;

a feed unit for feeding powder to said powder supply unit;

said powder supply unit being supported by said multi-articulated support arm at the distal end thereof;

a drive unit for driving said support arm; and said powder supply unit and said drive unit being actuated in response to detected signals indicating lack of powder and a position of lack of powder.

* * * * *